US006176570B1

(12) United States Patent
Kishima et al.

(10) Patent No.: US 6,176,570 B1
(45) Date of Patent: Jan. 23, 2001

(54) PRINTER APPARATUS WHEREIN THE PRINTER INCLUDES A PLURALITY OF VIBRATING PLATE LAYERS

(75) Inventors: Koichiro Kishima, Kanagawa; Tetsuo Nakayama, Tokyo; Takaaki Murakami, Kanagawa, all of (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/685,724

(22) Filed: Jul. 24, 1996

(30) Foreign Application Priority Data

Jul. 26, 1995 (JP) ..... 7-190750
Jul. 27, 1995 (JP) ..... 7-192201
Jul. 28, 1995 (JP) ..... 7-193366

(51) Int. Cl.[7] ..... B41J 2/045
(52) U.S. Cl. ..... 347/70; 310/358
(58) Field of Search ..... 347/68–72; 29/25.35

(56) References Cited

U.S. PATENT DOCUMENTS 4,888,598 * 12/1989 Heinzl et al. ..... 347/70
5,505,364 * 4/1996 Plesinger et al. ..... 347/71
5,821,121 * 10/1998 Shimada ..... 347/68 X

FOREIGN PATENT DOCUMENTS 42 01 923 8/1992 (DE) .
0 220 949 5/1987 (EP) .
563603 A2 * 6/1993 (EP) ..... B41J/2/16
0 709 195 5/1996 (EP) .

OTHER PUBLICATIONS

Patent Abstracts of Japan, vol. 15, No. 414, Oct. 22, 1991, JP03173650 (Seiko Epson Corp.).

Patent Abstracts of Japan, vol. 11, No. 269, Sep. 21, 1987, JP62073952 (Seiko Epson Corp.).

Patent Abstracts of Japan, vol. 11, No. 33, Jan. 30, 1987, JP61200800 A (Nippon Denso Co. Ltd.).

Patent Abstracts of Japan, vol. 10, No. 151, May 31, 1996, JP61003751A, (Konishiroku Shashin Kogyo KK).

Patent Abstracs of Japan, vol. 10, No. 129, May 14, 1996, JP60260297 A, (Nippon Denso KK).

* cited by examiner

*Primary Examiner*—John Barlow
*Assistant Examiner*—C Dickens
(74) *Attorney, Agent, or Firm*—Hill & Simpson

(57) ABSTRACT

A printer apparatus comprising a discharge nozzle; a pressure chamber communicated with this discharge nozzle; vibrating plates covering the pressure chamber; and a piezoelectric element arranged corresponding to the pressure chamber via the vibrating plates, the vibrating plates comprising a plurality of layers, at least one layer of the vibrating plates covering the entire pressure chamber, and the remaining layers of the vibrating plates being partially removed by using the piezoelectric element as the mask and controlled to substantially the same width as that of the piezoelectric element and, in addition, a method of production of the same.

22 Claims, 44 Drawing Sheets

PRINTER APPARATUS WHEREIN THE PRINTER INCLUDES A PLURALITY OF VIBRATING PLATE LAYERS

BACKGROUND OF THE INVENTION

1. Field of the Invention

The present invention relates to a printer apparatus for printing an image on a recording medium by discharging a discharging medium filled in a pressure chamber from a discharge nozzle by a bimorphic effect of a piezoelectric element and a vibrating plate and to a method of production of the same.

2. Description of the Related Art

The conventional so-called "on-demand type" ink jet printer is a printer which discharges ink droplets from a nozzle in accordance with a recording signal so as to record an image on a recording medium such as paper or film. This printer enables a reduction of size and a reduction of cost, so has been rapidly spreading in recent years.

On the other hand, in recent years, particularly in the office, there has been a boom in the production of documents by computers in what is known as "desk top publishing". Recently, there has been increased demand for printing not only characters and figures, but also color natural images such as photographs together with the characters and figures. To print a high quality natural image in this way, reproduction of halftones is very important.

In this on-demand type ink jet printer, the general methods used to discharge the ink droplets have been the method of using for example a piezoelectric element and the method of using a heat generating element. The method of using a piezoelectric element uses the deformation of the piezoelectric element to give a pressure to the ink and thereby discharge the same from the nozzle. On the other hand, the method of using the pressure of bubbles generated by heating and boiling the ink by a heat generating element to discharge the ink.

To reproduce halftones, there are the method of changing the voltage given to the piezoelectric element or the heat generating element and the pulse width so as to control the size of the droplets to be discharged, thereby making variable the diameter of the printing dots and expressing a tone and the method of including a pixel by a matrix consisting of for example 4×4 dots without a change of the dot diameter and expressing the tones by using the so-called dither method in units of this matrix.

The method of using the deformation of a piezoelectric element to give pressure to the ink and discharge the same from a nozzle includes a method in which a plurality of superposed layers of piezoelectric elements are made to linearly displaced to push the vibrating plate and a method of giving a voltage to a piezoelectric element including a single layer or two superposed layers clad to a vibrating plate so as to cause the vibrating plate to bend.

FIG. 1 and FIG. 2 show a print head in a printer apparatus using a single-plate type piezoelectric element. This print head comprises a base 101 made of for example a photosensitive glass, a vibrating plate 102 attached to this base 101, a piezoelectric element 103 provided on this vibrating plate 102, and an orifice plate 105 on which the discharge nozzle 104 is formed.

On the base 101, as shown in FIG. 1, an ink introduction hole 106 for introducing the ink and a pressure chamber 107 for accommodating the ink are formed. The vibrating plate 102 is attached to the base 101 so as to cover these ink introduction hole 106 and pressure chamber 107. The piezoelectric element 103 has electrodes 108 and 109 on the upper and lower surfaces of its thickness direction as shown in FIG. 1, respectively, and is bonded onto the vibrating plate 102 at a position corresponding to the pressure chamber 107 by an adhesive or the like. The orifice plate 105 is provided on the surface of the base 101 opposite to the surface on which the vibrating plate 102 is provided. The discharge nozzle 104 provided on this orifice plate 105 is communicated with the pressure chamber 107.

In this print head, when a voltage is applied to the piezoelectric element 103, the piezoelectric element 103 deforms due to the bimorphic effect and the displacement thereof is transferred to the pressure chamber 107 via the vibrating plate 102. Then, due to the displacement of this piezoelectric element 103, the volume of the pressure chamber 107 is reduced and the ink filled in the pressure chamber 107 is discharged from the discharge nozzle 104.

In the method of bending the vibrating plate by giving a voltage to a piezoelectric element including a single layer or two superposed layers adhered to the vibrating plate, however, there is a problem that it is difficult to achieve a fine pitch when adhering cut piezoelectric elements onto a vibrating plate. Further, where arranging paste-like piezoelectric elements on the vibrating plate by a means such as printing and then performing sintering, the heat resistance of the vibrating plate makes it difficult to raise the sintering temperature to 1000° C. or more, so there is the defect that the characteristic of the piezoelectric material cannot be sufficiently exhibited. Further, in the method of cutting after adhering a piezoelectric element to a vibrating plate, it is difficult to cut only the piezoelectric element without scratching the vibrating plate and, at the same time, it is not easy to always cut to a constant depth when considering the wear of the tool and the positional precision of the machine tool.

On the other hand, in the method of causing straight displacement of a plurality of layers of superposed piezoelectric elements to push the vibrating plate, the piezoelectric elements per se become expensive so there is a disadvantage in view of costs.

OBJECT AND SUMMARY OF THE INVENTION

The present invention was proposed in consideration with the above problems and has as an object thereof to provide a printer apparatus using a single or a plurality of superposed layers of piezoelectric elements and at the same time provide a method of production of a printer apparatus which stabilizes the process, brings out the full characteristics of the piezoelectric material, and further enables a fine pitch.

The present inventors engaged in intensive investigations so as to solve the above problems and consequently found the fact that it was possible to bring out the full inherent characteristics of a piezoelectric material and realize a fine pitch by providing not a single layer of a vibrating plate, but a superposed structure of a plurality of layers of vibrating plates, causing at least one layer among them to function as an original vibrating plate and not cutting up to the vibrating plate made to function as the original vibrating plate by the machining performed when cutting the piezoelectric elements, and removing the other vibrating plates remaining at the cut portions just before this by etching as an etching stop layer or the like.

Accordingly, the present invention provides a printer apparatus including a discharge nozzle; a pressure chamber communicated with this discharge nozzle; vibrating plates covering the pressure chamber; and a piezoelectric element arranged corresponding to the pressure chamber via the vibrating plates, the vibrating plates including a plurality of layers, at least one layer of the vibrating plates covering the entire pressure chamber, and the remaining layers of the vibrating plates being partially removed by using the piezoelectric element as the mask and controlled to substantially the same width as that of the piezoelectric element.

In addition, the present invention provides a method of production of a printer apparatus having a discharge nozzle, a pressure chamber communicated with this discharge nozzle, and vibrating plates covering the pressure chamber, the vibrating plates including a plurality of layers including an etching stop layer, including a first step of bonding a piezoelectric element layer onto the vibrating plates; a second step of cutting the piezoelectric element layer and the vibrating plates to a depth where the piezoelectric element layer is cut and a part of the vibrating plates remain so as to form a groove; and a third step of etching the groove to a depth where at least the etching stop layer is exposed by utilizing the difference of the etching rates of two layers in contact with each other among the plurality of layers of vibrating plates.

In addition, the present invention provides a printer apparatus including a plurality of discharge nozzles, a plurality of pressure chambers communicated with the respective plurality of discharge nozzles, vibrating plates covering the plurality of pressure chambers, and a plurality of piezoelectric elements arranged on the vibrating plates, the vibrating plates including a plurality of layers, at least one layer of the vibrating plates covering all of the plurality of pressure chambers, the vibrating plates of the remaining layers being partially removed by using the piezoelectric elements as the mask and controlled to substantially the same width as that of the piezoelectric elements.

BRIEF DESCRIPTION OF THE DRAWINGS

These and other objects and features of the present invention will become more apparent from the following description of the preferred embodiments given with reference to the attached drawings, in which.

DETAILED DESCRIPTION OF THE PREFERRED EMBODIMENTS

Figure 1:
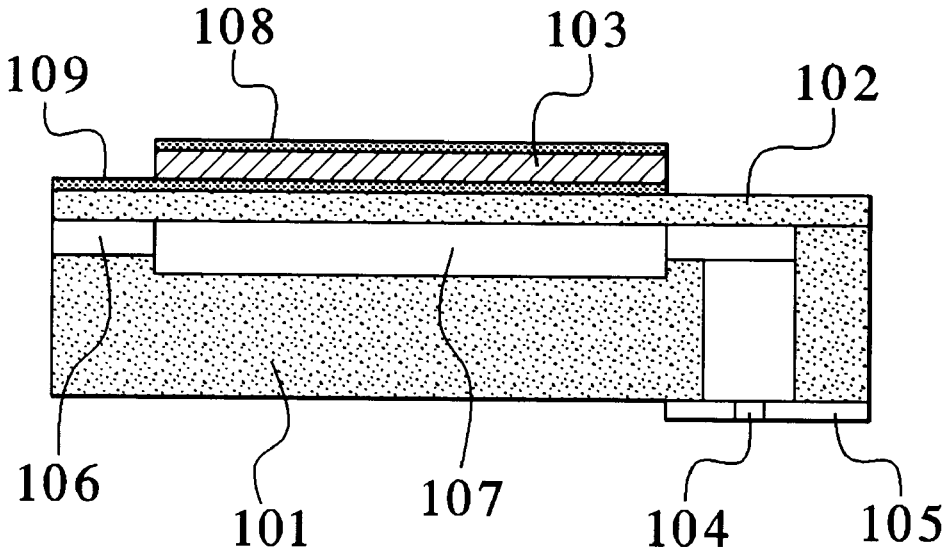
FIG. 1 is a vertical sectional view of a conventional print head.
Figure 2:
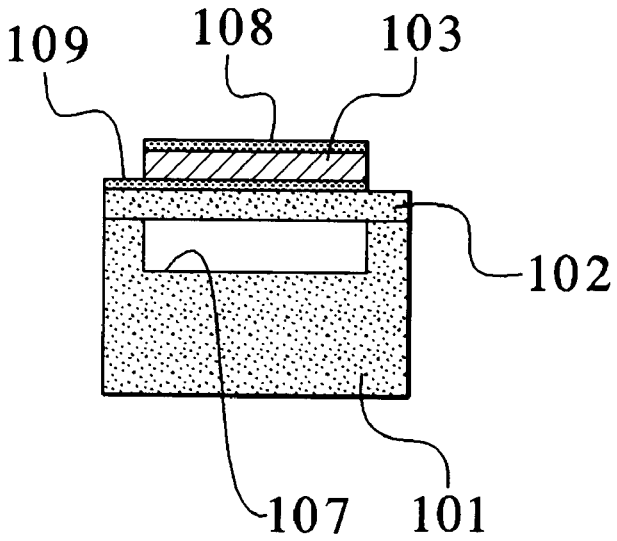
FIG. 2 is a lateral sectional view of the conventional print head.

Below, embodiments of a printer apparatus to which the present invention is applied and a method of production thereof will be explained in detail referring to the drawings.

Embodiment 1

Figure 3:
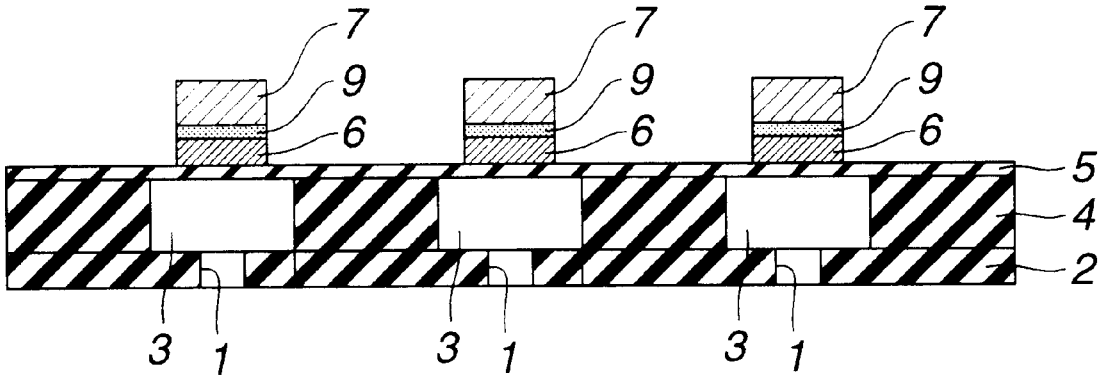
FIG. 3 is a lateral sectional view of a print head constituting by a two-layer structure of vibrating plates.
Figure 4:
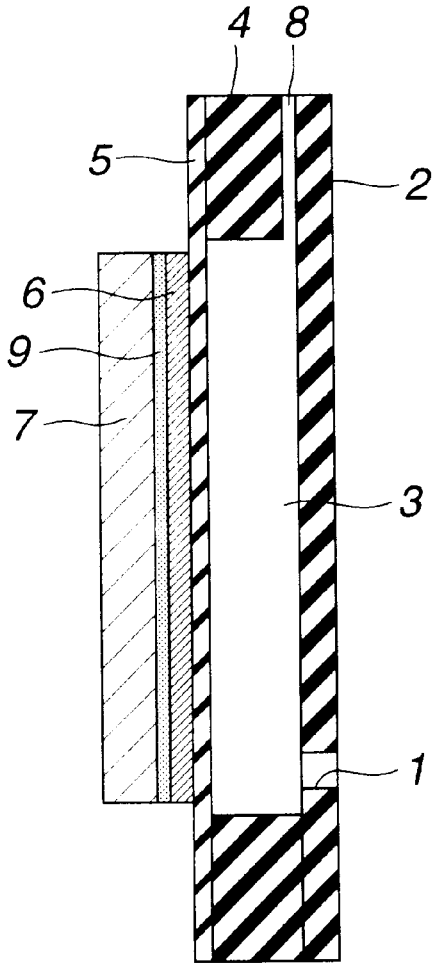
FIG. 4 is a vertical sectional view of a print head constituted by a two-layer structure of vibrating plates.

FIG. 3 and FIG. 4 are a vertical sectional view and a lateral sectional view of a print head in a printer apparatus according to the present invention.

This print head is provided with an orifice plate 2 having a plurality of discharge nozzles 1, a base 4 having pressure chambers 3 communicated with the discharge nozzles 1 and provided corresponding to the discharge nozzles 1, vibrating plates 5 and 6 attached to the base 4, and piezoelectric elements 7 arranged via these vibrating plates 5 and 6 corresponding to the pressure chambers 3.

Figure 5:
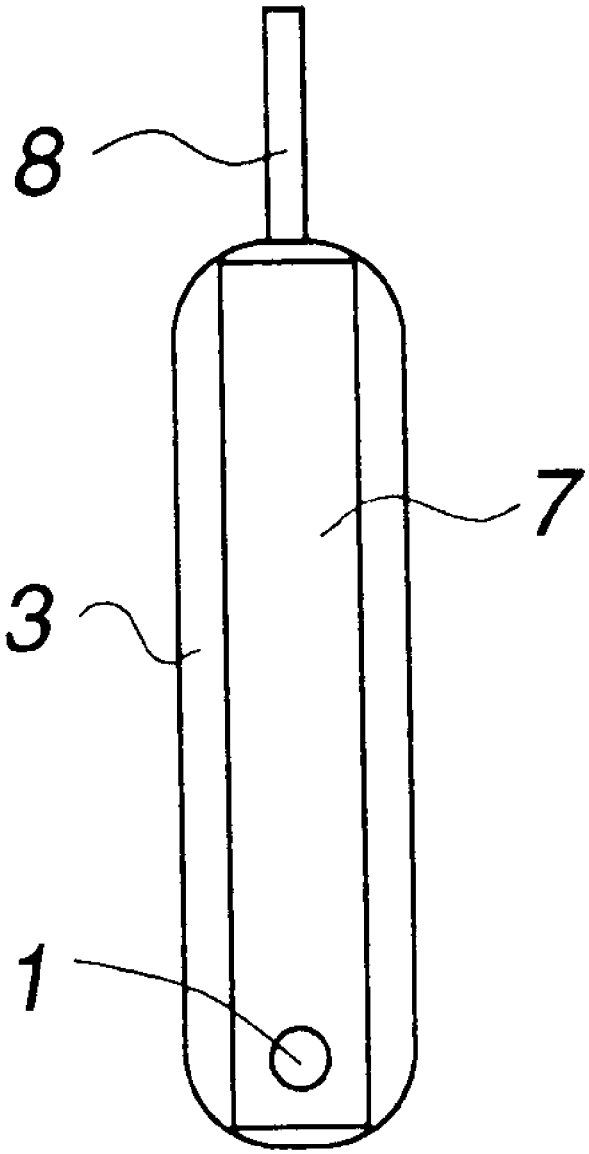
FIG. 5 is a perspective view of a print head constituted by a two-layer structure of vibrating plates.

The orifice plate 2 is formed as a substrate having a plurality of discharge nozzles 1 for discharging the ink as shown in FIG. 3 and FIG. 4 and is attached to the surface of the base 4 opposite to the surface on which the vibrating plate 5 is provided. The discharge nozzles 1 provided on this orifice plate 2 are provided facing the respective pressure chambers 3 formed in the base 4 and, at the same time, are communicated with the respective pressure chambers 3. The shape of the outlets of the discharge nozzles 1 may be either a round shape or square shape since the ink is designed to try to become spherical due to its surface tension. In this example, as shown in FIG. 5, the shape of the outlets of the discharge nozzles 1 is made circular.

As shown in FIG. 3 and FIG. 4, flow paths for guiding the ink to the discharge nozzles 1 are formed in the base 4. Each of the flow paths comprises a pressure chamber 3 which exhibits a parallelogram shape and serves as an ink accommodating portion at a position facing the piezoelectric element 7 and an ink feed path 8 communicating with this pressure chamber 3 as shown in FIG. 5. The ink is introduced into the pressure chamber 3 from the ink tank after passing through the ink feed path 8.

The vibrating plates 5 and 6 form a two-layer structure of two superimposed vibrating plates as shown in FIG. 3 and FIG. 4. One vibrating plate 5 is provided on the surface of the base 4 opposite to the surface at which the orifice plate 2 is provided so as to cover all of the pressure chambers 3 provided in the base 4. The other vibrating plate 6 is given substantially the same width as that of the piezoelectric elements 7 by partial removal using the piezoelectric elements 7 as a mask as indicated in the method of production mentioned later.

Figure 6A:
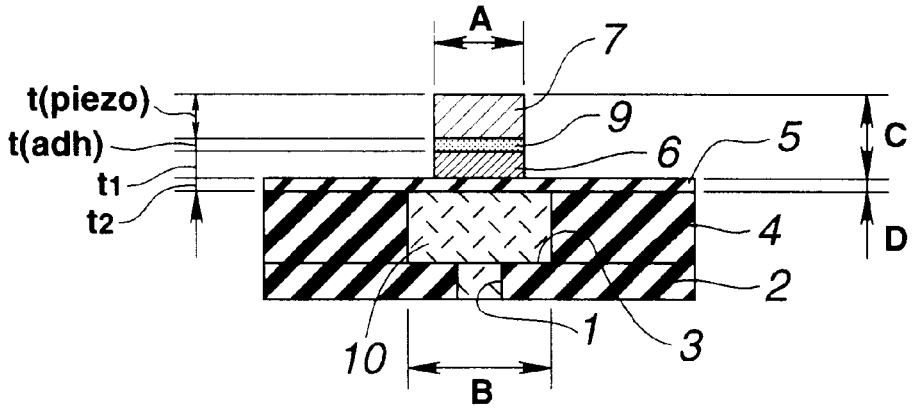
FIG. 6A and FIG. 6B are sectional views of an ink discharge standby state of a print head constituted by a two-layer structure of vibrating plates.
Figure 6B:
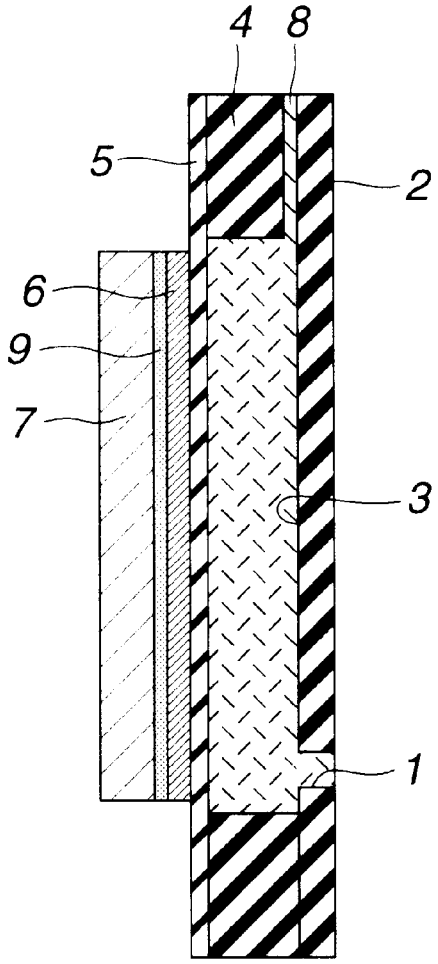

The piezoelectric element 7 is made of a monomorphic element obtained by forming electrodes on upper and lower surfaces of a sintered ceramic and serves to change the pressure in the pressure chamber 3 by deformation by application of voltage so as to discharge the ink, that is, the discharge medium, from the discharge nozzle 1. This piezoelectric element 7 is formed as a parallelogram and is bonded to the vibrating plate 6 via an adhesive layer 9 as shown in FIGS. 6A and 6B.

Figure 7A:
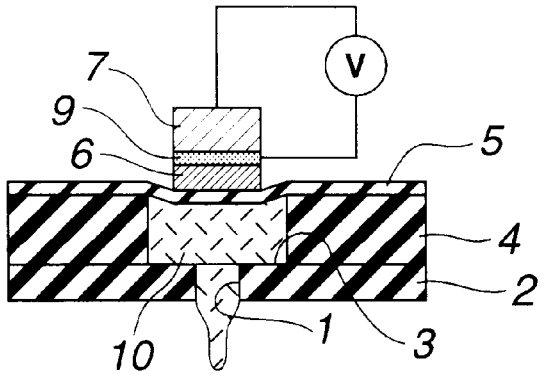
FIG. 7A and FIG. 7B are sectional views of a state of ink discharge of a print head constituted by a two-layer structure of vibrating plates.
Figure 7B:
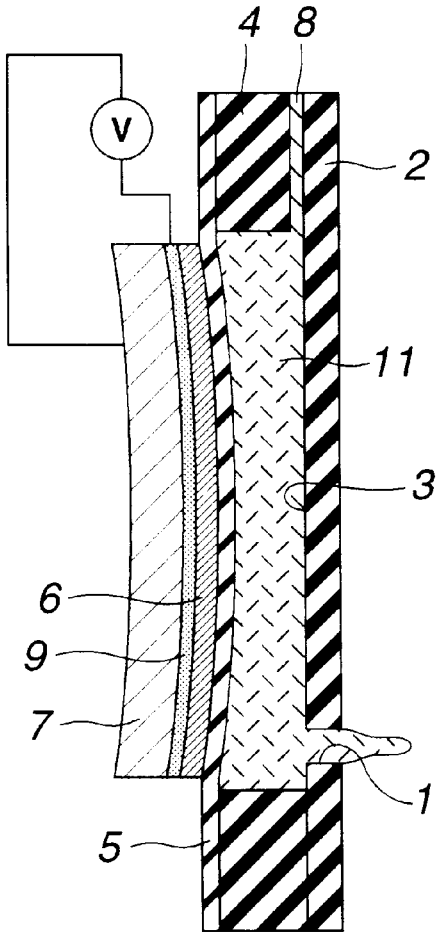

The discharging operation of the ink in the print head constituted in this way is as follows. When a voltage is given to a piezoelectric element 7 from the initial state shown in FIGS. 6A and 6B, as shown in FIG. 7, the bimorphic effect of the piezoelectric element 7 and the superposed vibrating plates 5 and 6 causes these piezoelectric element 7 and vibrating plates 5 and 6 to bend. For this reason, pressure is given to the pressure chamber 3 corresponding to the piezoelectric element 7 so as to discharge the ink 10 filled in the pressure chamber 3 from the discharge nozzle 1.

In this print head, that is, the bimorphic effect is generated by the two superposed layers of vibrating plates 5 and 6 and the piezoelectric element 7. The only load when obtaining the displacement necessary for raising the pressure in the pressure chamber 3 is the vibrating plate 5 of the lowermost layer provided covering the pressure chamber 3. When illustrating this, as shown in FIG. 6A, the portion indicated by C in the figure mainly generates the displacement force, and the portion indicated by D in the same figure acts as the load.

Accordingly, the width B of the pressure chamber 3, provided wide so as to weaken the displacement strength in the structure of a conventional ink jet head, can be made narrower than the width A of the piezoelectric element 7. As a result, in this print head, it becomes possible to reduce the size of the pressure chambers 3, raise the density of arrangement of the pressure chambers 3, and in turn reduce the intervals between the discharge nozzles 1 communicated with the pressure chambers 3.

Further, in this print head, there is an advantage that an error in the thickness of the adhesive layer 9 does not exert an influence upon the load. In FIG. 6A, where the thickness of the piezoelectric element 7 is t(piezo), the thickness of the adhesive layer 9 is t(adh), the thickness of the vibrating plate 6 of the upper layer is t1, and the thickness of the vibrating plate 5 of the lower layer is t2, the degree of influence on the load can be represented by $$\Delta t(\text{adh})/(t(\text{piezo})+t(\text{adh})+t1)$$

That is, the error of thickness of the adhesive exerts an influence of only one power.

The print head constituted as described above is produced according to the following method.

Figure 8:
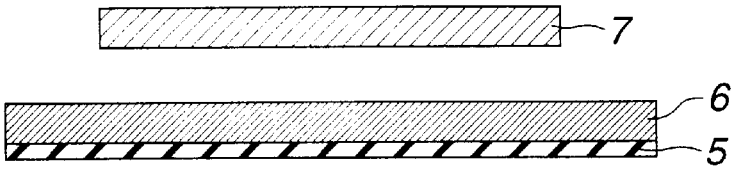
FIG. 8 shows a method of production of a print head constituted by a two-layer structure of vibrating plates and is a sectional view showing the state before the piezoelectric element layer is bonded to the vibrating plates.

First, as shown in FIG. 8, vibrating plates 5 and 6 for forming the two-layer structure and the piezoelectric element layer 7 are prepared. The materials for the vibrating plates 5 and 6 for forming the two layers are selected so that the vibrating plate 5 of the lower layer will not etched by the solution for dissolving the vibrating plate 6 of the upper layer and will thereby act as an etching stop layer. Further, the material of the vibrating plate 5 of the lower layer is selected to be free of almost all pits. Further, both of the vibrating plates 5 and 6 of the upper layer and the lower layer are desirably electrically conductive.

More specifically, the vibrating plate 6 of the upper layer may be made of a metal foil having a thickness of 20 $\mu$m or more mainly composed of copper, while the vibrating plate 5 of the lower layer may have a thickness of 15 $\mu$m or less and be made of mainly composed of nickel or titanium. Further, as to the method of superposing these vibrating plates 5 and 6, it is sufficient so far as they are tightly bonded. There exist a method of forming the vibrating plate 5 of the lower layer on the vibrating plate 6 of the upper layer by plating or a method of forming the vibrating plate 6 of the upper layer on the vibrating plate 5 of the lower layer by plating and further a method of bonding the vibrating plate 6 of the upper layer and the vibrating plate 5 of the lower layer, more specifically, a method of bonding them by adding a weight in a vacuum atmosphere etc.

On the other hand, the piezoelectric element layer 7 is comprised of a sintered ceramic having electrodes on its upper and lower surfaces. FIG. 8 shows this while omitting the electrodes. The thickness of this piezoelectric element layer 7 is desirably 200 $\mu$m or less. Note that, in this example, an explanation is made of a single piezoelectric element layer 7, but there is no problem even if it is a superposed assembly of piezoelectric element layers.

Further, the material of the vibrating plate 5 of the lower layer is desirably formed by rolling since there is a smaller possibility of existence of pits formed in a later stage in a material formed by press rolling than a material formed by the plating. Further, more desirably all materials constituting the vibrating plates 5 and 6 are formed by rolled foil.

Figure 9:
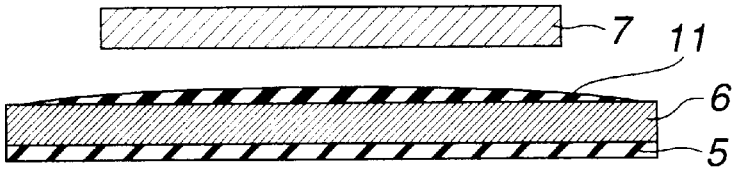
FIG. 9 shows a method of production of a print head constituted by a two-layer structure of vibrating plates and is a sectional view showing a state where an adhesive is coated on the vibrating plates.

Next, as shown in FIG. 9, an adhesive 11 is coated on the vibrating plate 6 of the upper layer between the laminated vibrating plates 5 and 6. Alternatively, it is also possible to coat the adhesive 11 on the surface of the piezoelectric element layer 7 and further both sides of the piezoelectric element layer 7 and the vibrating plate 6. It is sufficient so far as the adhesive 11 has a strength that is durable so that the vibrating plates 5 and 6 will not be peeled off in the later cutting process of the piezoelectric element layer 7. Further, this adhesive 11 desirably has electrical conductivity. More concretely, it may be a material obtained by mixing electrically conductive particles such as a metal in a epoxy adhesive.

Figure 10:
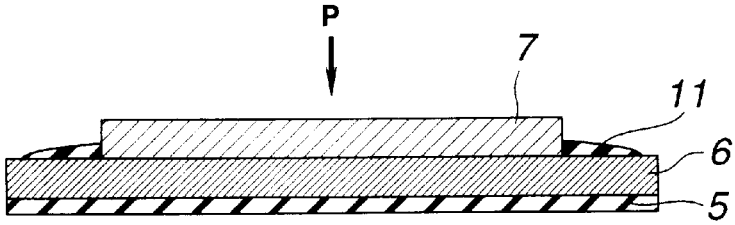
FIG. 10 shows a method of production of a print head constituted by a two-layer structure of vibrating plates, and is a sectional view showing a state where a piezoelectric element layer is bonded to the vibrating plates.

Subsequently, as shown in FIG. 10, a pressure P is added from the piezoelectric element layer 7 side and to perform pressing so that the vibrating plates 5 and 6 and the piezoelectric element layer 7 can be bonded more strongly and the bonding can be carried out while reducing the thickness of the adhesive 11. Note that, while pressing was performed in this example, pressing need not be performed where a method is used with which the thickness of the adhesive 11 is stabilized and further the piezoelectric element layer 7 and the vibrating plates 5 and 6 are tightly affixed.

Further, here, it is also possible if an underlying layer is further provided on the vibrating plate 6 of the upper layer so as to stabilize the coating of the adhesive 11. For example, it is effective to provide a layer of silicon oxide of several tens of nm so as to reduce the bubbles which may be contained in the adhesive at the time of the coating.

Figure 11:
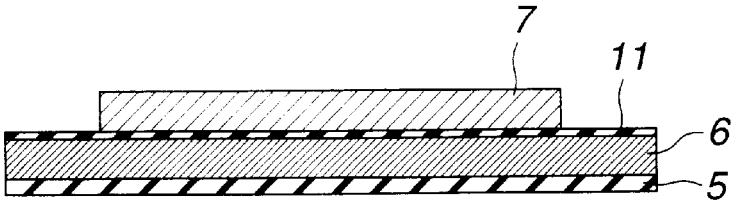
FIG. 11 shows a method of production of a print head constituted by a two-layer structure of vibrating plates and is a sectional view showing a state where the adhesive is thermally cured.

Next, as shown in FIG. 11, when an epoxy is used as the adhesive 11, thermal curing of the adhesive is carried out.

Figure 12:
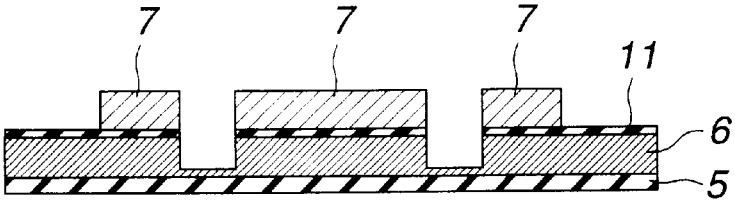
FIG. 12 shows a method of production of a print head constituted by a two-layer structure of vibrating plates and is a sectional view showing a state where the piezoelectric element layer is diced.

Subsequently, as shown in FIG. 12, the piezoelectric element layer 7 affixed on the vibrating plates 5 and 6 is cut by dicing by a rotating blade. Here, the cutting is carried out at a pitch such that the size of the resultant piezoelectric elements 7 becomes a size corresponding to the size of the pressure chambers communicating with the discharge nozzles. In the cutting step of this piezoelectric element layer 7, the cutting means can be a grindstone containing diamond particles in place of a diamond.

When performing the cutting, the piezoelectric element layer 7 is completely cut and the bottom of the cutting tool is prevented from reaching the vibrating plate 5 of the lower layer which served as the etching stop layer. That is, the cutting is stopped just before the vibrating plate 5 of the lower layer. The position just before the vibrating plate 5 of the lower layer means one leaving for example about 5 to 10 $\mu$m of the vibrating plate 6 of the upper layer.

Figure 13:
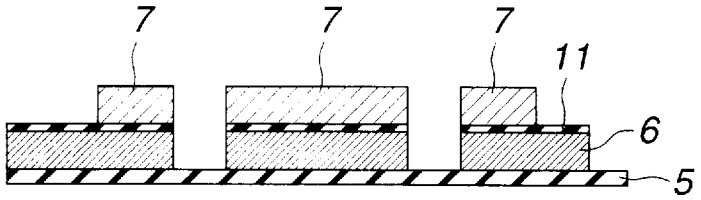
FIG. 13 shows a method of production of a print head constituted by a two-layer structure of vibrating plates and is a sectional view showing a state where the thickness of the vibrating plates is defined by etching.

Next, as shown in FIG. 13, the piezoelectric elements 7 bonded to the vibrating plates 5 and 6 are dipped in a solution which dissolves or etches only the vibrating plate 6 of the upper layer but does not dissolve or etch the vibrating plate 5 of the lower layer or the piezoelectric elements 7. This being done, the piezoelectric elements 7 are used as a mask and the portions of the vibrating plate 6 remaining at the cut portions are removed down to the vibrating plate 5 of the lower layer serving as the etching stop layer. As a result, the portions of the vibrating plate 6 of the upper layer remaining in the cut portions are removed, and the vibrating plate 5 of the lower layer is exposed at the bottom surface.

Here, where a material mainly composed of copper is used as the vibrating plate 6 of the upper layer and a material mainly composed of nickel or titanium is used as the vibrating plate 5 of the lower layer, the etching may be performed as shown in FIG. 13 by using as a mask the piezoelectric elements 7 remaining after the cutting by dipping in a 5 to 40 percent aqueous solution of ferric chloride for a few minutes or tens of seconds. By doing this, errors in the thickness of the vibrating plates due to the dicing can be eliminated and vibrating plates having a high precision of thickness can be obtained.

Figure 14:
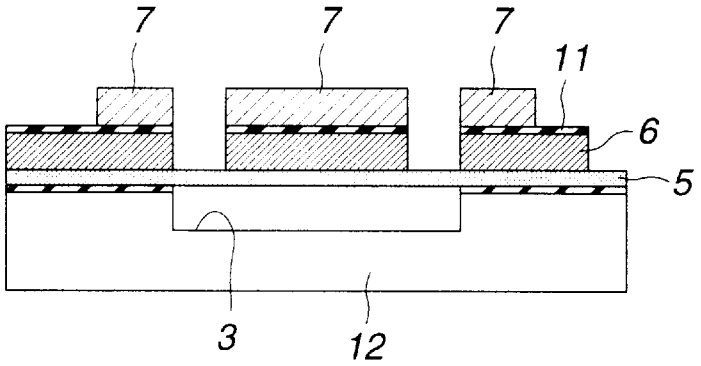
FIG. 14 shows a method of production of a print head constituted by a two-layer structure of vibrating plates and is a sectional view showing a state where an ink path forming member is bonded.

Next, as shown in FIG. 14, the bonded assembly of the piezoelectric elements 7 and the vibrating plates 5 and 6 obtained in the previous step is bonded to an ink path-forming member 12, that is, the base on which the pressure chambers 3 and the ink feed paths are formed. At the bonding, the pressure chambers 3 are aligned at positions facing the piezoelectric elements 7. Then, further, an orifice plate (not shown) having discharge nozzles 1 provided corresponding to the pressure chambers 3 and to be communicated with the pressure chambers 3 is attached to a position so that the discharge nozzles 1 are aligned with the pressure chambers 3. By this, a print head shown in FIG. 3 and FIG. 4 is completed.

In a print head produced after going through such a process, a bimorphic effect is generated by the upper and lower vibrating plates 5 and 6 and the piezoelectric elements 7. The only load for obtaining the displacement necessary for raising the pressure in the pressure chamber 3 is the vibrating plate 5 of the lower layer.

Further, when the vibrating plates 5 and 6 are deformed by this bimorphic effect, it is the sectional secondary moment of the vibrating plate 5 of the lower layer that acts as the load. This becomes a load proportional to the thickness of the vibrating plate to the third power. Here, in the above process, as shown in FIG. 13, this sectional secondary moment is defined by the dissolution or etching. Accordingly, it becomes possible to generate a uniform pressure with respect to the pressure chambers 3 provided corresponding to the large number of discharge nozzles 1.

Here, for example, in the above process, where the vibrating plate is constituted by ending at the cutting step and not removing portions of the vibrating plate by dissolution or etching by using the piezoelectric elements 7 as a mask, the thickness of the vibrating plate is determined by the wear of the cutting tool at the time of cutting and the precision of height of the cutting tool derived from the performance of the cutting machine. Even if the precision thereof is for example 1 $\mu$m or less, where the target value of the thickness of the vibrating plate is 10 $\mu$m , there is a variation of the thickness of the vibrating plate of about 10 percent and consequently, since the sectional secondary moment is in proportional to the thickness to the third power, there is a variation of about 30 percent. That is, where there is a variation of 30 percent in the load of the vibrating plate, when the printer apparatus is completed, there is a remarkable variation in the amount of discharge of the ink.

By adopting the above process, however, the vibrating plate 5, which becomes the load when the causing the vibrating plates to displace at the discharge of ink, can be produced while reducing the thickness thereof, and further, in a stable manner. Accordingly, in the print head produced by this process, it becomes possible to reduce the size of the pressure chambers 3, the density of arrangement of the pressure chambers 3 can be increased, and consequently the intervals between the discharge nozzles 1 communicated with the pressure chambers 3 can be reduced.

Further, by using materials having electrical conductivity for the vibrating plates 5 and 6, it becomes possible to use these vibrating plates 5 and 6 as common electrodes when applying a voltage to the piezoelectric elements 7. Namely, there are the effects of economization at the portions where the terminals of the common electrodes are provided and the reduction of the number of terminals. Furthermore, by using the electrically conductive adhesive 11, an electrical field can be directly given to the surface of the piezoelectric elements 7, therefore the voltage can be lowered by an amount corresponding to the thickness of the adhesive 11.

The above description related to the method of production of the print head shown in FIG. 3 through FIG. 5. Other than this, it is also possible to produce the print head as follows.

Figure 15:
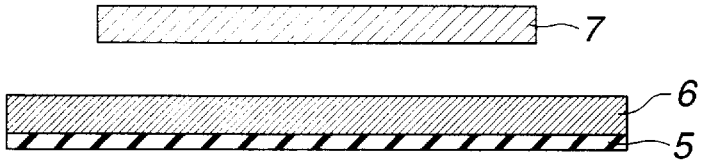
FIG. 15 shows another method of production of a print head constituted by a two-layer structure of vibrating plates and is a sectional view showing a state before the piezoelectric element layer is bonded to the vibrating plates.

First, as shown in FIG. 15, vibrating plates 5 and 6 for forming a two-layer structure and a piezoelectric element layer 7 are prepared. The materials of the vibrating plates 5 and 6 for forming the two layers are selected so that the vibrating plate 5 of the lower layer is not etched with respect to the solution for dissolving the vibrating plate 6 of the upper layer and becomes an etching stop layer. Further, the material of the vibrating plate 5 of the lower layer is selected to be one substantially free from pits. Further, desirably both of the vibrating plates 5 and 6 of the lower layer and the upper layer are electrically conductive.

More specifically, the vibrating plate 6 of the upper layer is made of a metal foil having a thickness of 20 $\mu$m or more mainly composed of copper, and the vibrating plate 5 of the lower layer has a thickness of 15 $\mu$m or less and is mainly composed of nickel or titanium. Further, as the method of superposition of these vibrating plates 5 and 6, it is sufficient so far as they are tightly bonded. There are for example a method of forming the vibrating plate 5 of the lower layer on the vibrating plate 6 of the upper layer by plating or a method of forming the vibrating plate 6 of the upper layer on the vibrating plate 5 of the lower layer by plating and further a method of bonding the vibrating plate 6 of the upper layer and the vibrating plate 5 of the lower layer, more specifically, a method of bonding them by applying a weight in a vacuum atmosphere.

Further, the piezoelectric element layer 7 is comprised of a sintered ceramic having electrodes which are respectively formed on its upper and lower surfaces. FIG. 15 shows this omitting the electrodes. The thickness of this piezoelectric element layer 7 is desirably 200 $\mu$m or less. Note that, in this example, the explanation was made of a single piezoelectric element layer 7, but there is no problem even if it is a superposed assembly of piezoelectric element layers. Further, for the vibrating plate 5 of the lower layer, desirably a material formed by rolling is used since there is a smaller possibility of existence of pits in the later stage of a material formed by press rolling than a material formed by plating. Further, more desirably all materials constituting the vibrating plates 5 and 6 are formed by rolled foil.

Figure 16:
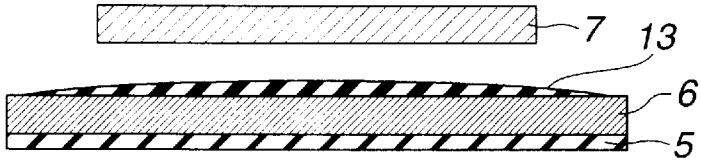
FIG. 16 shows another method of production of a print head constituted by a two-layer structure of vibrating plates and is a sectional view showing a state where a liquid metal adhesive is coated on the vibrating plates.

Next, as shown in FIG. 16, a liquid metal adhesive 13 containing gallium as component is coated on the vibrating plate 6 of the upper layer among the superposed vibrating plates 5 and 6. Alternatively, it is possible to coat the liquid metal adhesive 13 on the surface of the piezoelectric element layer 7 and further on both sides of the piezoelectric element layer 7 and the vibrating plate 6. This liquid metal adhesive 13 has as least three components of gallium, indium, and tin, becomes liquid at a temperature near room temperature or 100° C. or less, and further causes a diffusion reaction with respect to the vibrating plate 6 of the upper layer and forms an alloy. Alternatively, this liquid metal adhesive 13 has at least the three components of gallium, indium, and zinc, becomes liquid at a temperature near room temperature or 100° C. or less, and further causes a diffusion reaction with respect to the vibrating plate 6 of the upper layer and forms an alloy.

Figure 17:
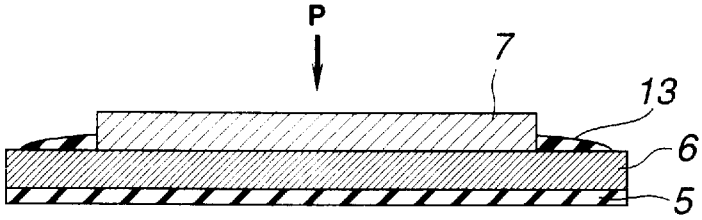
FIG. 17 shows another method of production of a print head constituted by a two-layer structure of vibrating plates and is a sectional view showing a state where the piezoelectric element layer is bonded to the vibrating plates.

Subsequently, as shown in FIG. 17, pressing or rolling is carried out so that the vibrating plates 5 and 6 and the piezoelectric element layer 7 can be bonded more tightly and the bonding can be carried out while reducing the thickness of the liquid metal adhesive 13.

Note that, in this example, the pressing or the rolling were carried out and the thickness of the liquid metal adhesive 13 was suppressed to 5 μm or less. Further, where a method tightly affixing the piezoelectric element layer 7 and the vibrating plates 5 and 6 is used, the pressing step or the rolling step is not necessary.

Further, here, it is also possible to further provide an underlying layer on the vibrating plate 6 of the upper layer so as to stabilize the coating of the liquid metal adhesive 13. For example, it is also effective to reduce the bubbles which may be contained in the adhesive at the time of coating by providing a layer of silicon oxide or the like of several tens of nm.

Figure 18:
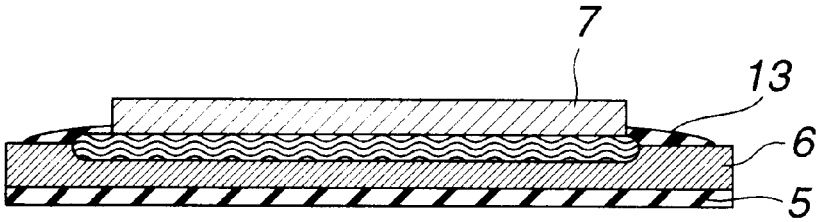
FIG. 18 shows another method of production of a print head constituted by a two-layer structure of vibrating plates and is a sectional view showing a state where a diffusion and alloy-formation reaction of the liquid metal adhesive is ended.

Next, as shown in FIG. 18, the assembly is held at room temperature or a temperature of 200° C. or less until the diffusion and alloy-forming reaction of the liquid metal adhesive 13 is ended. Note that, here, where a metal mainly composed of copper is used as the vibrating plate 6 of the upper layer, an alloy of copper and gallium having a melting point of 300° C. or more is gradually generated by the diffusion and alloy-forming reaction. Further, where a sufficient holding time is provided, the liquid metal is completely diffused into the solid metal, everything becomes an alloy having a high melting point, and the piezoelectric element layer and the vibrating plates are tightly bonded.

For example, where a liquid metal of gallium-indium-tin (Ga: 40 to 95%, In: 0 to 40%, Sn: 0 to 30%) and a liquid metal of gallium-indium-zinc (Ga: 40 to 95%, In: 0 to 40%, Zn: 0 to 10%) are used, an alloy layer 14 is generated in a region of about 15 μm or less from the surface of the vibrating plate 5.

Figure 19:
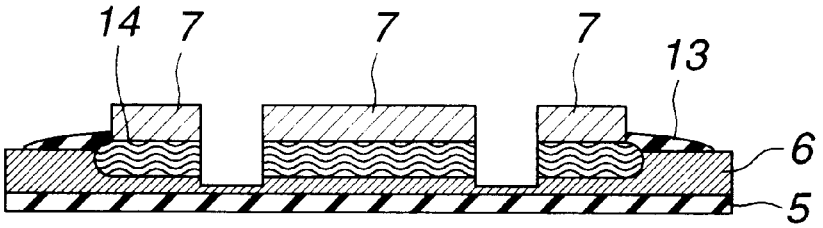
FIG. 19 shows another method of production of a print head constituted by a two-layer structure of vibrating plates and is a sectional view showing a state where the piezoelectric element layer is diced.

Subsequently, as shown in FIG. 19, the piezoelectric element layer 7 fixed on the vibrating plates 5 and 6 is cut by dicing by a rotating blade. Here, the cutting is carried out at a pitch so the size of the resulting piezoelectric elements 7 becomes a size corresponding to the size of the pressure chambers communicated with the discharge nozzles. In the cutting step of this piezoelectric element layer 7, the cutting means can be a grindstone containing diamond particles in place of a diamond.

When performing the cutting, the piezoelectric element layer 7 is completely cut and the bottom of the cutting tool is prevented from reaching the vibrating plate 5 of the lower layer which served as the etching stop layer. That is, the cutting is stopped just before the vibrating plate 5 of the lower layer. The position just before the vibrating plate 5 of the lower layer means one leaving for example about 5 to 10 μm of the vibrating plate 6 of the upper layer.

Figure 20:
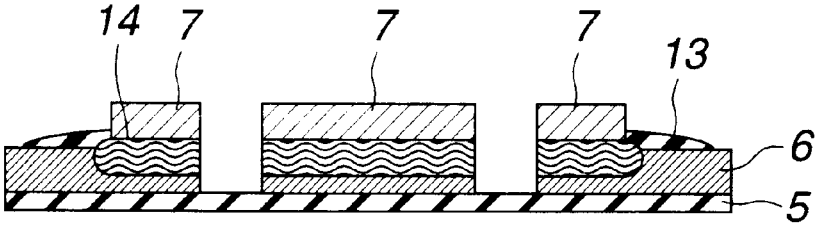
FIG. 20 shows another method of production of a print head constituted by a two-layer structure of vibrating plates and is a sectional view showing a state where the thickness of the vibrating plate is defined by etching.

Next, as shown in FIG. 20, the piezoelectric elements 7 bonded to the vibrating plates 5 and 6 are dipped in a solution which dissolves or etches only the vibrating plate 6 of the upper layer but does not dissolve or etch the vibrating plate 5 of the lower layer or the piezoelectric elements 7. This being done, the piezoelectric elements 7 are used as a mask and the portions of the vibrating plate 6 remaining at the cut portions are removed down to the vibrating plate 5 of the lower layer serving as the etching stop layer. As a result, the portions of the vibrating plate 6 of the upper layer remaining in the cut portions are removed, and the vibrating plate 5 of the lower layer is exposed at the bottom surface.

Here, where a material mainly composed of copper is used as the vibrating plate 6 of the upper layer and a material mainly composed of nickel or titanium is used as the vibrating plate 5 of the lower layer, the etching may be performed as shown in FIG. 20 by using as a mask the piezoelectric elements 7 remained after the cutting by dipping in a 5 to 40 percent aqueous solution of ferric chloride for a few minutes or tens of seconds. By doing this, errors in the thickness of the vibrating plates due to the dicing can be eliminated and vibrating plates having a high precision of thickness can be obtained.

Figure 21:
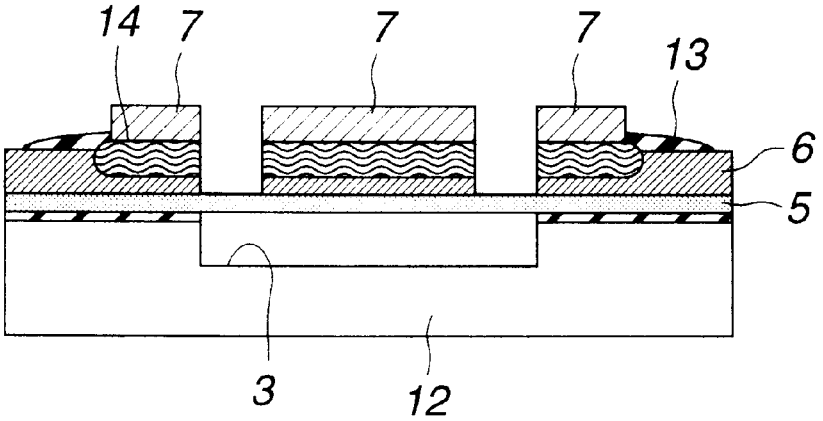
FIG. 21 shows another method of production of a print head constituted by a two-layer structure of vibrating plates and is a sectional view showing a state where the ink path-forming member is bonded.

Next, as shown in FIG. 21, the bonded assembly of the piezoelectric elements 7 and the vibrating plates 5 and 6 obtained in the previous step is bonded to an ink path-forming member 12, that is, the base on which the pressure chambers 3 and the ink feed paths are formed. At the bonding, the pressure chambers 3 are aligned at positions facing the piezoelectric elements 7. Then, further, an orifice plate (not shown) having discharge nozzles 1 provided corresponding to the pressure chambers 3 and to be communicated with the pressure chambers 3 is attached to a position so that the discharge nozzles 1 are aligned with the pressure chambers 3. By this, a print head shown in FIG. 3 and FIG. 4 is completed.

In the print head produced in this way, not only is the same effect as that of a print head produced by the previous method obtained, but also there is the following advantage: Namely, a strong alloy layer 14 exists due to the liquid metal adhesive 13, therefore in comparison with a case where the adhesive 11 of a resin system such as an epoxy is used, a higher bimorphic effect is obtained. Further, the alloy layer 14 absorbs almost none of the displacement in comparison with the adhesive 11 of a resin system, therefore it can effectively transfer the bimorphic effect which is obtained as a higher effect to the pressure chambers 3. Namely, in comparison with a case where an adhesive 11 of the resin system is used, it becomes possible to discharge the ink even if the voltage given to the piezoelectric elements 7 is lowered.

Further, it is possible to form a strong alloy layer 14 as the adhesive layer without requiring heat treatment by just continuing the state holding room temperature, therefore even if a material of the vibrating plates having a greatly different thermal expansion from that of the material forming the piezoelectric elements 7 is selected, warping or the like will not be generated in the vibrating plates 5 and 6 or the piezoelectric elements 7. That is, when the materials of the piezoelectric elements 7 or the vibrating plates 5 and 6 are properly selected, an effect of raising the degree of freedom thereof is obtained.

Embodiment 2

Figure 22:
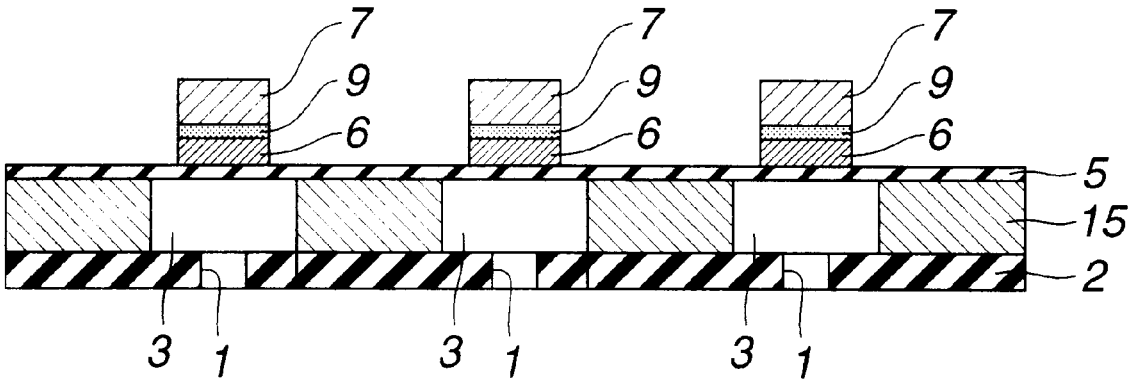
FIG. 22 is a lateral sectional view of a print head constituting a three-layer structure of vibrating plates.
Figure 23:
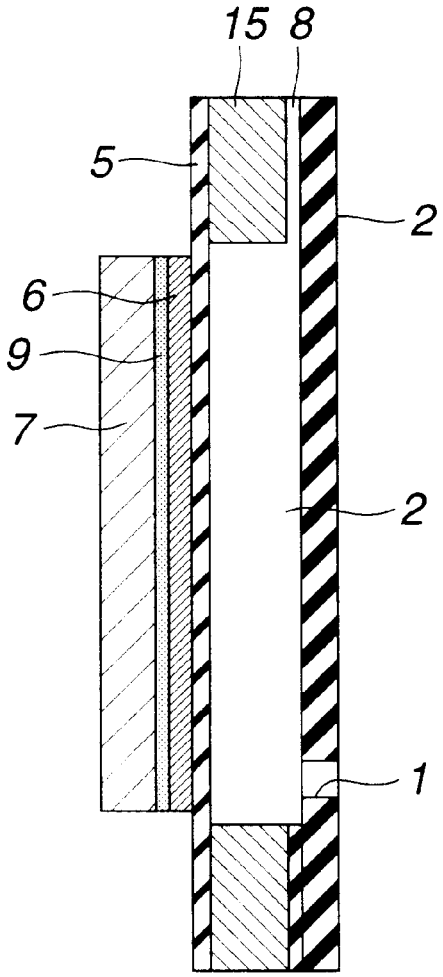
FIG. 23 is a vertical sectional view of a print head constituting a three-layer structure of vibrating plates.
Figure 24A:
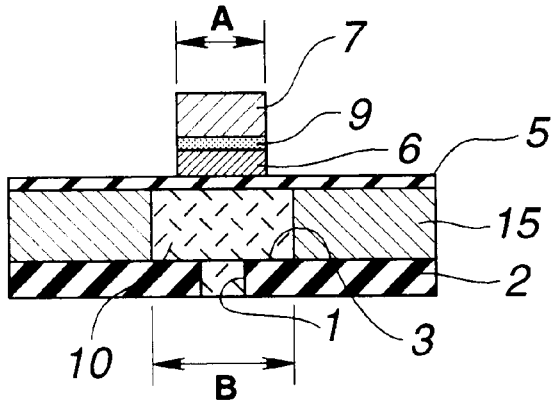
FIG. 24A and FIG. 24B are sectional views of the ink discharge standby state of a print head constituting a three-layer structure of vibrating plates.
Figure 24B:
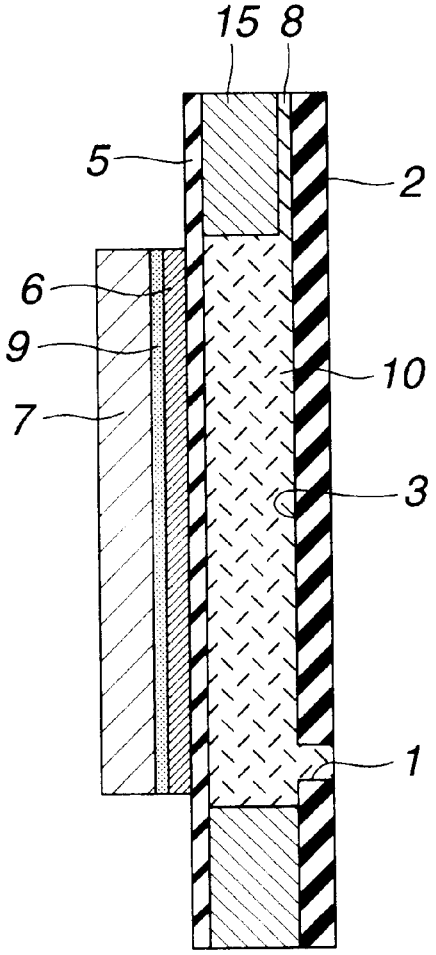
Figure 25A:
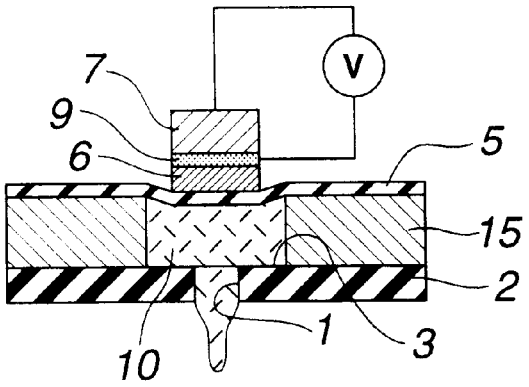
FIG. 25A and FIG. 25B are sectional views of the ink discharging state of a print head constituting a three-layer structure of vibrating plates.
Figure 25B:
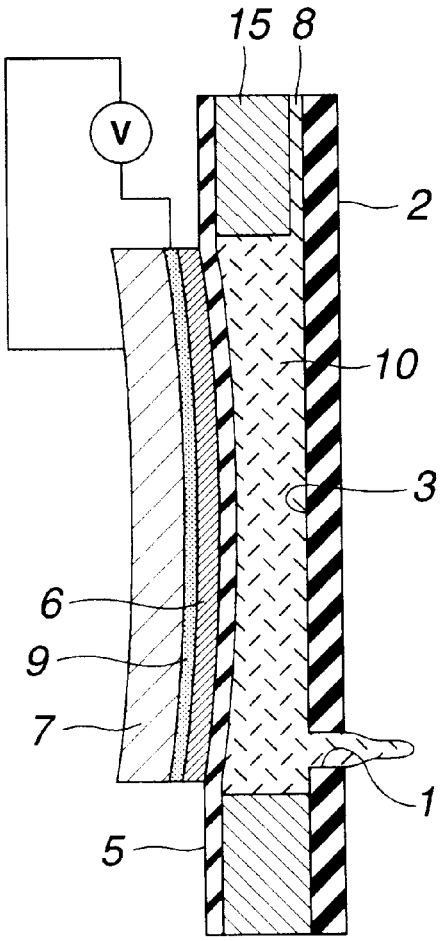

In this print head, as shown in FIG. 22 and FIG. 23, there is provided a three-layer structure of vibrating plates. Pressure chambers 3 are provided in the vibrating plate 15 of the lowermost layer at a side in contact with the orifice plate 2 among these vibrating plates. The rest of the configuration is the same as that of the print head shown in FIG. 3 through FIG. 5. Here, the same reference numerals are given to the same members as those of the print head shown in Embodiment 1. Other reference numerals are given to different members. Explanations of identical portions will be omitted.

In this print head, the portion for forming the pressure chambers 3 is determined to be the vibrating plate 15. This vibrating plate 15 does not function in the same way as a proper vibrating plate. What function to give the bimorphic effect are in the end the vibrating plates 5 and 6 and the piezoelectric elements 7—not the vibrating plate 15 of the lowermost layer. Accordingly, as shown in FIGS. 24A and 24B and FIGS. 25A and 25B, the discharging operation of ink in this print head is the same as that of Embodiment 1 and therefore an explanation thereof will be omitted.

In this way, the print head in this embodiment is the same as the print head of Embodiment 1 except the portion for forming the pressure chamber 3 comprises the vibrating plate 15, therefore the same effect as that by the print head shown in FIG. 3 through FIG. 5 is obtained.

Next, the method of production of this print head will be shown.

Figure 26:
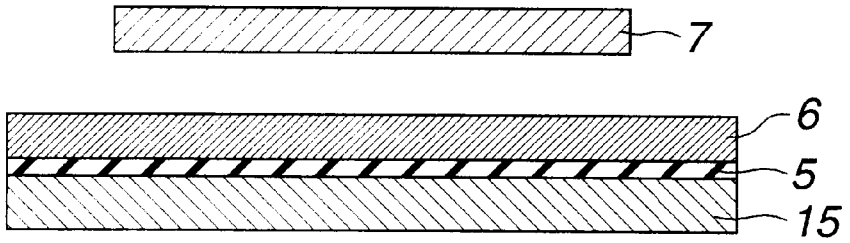
FIG. 26 shows a method of production of a print head constituting a three-layer structure of vibrating plates and is a sectional view showing a state before the piezoelectric element layer is bonded to the vibrating plates.

First, as shown in FIG. 26, vibrating plates 6, 5, and 15 for forming the three-layer structure and the piezoelectric element layer 7 are prepared. Note that, below, the three layers of the vibrating plates 6, 5, and 15 will be referred to as the vibrating plate 6 of the upper layer, the vibrating plate 5 of the lower layer, and the vibrating plate 15 of the lowermost layer in order from the top for convenience.

Here, the materials of the vibrating plates 6, 5, and 15 including the three layers are selected so that the vibrating plate 5 of the lower layer will not be etched by a solution dissolving the vibrating plate 6 of the upper layer and becomes an etching stop layer. Further, the material of the vibrating plate 5 of the lower layer is selected to be one substantially free from pits. Further, the materials are selected so that the vibrating plate 5 of the lower layer is not etched by the solution dissolving the vibrating plate 15 of the lowermost layer and becomes the etching stop layer. Further, desirably both of the vibrating plates 5 and 6 of the lower layer and the upper layer are electrically conductive.

More specifically, the vibrating plate 6 of the upper layer is made of a metal foil having a thickness of 20 $\mu$m or more mainly composed of copper, the vibrating plate 5 of the lower layer is made of a metal foil having a thickness of 15 $\mu$m or less mainly composed of nickel or titanium, and the vibrating plate 15 of the lowermost layer is made of a metal foil having a thickness of 50 $\mu$m or more mainly composed of copper. As the method of superposition of these three vibrating plates 6, 5, and 15, it is sufficient so far as they are tightly bonded. There exist a method of forming the vibrating plate 6 of the upper layer and the vibrating plate 15 of the lowermost layer on the vibrating plate 5 of the lower layer by plating or a method of forming the vibrating plate 5 of the lower layer on the vibrating plate 15 of the lowermost layer by plating and further forming the vibrating plate 6 of the upper layer by plating and further a method of bonding the vibrating plates 6, 5, and 15 of the upper layer, lower layer, and the lowermost layer, more specifically a method of bonding them by applying a weight in a vacuum atmosphere.

On the other hand, the piezoelectric element layer 7 is comprised of a sintered ceramic having electrodes formed on its upper and lower surfaces. This is shown in FIG. 26 while omitting the electrodes. The thickness of this piezoelectric element layer 7 is desirably controlled to 200 $\mu$m or less. Note that, in this example, an explanation is made of a single piezoelectric element layer 7, but there is no problem even if superposed piezoelectric element layers are adopted.

Further, for the vibrating plate 5 of the lower layer, desirably a material formed by rolling is used since there is a smaller possibility of existence of pits in a later stage in the material formed by press rolling than the material formed by plating. Further, more desirably all materials constituting the vibrating plates 5, 6 and 15 are formed by rolled foil.

Figure 27:
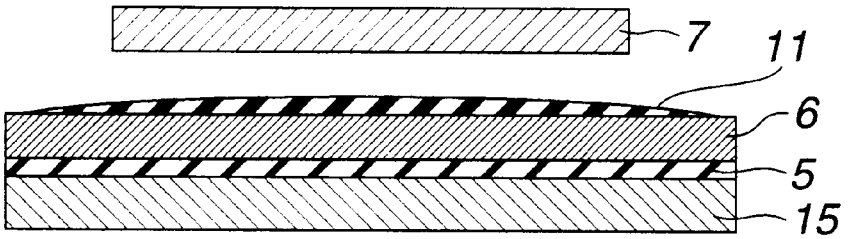
FIG. 27 shows a method of production of a print head constituting a three-layer structure of vibrating plates and is a sectional view showing a state where an adhesive is coated on the vibrating plates.

Next, as shown in FIG. 27, the adhesive 11 is coated on the vibrating plate 6 of the upper layer among the superposed vibrating plates 5, 6, and 15. Alternatively, it is also possible to coat an adhesive 11 on the surface of the piezoelectric element layer 7 and further both sides of the piezoelectric element layer 7 and the vibrating plate 6. It is sufficient so far as the adhesive 11 has a strength that is durable so that the vibrating layers will not peel off in the later cutting process of the piezoelectric element layer 7. Further, this adhesive 11 desirably has electrical conductivity. More specifically, it may be a material obtained by mixing electrically conductive particles such as a metal into an epoxy adhesive.

Figure 28:
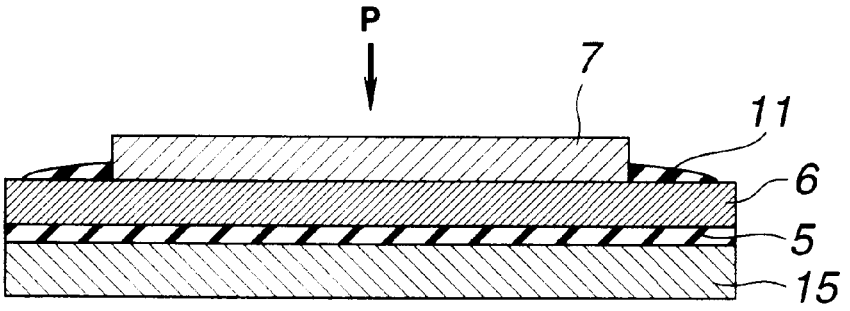
FIG. 28 shows a method of production of a print head constituting a three-layer structure of vibrating plates and is a sectional view showing a state where the piezoelectric element layer is bonded to the vibrating plates.

Subsequently, as shown in FIG. 28, a pressure P is added from the piezoelectric element layer 7 side and to perform pressing so that the vibrating plates 6, 5, and 15 and the piezoelectric element layer 7 can be bonded more strongly and the bonding can be carried out while reducing the thickness of the adhesive 11. Note that, while pressing was performed in this example, pressing need not be performed where a method is used with which the thickness of the adhesive 11 is stabilized and further the piezoelectric element layer 7 and the vibrating plates 6, 5, and 15 are tightly affixed.

Further, here, it is also possible if an underlying layer is further provided on the vibrating plate 6 of the upper layer so as to stabilize the coating of the adhesive 11. For example, it is effective to provide a layer of silicon oxide of several tens of nm so as to reduce the bubbles which may be contained in the adhesive at the time of the coating.

Figure 29:
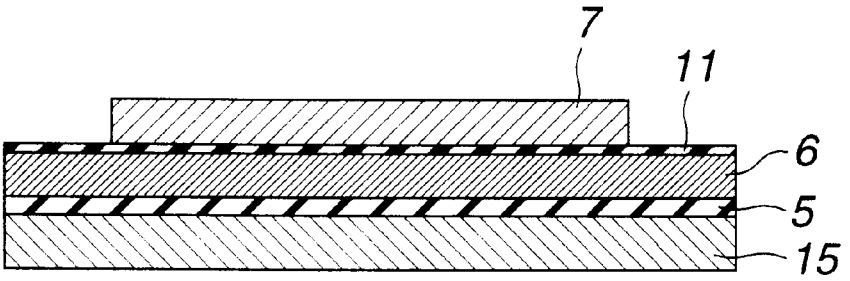
FIG. 29 shows a method of production of a print head constituting a three-layer structure of vibrating plates and is a sectional view showing a state where the adhesive is thermally cured.

Next, as shown in FIG. 29, when an epoxy is used as the adhesive 11, thermal curing of the adhesive is carried out.

Figure 30:
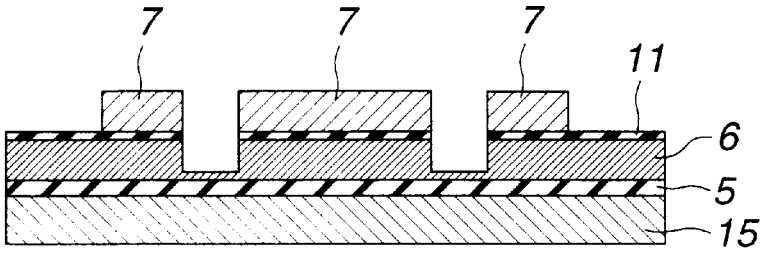
FIG. 30 shows a method of production of a print head constituting a three-layer structure of vibrating plates and is a sectional view showing a state where the piezoelectric element layer is diced.

Subsequently, as shown in FIG. 30, the piezoelectric element layer 7 affixed on the vibrating plates 6, 5, and 15 is cut by dicing by a rotating blade. Here, the cutting is carried out at a pitch such that the size of the resultant piezoelectric elements 7 becomes a size corresponding to the size of the pressure chambers communicating with the discharge nozzles. In the cutting step of this piezoelectric element layer 7, the cutting means can be a grindstone containing diamond particles in place of a diamond.

When performing the cutting, the piezoelectric element layer 7 is completely cut and the bottom of the cutting tool is prevented from reaching the vibrating plate 5 of the lower layer which served as the etching stop layer. That is, the cutting is stopped just before the vibrating plate 5 of the lower layer. The position just before the vibrating plate 5 of the lower layer means one leaving for example about 5 to 10 $\mu$m of the vibrating plate 6 of the upper layer.

Figure 31:
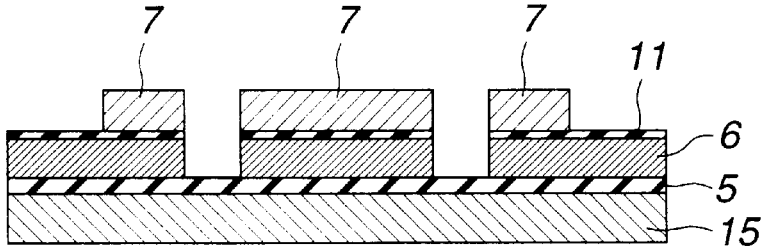
FIG. 31 shows a method of production of a print head constituting a three-layer structure of vibrating plates and is a sectional view showing a state where the thickness of the vibrating plates is defined by etching.

Next, as shown in FIG. 31, the piezoelectric elements 7 bonded to the vibrating plates 6, 5, and 15 are dipped in a solution which dissolves or etches only the vibrating plate 6 of the upper layer but does not dissolve or etch the vibrating plate 5 of the lower layer or the piezoelectric elements 7. This being done, the piezoelectric elements 7 are used as a mask and the portions of the vibrating plate 6 remaining at the cut portions are removed down to the vibrating plate 5 of the lower layer serving as the etching stop layer. As a result, the portions of the vibrating plate 6 of the upper layer remaining in the cut portions are removed, and the vibrating plate 5 of the lower layer is exposed at the bottom surface.

Here, where a material mainly composed of copper is used as the vibrating plate 6 of the upper layer and a material mainly composed of nickel or titanium is used as the vibrating plate 5 of the lower layer, the etching may be performed as shown in FIG. 31 by using as a mask the piezoelectric elements 7 remaining after the cutting by dipping in a 5 to 40 percent aqueous solution of ferric chloride for a few minutes or tens of seconds. By doing this, errors in the thickness of the vibrating plates due to the dicing can be eliminated and vibrating plates having a high precision of thickness can be obtained.

Figure 32:
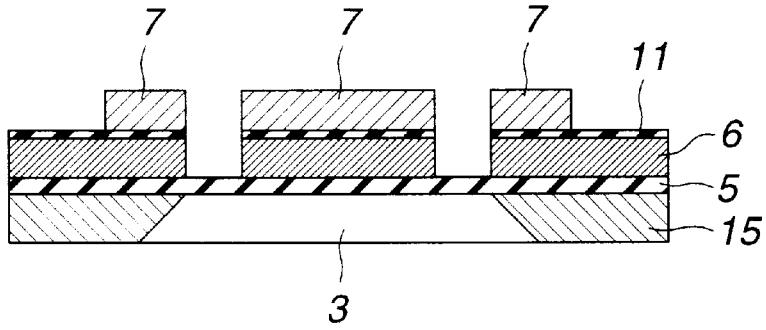
FIG. 32 shows a method of production of a print head constituting a three-layer structure of vibrating plates and is a sectional view showing a state where a pressure chamber is formed in the lowermost layer of the vibrating plates.

Next, as shown in FIG. 32, a photosensitive material such as a dry film or a liquid resist is provided on the vibrating plate 15 of the lowermost layer and the shape of the pressure chambers 3 and the ink paths is patterned so that the pressure chambers 3 of the ink correspond to the positions of the piezoelectric elements 7. Then, the pressure chambers 3 are formed by etching by using the photosensitive material subjected to the patterning as the mask material, and then the mask material is removed.

Here, as the mask material, for example a photosensitive dry film used at time of preparation of a printed circuit board can be used. Further, ferric chloride or the like can be used for the etching solution. It is also possible to use the screen printing method as the method of formation of the mask material. Further, where there is a possibility that the etching solution to be used in the etching step of the vibrating plate 15 of the lowermost layer etches the vibrating plate 6 of the upper layer or the piezoelectric elements 7, it is necessary to protect the vibrating plate 6 of the upper layer or the piezoelectric elements 7.

Further, as shown in this example, where the materials of the vibrating plate 6 of the upper layer and the vibrating plate 15 of the lowermost layer are the same, it is possible to make the steps shown in FIGS. 31 and 32 the same. Namely, it is also possible to form a mask material by a resist on the vibrating plate 15 of the lowermost layer after the dicing step shown in FIG. 30 and dip this in the etching solution.

Further, in this example, an example of using copper, a metal material, for the vibrating plate 15 of the lowermost layer was shown, but the material for forming the vibrating plate 15 does not have to be a metal material. It is possible that it be an organic material for example a polyimide.

Figure 33:
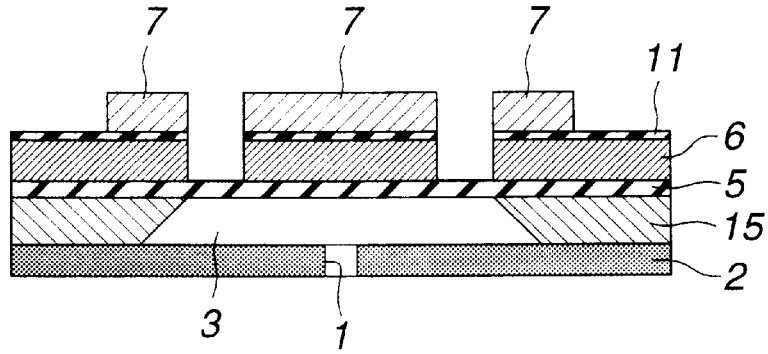
FIG. 33 shows a method of production of a print head constituting a three-layer structure of vibrating plates and is a sectional view showing a state where an orifice plate is bonded.

Next, as shown in FIG. 33, the bonded assembly of the piezoelectric elements 7 and the vibrating plates 6, 5, and 15 is bonded to the orifice plate 2 having the discharge nozzles 1. At the time of the bonding, the parts are arranged and affixed so that the discharge nozzles 1 are aligned at positions facing to the piezoelectric elements 7. Due to this, the print head shown in FIG. 22 and FIG. 23 is completed.

The same effect as that by the print head of Embodiment 1 is obtained in the print head produced after going through this process as well. Here, the effect thereof is omitted and a description will be made only of the effect peculiar to this print head so as to avoid an overlapped description.

Namely, in this print head, the pressure chambers 3 of the ink can also be formed by the etching or dissolution, therefore the precision of positioning between the pressure chambers 3 and the piezoelectric elements 7 can be greatly improved. Further, in this print head, where the vibrating plates are deformed, they can be formed stably not only up to the value of the sectional secondary moment of the vibrating plate acting as the load, but also up to the length at which the deformation of the vibrating plates occurs.

The above description related to the method of production of the print head shown in FIG. 22 and FIG. 23. Other than this, as the adhesive for bonding the vibrating plate 6 and the piezoelectric element 7, as indicated in Embodiment 1, a liquid metal adhesive can be used. As the bonding method of the vibrating plate 6 and the piezoelectric element layer 7 at this time, the methods shown in Embodiment 1 can be used too, and therefore the explanation will be omitted.

In the print head produced in this way, not only can the same effect as that by the print head produced by the previous method be obtained, but also the effect in the case of using a liquid metal adhesive 13 can be obtained similar to Embodiment 1.

Embodiment 3

Figure 34:
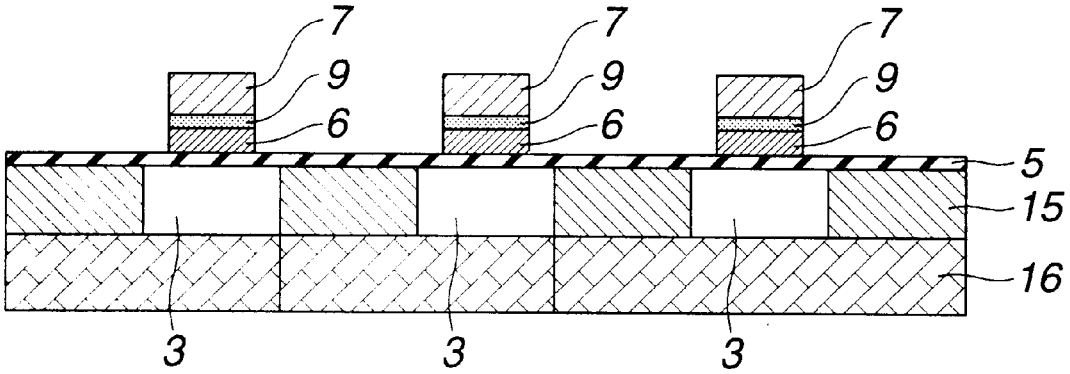
FIG. 34 is a lateral sectional view of a print head provided with a three-layer structure of vibrating plates and a discharge nozzle formed on the lowermost layer of the vibrating plates.
Figure 35:
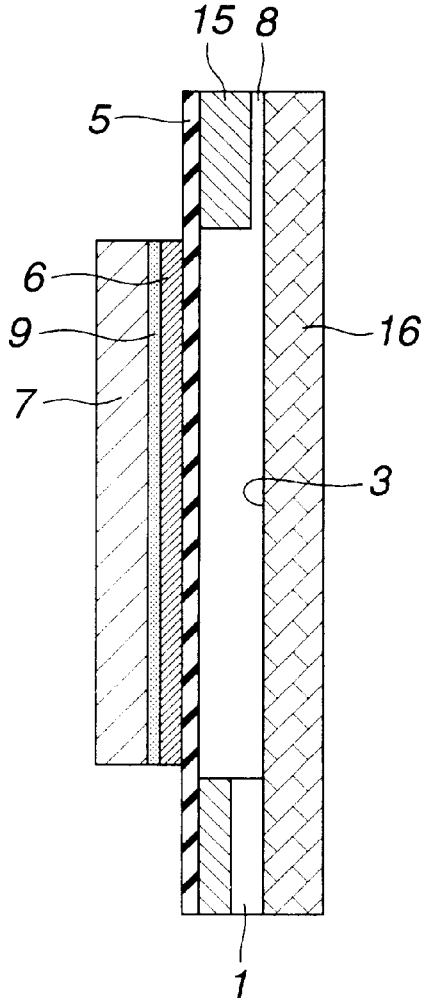
FIG. 35 is a vertical sectional view of a print head provided with a three-layer structure of vibrating plates and a discharge nozzle formed on the lowermost layer of the vibrating plates.

In this print head, as shown in FIG. 34 and FIG. 35, a three-layer structure of vibrating plates is provided. On the vibrating plate 15 of the lowermost layer among these vibrating plates, not only the pressure chambers 3, but also the ink feed paths 8 and the discharge nozzles 1 are formed. This print head is given a structure in which a base 16 having rigidity is attached to the vibrating plate 15 of the lowermost layer in place of the orifice plate. Here, the basic configuration is the same as that of the print head of FIG. 22 and FIG. 23, therefore the same reference numerals are given to the same members as those of this print head and different reference numerals are given to different members. Explanations of same portions will be omitted.

Figure 36:
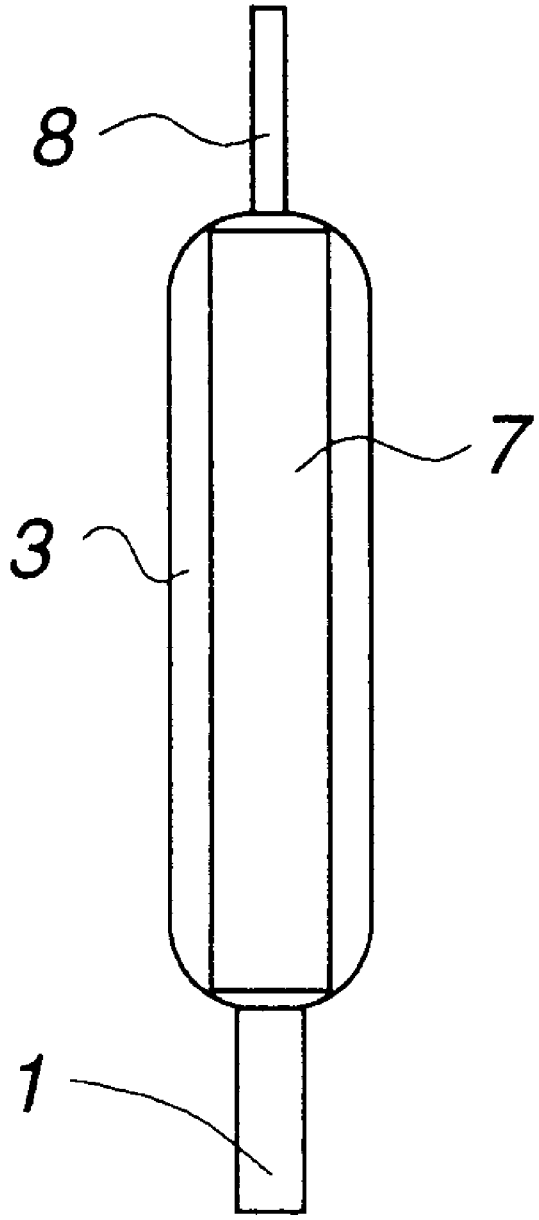
FIG. 36 is a perspective view of a print head provided with a three-layer structure of vibrating plates and a discharge nozzle formed on the lowermost layer of the vibrating plates.

In this print head, no orifice plate is provided. The discharge nozzles 1 communicated with the pressure chambers 3 are formed on the vibrating plate 15 of the lowermost layer. Namely, as shown in FIG. 35 and FIG. 36, the discharge nozzles 1 are formed communicated with these pressure chambers 3 and ink feed paths 8 in the vibrating plate 15 of the lowermost layer on which the pressure chambers 3 and the ink feed paths 8 are formed. The discharge nozzles 1 are formed in a direction orthogonal to the direction of displacement of the piezoelectric elements 7.

Figure 37A:
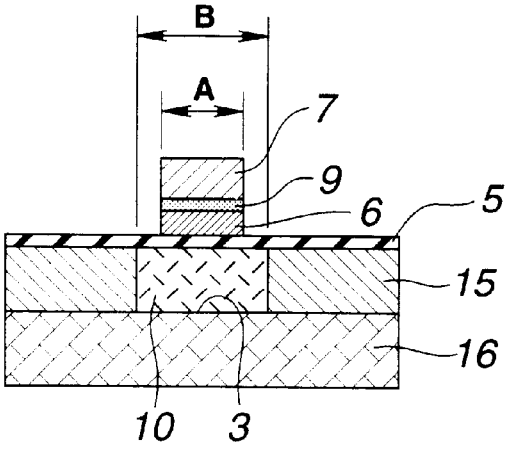
FIG. 37A and FIG. 37B are a sectional view of the ink discharge standby state of a print head provided with a three-layer structure of vibrating plates and a discharge nozzle formed on the lowermost layer of the vibrating plates.
Figure 37B:
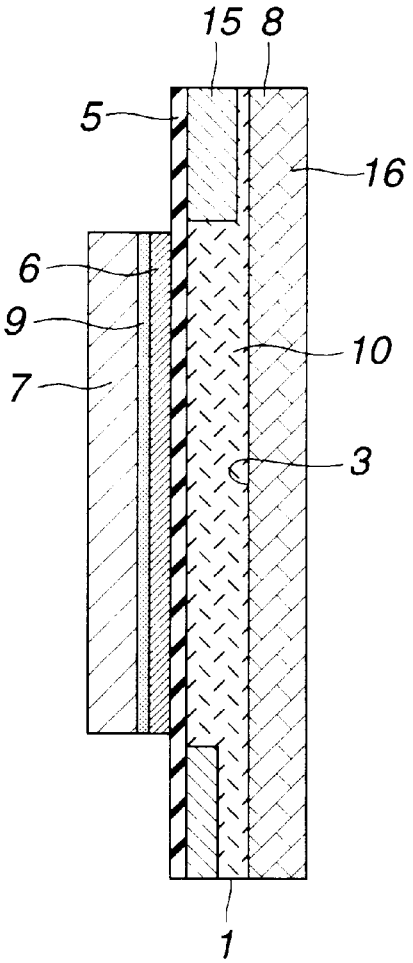
Figure 38A:
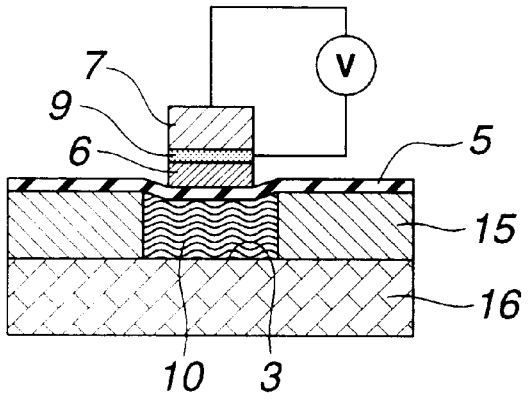
FIG. 38A and FIG. 38B are a sectional view showing the ink discharging state of a print head provided with a three-layer structure of vibrating plates and a discharge nozzle formed on the lowermost layer of the vibrating plates.
Figure 38B:
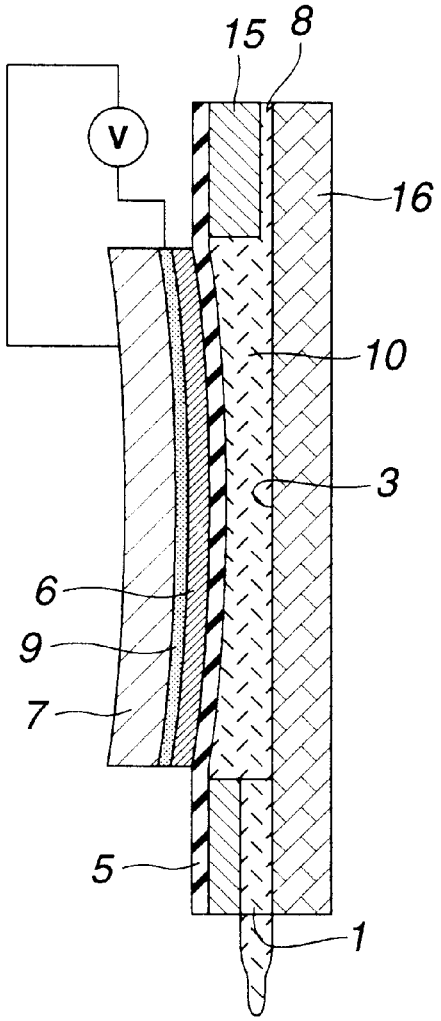

The discharging operation of ink in this print head is basically the same as that of the print head of Embodiment 2, therefore the explanation thereof will be omitted. Note, in this print head, when the state changes from the discharge standby state of FIGS. 37A and 37B to the discharging state of FIGS. 38A and 38B, the ink 10 is discharged to a direction orthogonal to the direction of displacement of the piezoelectric elements 7.

In this way, the print head in this embodiment is basically the same as the print head of Embodiment 2, therefore the same effect as that by the print head shown in FIG. 22 and FIG. 23 is obtained.

Next, the method of production of this print head will be shown.

Figure 39:
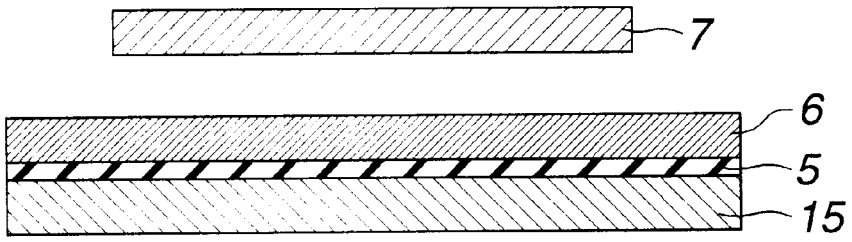
FIG. 39 shows a method of production of a print head provided with a three-layer structure of vibrating plates and a discharge nozzle formed on the lowermost layer of the vibrating plates and is a sectional view of a state before the piezoelectric element layer is bonded to the vibrating plates.

First, as shown in FIG. 39, the vibrating plates 6, 5, and 15 for forming the three-layer structure and the piezoelectric element layer 7 are prepared. Here, the materials of the vibrating plates 6, 5, and 15 including the three layers are selected so that the vibrating plate 5 of the lower layer will not be etched by a solution dissolving the vibrating plate 6 of the upper layer and becomes an etching stop layer. Further, the material of the vibrating plate 5 of the lower layer is selected to be one substantially free from pits. Further, the materials are selected so that the vibrating plate 5 of the lower layer is not etched by the solution dissolving the vibrating plate 15 of the lowermost layer and becomes the etching stop layer. Further, desirably both of the vibrating plates 5 and 6 of the lower layer and the upper layer are electrically conductive.

More specifically, the vibrating plate 6 of the upper layer is made of a metal foil having a thickness of 20 $\mu$m or more mainly composed of copper, the vibrating plate 5 of the lower layer is made of a metal foil having a thickness of 15 $\mu$m or less mainly composed of nickel or titanium, and the vibrating plate 15 of the lowermost layer is made of a metal foil having a thickness of 20 $\mu$m or more mainly composed of copper. As the method of superposition of these three vibrating plates 6, 5, and 15, it is sufficient so far as they are tightly bonded. There exist a method of forming the vibrating plate 6 of the upper layer and the vibrating plate 15 of the lowermost layer on the vibrating plate 5 of the lower layer by plating or a method of forming the vibrating plate 5 of the lower layer on the vibrating plate 15 of the lowermost layer by plating and further forming the vibrating plate 6 of the upper layer by plating and further a method of bonding the vibrating plates 6, 5, and 15 of the upper layer, lower layer, and the lowermost layer, more specifically a method of bonding them by applying a weight in a vacuum atmosphere.

On the other hand, the piezoelectric element layer 7 is comprised of a sintered ceramic having electrodes formed on its upper and lower surfaces. This is shown in FIG. 39 while omitting the electrodes. The thickness of this piezoelectric element layer 7 is desirably controlled to 200 μm or less. Note that, in this example, an explanation is made of a single piezoelectric element layer 7, but there is no problem even if superposed piezoelectric element layers are adopted.

Further, for the vibrating plate 5 of the lower layer, desirably a material formed by rolling is used since there is a smaller possibility of existence of pits in a later stage in the material formed by press rolling than the material formed by plating. Further, more desirably all materials constituting the vibrating plates 5, 6 and 15 are formed by rolled foil.

Figure 40:
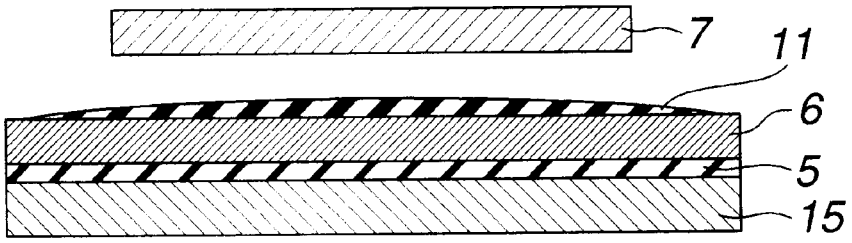
FIG. 40 shows a method of production of a print head provided with a three-layer structure of vibrating plates and a discharge nozzle formed on the lowermost layer of the vibrating plates and is a sectional view of a state where the adhesive is coated on the vibrating plates.

Next, as shown in FIG. 40, the adhesive 11 is coated on the vibrating plate 6 of the upper layer among the superposed vibrating plates 5, 6, and 15. Alternatively, it is also possible to coat an adhesive 11 on the surface of the piezoelectric element layer 7 and further both sides of the piezoelectric element layer 7 and the vibrating plate 6. It is sufficient so far as the adhesive 11 has a strength that is durable so that the vibrating layers will not peel off in the later cutting process of the piezoelectric element layer 7. Further, this adhesive 11 desirably has electrical conductivity. More specifically, it may be a material obtained by mixing electrically conductive particles such as a metal into an epoxy adhesive.

Figure 41:
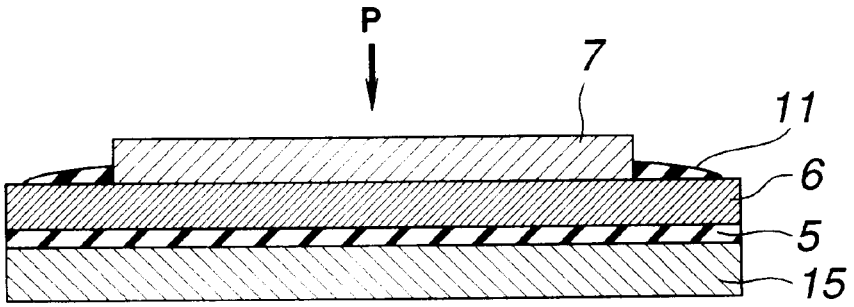
FIG. 41 shows a method of production of a print head provided with a three-layer structure of vibrating plates and a discharge nozzle formed on the lowermost layer of the vibrating plates and is a sectional view of a state where the piezoelectric element layer is bonded to the vibrating plates.

Subsequently, as shown in FIG. 41, a pressure P is added from the piezoelectric element layer 7 side and to perform pressing so that the vibrating plates 6, 5, and 15 and the piezoelectric element layer 7 can be bonded more strongly and the bonding can be carried out while reducing the thickness of the adhesive 11. Note that, while pressing was performed in this example, pressing need not be performed where a method is used with which the thickness of the adhesive 11 is stabilized and further the piezoelectric element layer 7 and the vibrating plates 6, 5, and 15 are tightly affixed.

Further, here, it is also possible if an underlying layer is further provided on the vibrating plate 6 of the upper layer so as to stabilize the coating of the adhesive 11. For example, it is effective to provide a layer of silicon oxide of several tens of nm so as to reduce the bubbles which may be contained in the adhesive at the time of the coating.

Figure 42:
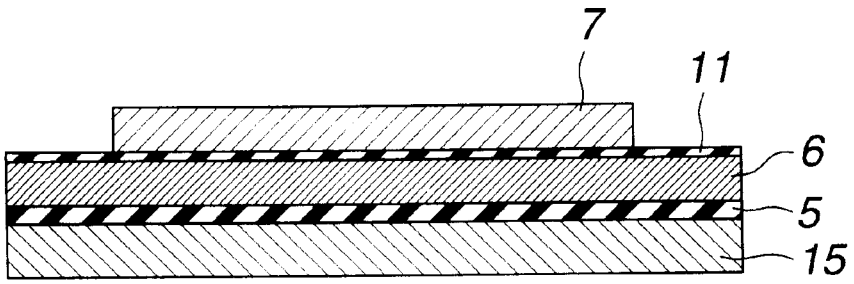
FIG. 42 shows a method of production of a print head provided with a three-layer structure of vibrating plates and a discharge nozzle formed on the lowermost layer of the vibrating plates and is a sectional view of a state where the adhesive is thermally cured.

Next, as shown in FIG. 42, when an epoxy is used as the adhesive 11, thermal curing of the adhesive is carried out.

Figure 43:
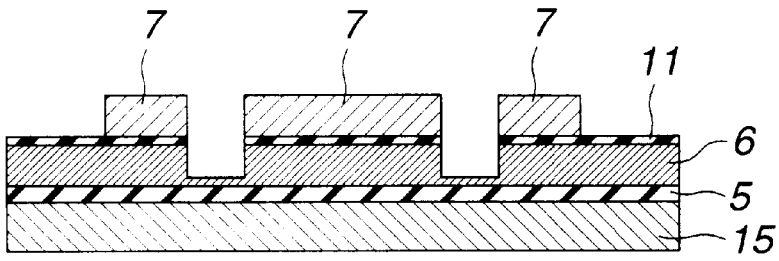
FIG. 43 shows a method of production of a print head provided with a three-layer structure of vibrating plates and a discharge nozzle formed on the lowermost layer of the vibrating plates and is a sectional view of a state where the piezoelectric element layer is diced.

Subsequently, as shown in FIG. 43, the piezoelectric element layer 7 affixed on the vibrating plates 6, 5, and 15 is cut by dicing by a rotating blade. Here, the cutting is carried out at a pitch such that the size of the resultant piezoelectric elements 7 becomes a size corresponding to the size of the pressure chambers communicating with the discharge nozzles. In the cutting step of this piezoelectric element layer 7, the cutting means can be a grindstone containing diamond particles in place of a diamond.

When performing the cutting, the piezoelectric element layer 7 is completely cut and the bottom of the cutting tool is prevented from reaching the vibrating plate 5 of the lower layer which served as the etching stop layer. That is, the cutting is stopped just before the vibrating plate 5 of the lower layer. The position just before the vibrating plate 5 of the lower layer means one leaving for example about 5 to 10 μm of the vibrating plate 6 of the upper layer.

Figure 44:
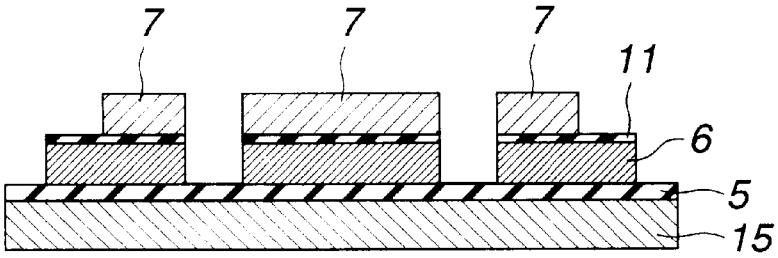
FIG. 44 shows a method of production of a print head provided with a three-layer structure of vibrating plates and a discharge nozzle formed on the lowermost layer of the vibrating plates and is a sectional view of a state where the thickness of the vibrating plate is defined by etching.

Next, as shown in FIG. 44, the piezoelectric elements 7 bonded to the vibrating plates 6, 5, and 15 are dipped in a solution which dissolves or etches only the vibrating plate 6 of the upper layer but does not dissolve or etch the vibrating plate 5 of the lower layer or the piezoelectric elements 7. This being done, the piezoelectric elements 7 are used as a mask and the portions of the vibrating plate 6 remaining at the cut portions are removed down to the vibrating plate 5 of the lower layer serving as the etching stop layer. As a result, the portions of the vibrating plate 6 of the upper layer remaining in the cut portions are removed, and the vibrating plate 5 of the lower layer is exposed at the bottom surface.

Here, where a material mainly composed of copper is used as the vibrating plate 6 of the upper layer and a material mainly composed of nickel or titanium is used as the vibrating plate 5 of the lower layer, the etching may be performed as shown in FIG. 44 by using as a mask the piezoelectric elements 7 remaining after the cutting by dipping in a 5 to 40 percent aqueous solution of ferric chloride for a few minutes or tens of seconds. By doing this, errors in the thickness of the vibrating plates due to the dicing can be eliminated and vibrating plates having a high precision of thickness can be obtained.

Figure 45:
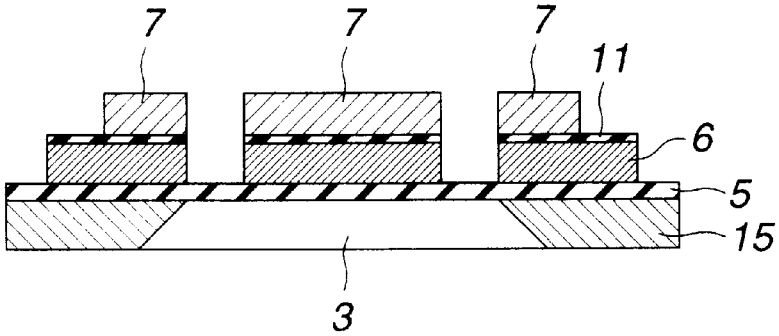
FIG. 45 shows a method of production of a print head provided with a three-layer structure of vibrating plates and a discharge nozzle formed on the lowermost layer of the vibrating plates and is a sectional view of a state where the pressure chamber is formed on the lowermost layer of the vibrating plates.

Next, as shown in FIG. 45, a photosensitive material such as a dry film or a liquid resist is provided on the vibrating plate 15 of the lowermost layer and the shape of the pressure chambers 3 and the ink paths is patterned so that the pressure chambers 3 of the ink correspond to the positions of the piezoelectric elements 7. Then, the pressure chambers 3 are formed by etching by using the photosensitive material subjected to the patterning as the mask material, and then the mask material is removed.

Here, as the mask material, for example a photosensitive dry film used at time of preparation of a printed circuit board can be used. Further, ferric chloride or the like can be used for the etching solution. It is also possible to use the screen printing method as the method of formation of the mask material. Further, where there is a possibility that the etching solution to be used in the etching step of the vibrating plate 15 of the lowermost layer etches the vibrating plate 6 of the upper layer or the piezoelectric elements 7, it is necessary to protect the vibrating plate 6 of the upper layer or the piezoelectric elements 7.

Further, as shown in this example, where the materials of the vibrating plate 6 of the upper layer and the vibrating plate 15 of the lowermost layer are the same, it is possible to make the steps shown in FIGS. 44 and 45 the same. Namely, it is also possible to form a mask material by a resist on the vibrating plate 15 of the lowermost layer after the dicing step shown in FIG. 43 and dip this in the etching solution.

Further, in this example, an example of using copper, a metal material, for the vibrating plate 15 of the lowermost layer was shown, but the material for forming the vibrating plate 15 does not have to be a metal material. It is possible that it be an organic material for example a polyimide.

Figure 46:
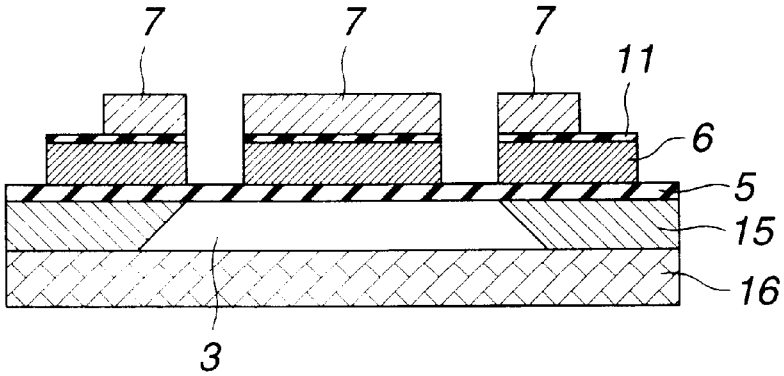
FIG. 46 shows another method of production of a print head provided with a three-layer structure of vibrating plates and a discharge nozzle formed on the lowermost layer of the vibrating plates and is a sectional view of a state where a base having rigidity is bonded.

Next, as shown in FIG. 46, the bonded assembly of the piezoelectric elements 7 and the vibrating plates 6, 5, and 15 is bonded to the rigid base plate 16. At the time of the bonding, the parts are arranged and affixed so that the end face of the discharge nozzles 1 are aligned at positions facing to the end face of the base plate 16. Due to this, the print head shown in FIG. 34 and FIG. 35 is completed.

The same effect as that by the print head of Embodiment 1 is obtained in the print head produced after going through this process as well. Here, the effect thereof is omitted and a description will be made only of the effect peculiar to this print head so as to avoid an overlapped description.

Namely, in this print head, the pressure chambers 3, the ink feed paths 8, and the discharge nozzles 1 are formed in the same step by the etching or the dissolution, therefore not only is the positioning precision between the pressure chambers 3 and the piezoelectric elements 7 greatly improved, but also the positional relationship between the pressure chambers 3 and the discharge nozzles 1 is obtained with a high precision. Then, in this print head, where the vibrating plate is deformed, formation can be stably made not only up to the value of the sectional secondary moment of the vibrating plate acting as the load, but also up to the length at which the deformation of the vibrating plate is made.

The above description is for the method of production of the print head shown in FIG. 34 and FIG. 35. Other than this, as the adhesive for bonding the vibrating plate 6 and the piezoelectric elements 7, as indicated in Embodiment 1, the liquid metal adhesive can be used. As the adhesive method of the vibrating plate 6 and the piezoelectric elements at this time, a method shown in Embodiment 1 can be used too, therefore the explanation will be omitted.

In the print head produced in this way, not can only the same effect as that by the print head produced by the method shown in Embodiment 1 be obtained, but also the effect of the case of using the liquid metal adhesive 13 can be obtained similar to that mentioned before.

Embodiment 4

Figure 47:
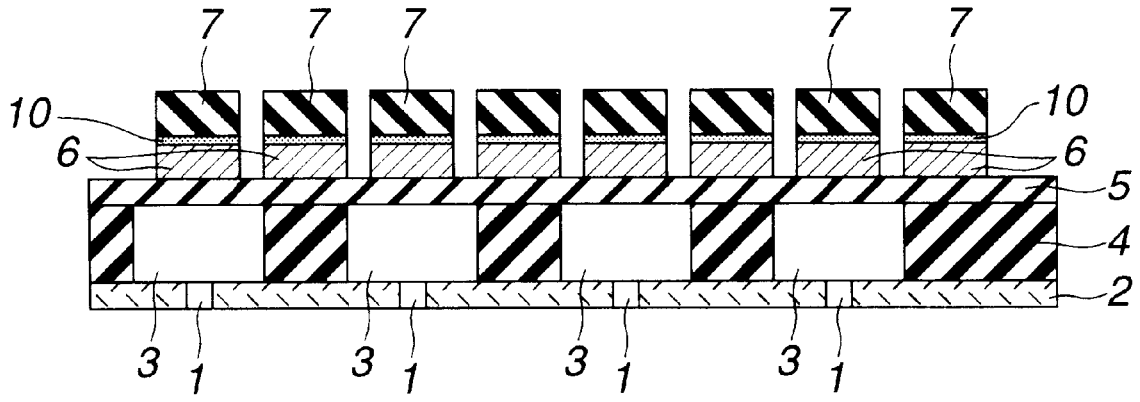
FIG. 47 is a lateral sectional view of a print head to which the present invention is applied.
Figure 48:
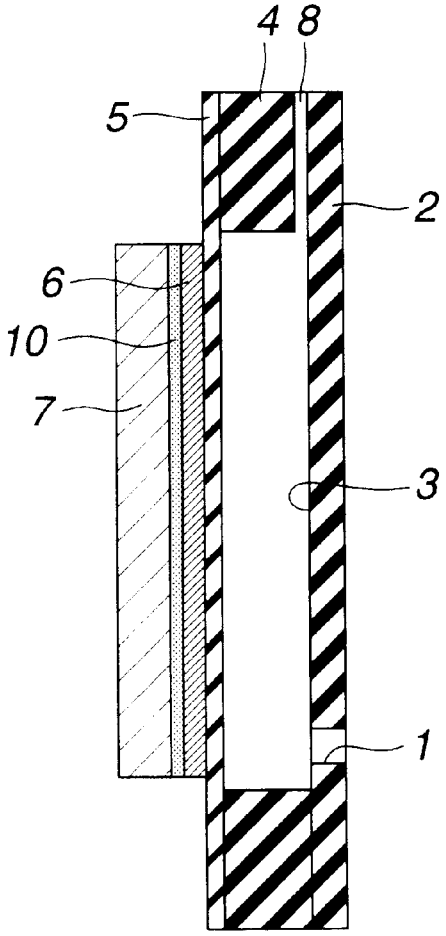
FIG. 48 is a vertical sectional view of a print head to which the present invention is applied.

This print head comprises, as shown in FIG. 47 and FIG. 48, an orifice plate 2 having a plurality of discharge nozzles 1, a base 4 having pressure chambers 3 communicated with these discharge nozzles 1 and provided corresponding to the discharge nozzles 1, vibrating plates 5 and 6 attached to this base 4, and a plurality of piezoelectric elements 7 arranged on these vibrating plates 5 and 6.

Figure 49:
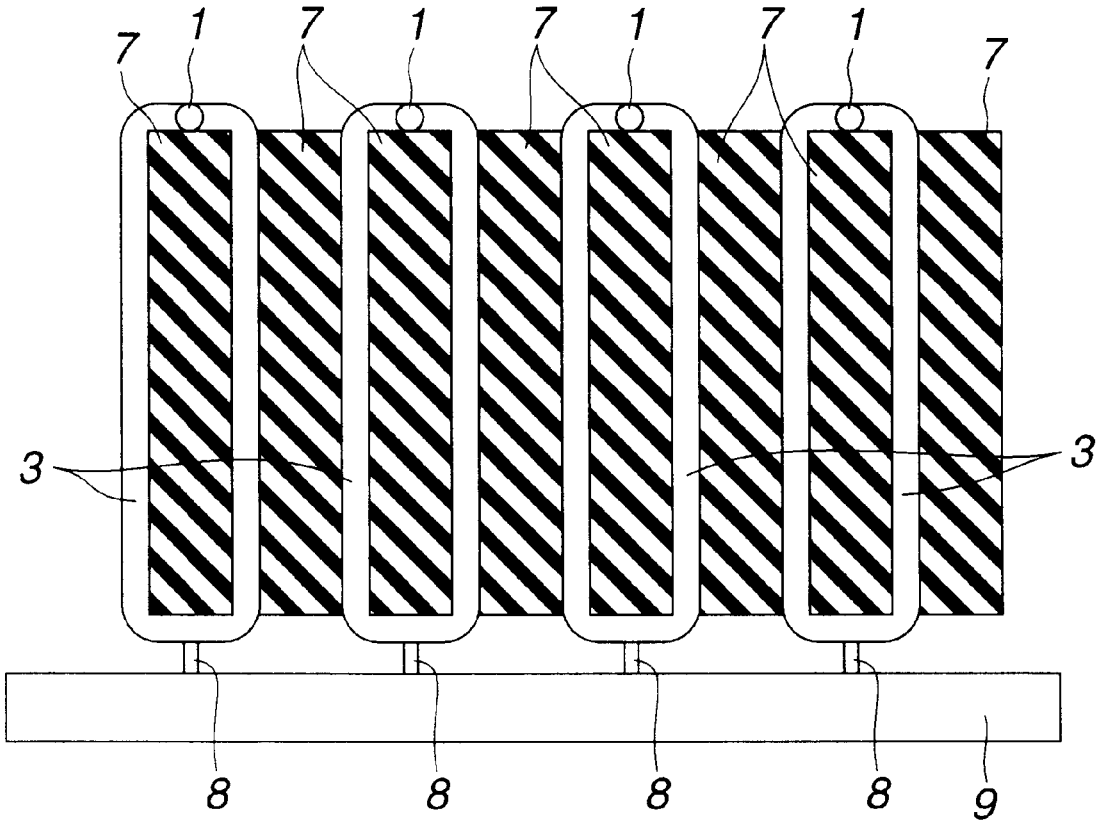
FIG. 49 is a plan view of a print head to which the present invention is applied.

As shown in FIG. 47 and FIG. 48, the orifice plate 2 is formed as a substrate having a plurality of discharge nozzles 1 for discharging the ink, that is, the discharge medium, and is attached to the surface of the base 4 opposite to the surface on which the vibrating plate 5 is provided. The discharge nozzles 1 provided on this orifice plate 2 are provided so as to face the respective pressure chambers 3 formed in the base 4 and, at the same time, are communicated with the respective pressure chambers 3. The shape of the outlets of the discharge nozzles 1 may be either a round shape or square shape since the ink is designed to try to become spherical due to its surface tension. In this example, as shown in FIG. 49, the shape of the outlets of the discharge nozzles 1 is made circular.

As shown in FIG. 47 and FIG. 48, flow paths for guiding the ink to the discharge nozzles 1 are formed in the base 4. Each of the flow paths comprises a pressure chamber 3 which exhibits a parallelogram shape and serves as an ink accommodating portion at a position facing the piezoelectric element 7 and an ink feed path 8 communicating with this pressure chamber 3 as shown in FIG. 49. The ink is introduced into the pressure chamber 3 from the ink tank after passing through the ink feed path 8.

The vibrating plates 5 and 6 form a two-layer structure of two superimposed vibrating plates as shown in FIG. 47 and FIG. 48. One vibrating plate 5 is provided on the surface of the base 4 opposite to the surface at which the orifice plate 2 is provided so as to cover all of the pressure chambers 3 provided in the base 4. The other vibrating plate 6 is given substantially the same width as that of the piezoelectric elements 7 by partial removal using the piezoelectric elements 7 as a mask as indicated in the method of production mentioned later.

Figure 50A:
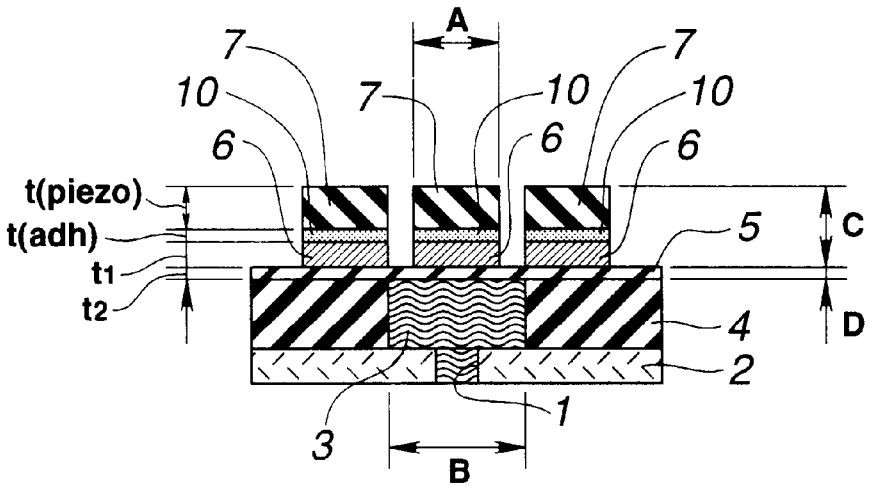
FIG. 50A and FIG. 50B are sectional views of the ink discharge standby state of a print head to which the present invention is applied.
Figure 50B:
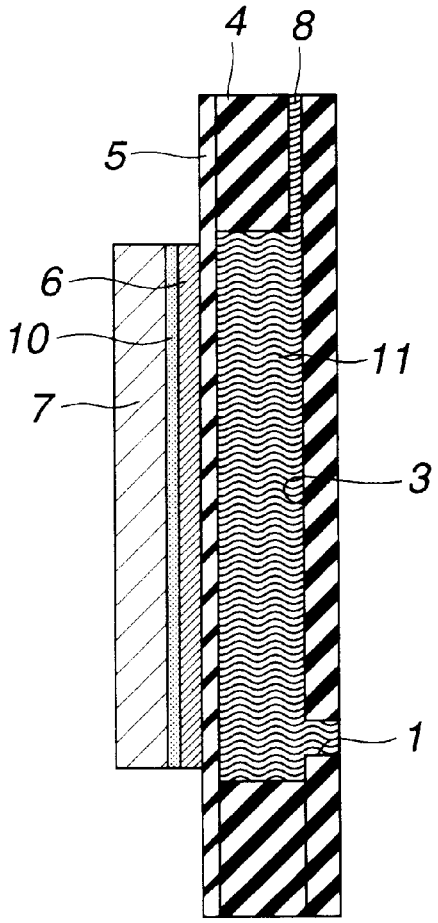

The piezoelectric element 7 is made of a monomorphic element obtained by forming electrodes on upper and lower surfaces of a sintered ceramic and serves to change the pressure in the pressure chamber 3 by deformation by application of voltage so as to discharge the ink, that is, the discharge medium, from the discharge nozzle 1. This piezoelectric element 7 is formed as a parallelogram and is bonded to the vibrating plate 6 via an adhesive layer 10 as shown in FIGS. 50A and 50B.

Among the plurality of piezoelectric elements 7 arranged on the vibrating plates 5 and 6 at predetermined intervals, the piezoelectric elements 7 provided at the positions corresponding to the pressure chambers 3 indicated by hatching in FIG. 47 and FIG. 49 act as the regular piezoelectric elements 7 contributing to the imparting of pressure of the pressure chambers 3 when discharging the ink (hereinafter, this will be referred to as a regular piezoelectric element 7). Contrary to this, the piezoelectric elements 7 provided at positions not corresponding to the pressure chambers 3 act as dummy so-called piezoelectric elements not contributing to the imparting of pressure of the pressure chambers 3 (hereinafter, this will be referred to as dummy piezoelectric elements 7). The dummy piezoelectric elements 7 function to enhance the bonding reliability when bonding the base 4 and the orifice plate 2 to the vibrating plates 5 and 6 as will be mentioned in the production process mentioned later and the mechanical strength. Note that, in this example, the regular piezoelectric elements 7 and the dummy piezoelectric elements 7 are alternately arranged.

Figure 51A:
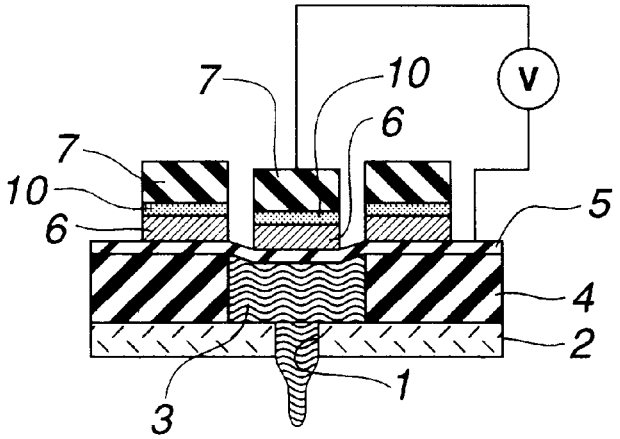
FIG. 51A and FIG. 51B are sectional views of the ink discharging state of a print head to which the present invention is applied.
Figure 51B:
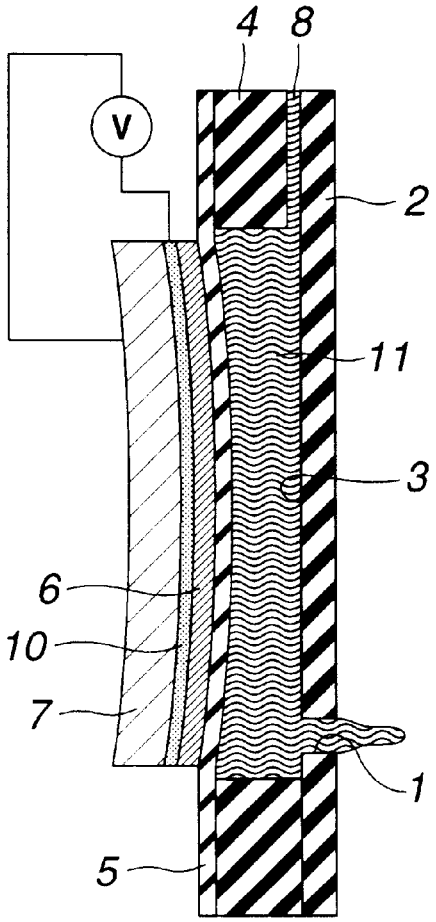

The discharging operation of the ink in the print head constituted in this way is as follows. When a voltage is given to a piezoelectric element 7 from the initial state shown in FIGS. 50A and 50B, as shown in FIGS. 51A and 51B, the bimorphic effect of the piezoelectric element 7 and the superposed vibrating plates 5 and 6 causes these piezoelectric element 7 and vibrating plates 5 and 6 to bend. For this reason, pressure is given to the pressure chamber 3 corresponding to the piezoelectric element 7 so as to discharge the ink 11 filled in the pressure chamber 3 from the discharge nozzle 1.

The print head constituted as described above is produced according to the following process.

Figure 52:
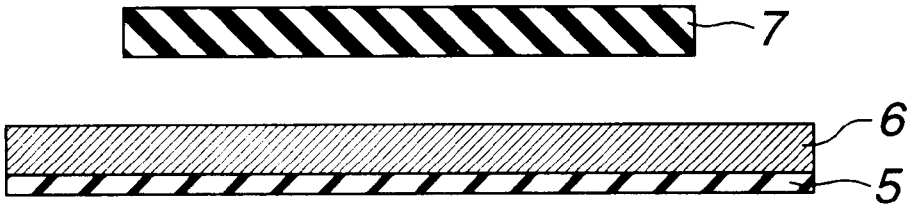
FIG. 52 shows a method of production of a print head to which the present invention is applied and is a sectional view of a state before the piezoelectric element layer is bonded to the vibrating plates.

First, as shown in FIG. 52, vibrating plates 5 and 6 for forming the two-layer structure and the piezoelectric element layer 7 are prepared. The materials for the vibrating plates 5 and 6 for forming the two layers are selected so that the vibrating plate 5 of the lower layer will not etched by the solution for dissolving the vibrating plate 6 of the upper layer. Further, the material of the vibrating plate 5 of the lower layer is selected to be free of almost all pits. Further, both of the vibrating plates 5 and 6 of the upper layer and the lower layer are desirably electrically conductive.

More specifically, the vibrating plate 6 of the upper layer may be made of a metal foil having a thickness of 20 $\mu$m or more mainly composed of copper, while the vibrating plate 5 of the lower layer may have a thickness of 15 $\mu$m or less and be made of mainly composed of nickel or titanium. Further, as to the method of superposing these vibrating plates 5 and 6, it is sufficient so far as they are tightly bonded. There exist a method of forming the vibrating plate 5 of the lower layer on the vibrating plate 6 of the upper layer by plating or a method of forming the vibrating plate 6 of the upper layer on the vibrating plate 5 of the lower layer by plating and further a method of bonding the vibrating plate 6 of the upper layer and the vibrating plate 5 of the lower layer, more specifically, a method of bonding them by adding a weight in a vacuum atmosphere etc.

On the other hand, the piezoelectric element layer 7 is comprised of a sintered ceramic having electrodes on its upper and lower surfaces. FIG. 52 shows this while omitting the electrodes. The thickness of this piezoelectric element layer 7 is desirably 200 μm or less. Note that, in this example, an explanation is made of a single piezoelectric element layer 7, but there is no problem even if it is a superposed assembly of piezoelectric element layers.

Further, the material of the vibrating plate 5 of the lower layer is desirably formed by rolling since there is a smaller possibility of existence of pits formed in a later stage in a material formed by press rolling than a material formed by the plating. Further, more desirably all materials constituting the vibrating plates 5 and 6 are formed by rolled foil.

Figure 53:
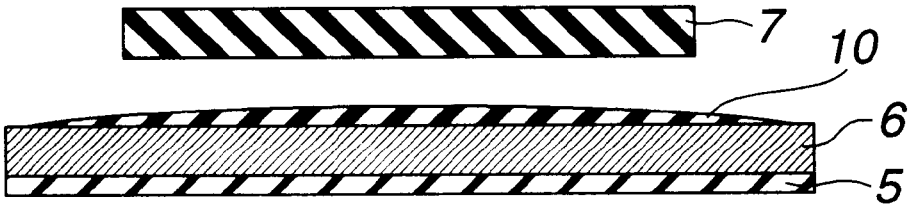
FIG. 53 shows a method of production of a print head to which the present invention is applied and is a sectional view of a state where the adhesive is coated on the vibrating plates.

Next, as shown in FIG. 53, an adhesive 10 is coated on the vibrating plate 6 of the upper layer among the laminated vibrating plates 5 and 6. Alternatively, it is also possible to coat the adhesive 10 on the surface of the piezoelectric element layer 7 and further both sides of the piezoelectric element layer 7 and the vibrating plate 6. It is sufficient so far as the adhesive 10 has a strength that is durable so that the vibrating plates 5 and 6 will not be peeled off in the later cutting process of the piezoelectric element layer 7. Further, this adhesive 10 desirably has electrical conductivity. More concretely, it may be a material obtained by mixing electrically conductive particles such as a metal in a epoxy adhesive.

Figure 54:
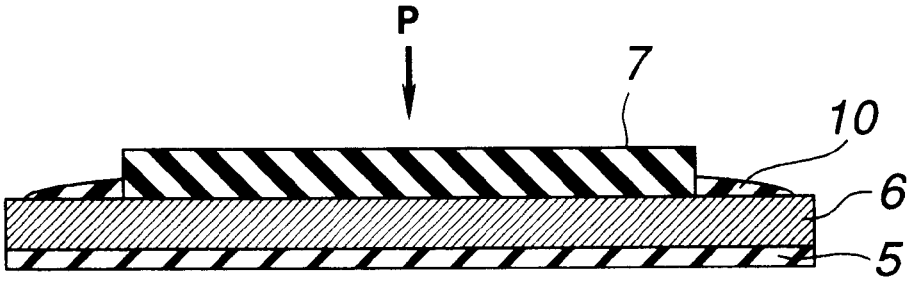
FIG. 54 shows a method of production of a print head to which the present invention is applied and is a sectional view of a state where the piezoelectric element layer is bonded to the vibrating plates.

Subsequently, as shown in FIG. 54, a pressure P is added from the piezoelectric element layer 7 side and to perform pressing so that the vibrating plates 5 and 6 and the piezoelectric element layer 7 can be bonded more strongly and the bonding can be carried out while reducing the thickness of the adhesive 10. Note that, while pressing was performed in this example, pressing need not be performed where a method is used with which the thickness of the adhesive 10 is stabilized and further the piezoelectric element layer 7 and the vibrating plates 5 and 6 are tightly affixed.

Further, here, it is also possible if an underlying layer is further provided on the vibrating plate 6 of the upper layer so as to stabilize the coating of the adhesive 10. For example, it is effective to provide a layer of silicon oxide of several tens of nm so as to reduce the bubbles which may be contained in the adhesive at the time of the coating.

Figure 55:
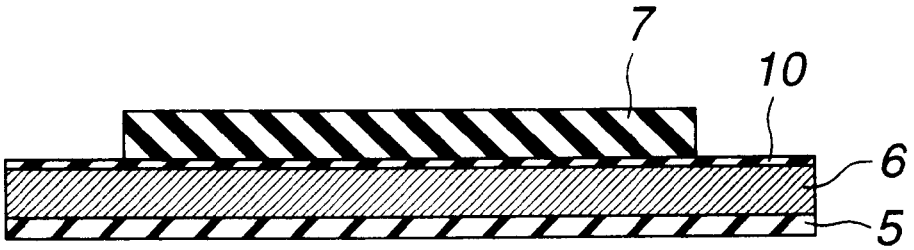
FIG. 55 shows a method of production of a print head to which the present invention is applied and is a sectional view of a state where the adhesive is thermally cured.

Next, as shown in FIG. 55, when an epoxy is used as the adhesive 10, thermal curing of the adhesive is carried out.

Figure 56:
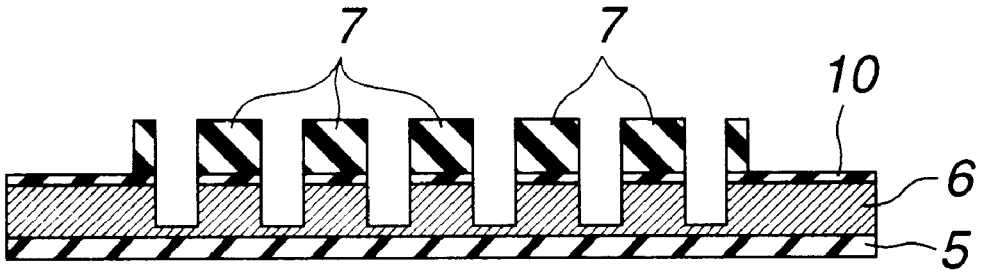
FIG. 56 shows a method of production of a print head to which the present invention is applied and is a sectional view of a state where the piezoelectric element layer is diced.

Subsequently, as shown in FIG. 56, the piezoelectric element layer 7 affixed on the vibrating plates 5 and 6 is cut by dicing by a rotating blade. Here, the cutting is carried out at a pitch such that the size of the resultant piezoelectric elements 7 becomes a size corresponding to the size of the pressure chambers communicating with the discharge nozzles. Further, dummy piezoelectric elements 7 remain also at the portions not corresponding to the pressure chambers 3. In the cutting step of this piezoelectric element layer 7, the cutting means can be a grindstone containing diamond particles in place of a diamond.

When performing the cutting, the piezoelectric element layer 7 is completely cut and the bottom of the cutting tool is prevented from reaching the vibrating plate 5 of the lower layer which served as the etching stop layer. That is, the cutting is stopped just before the vibrating plate 5 of the lower layer. The position just before the vibrating plate 5 of the lower layer means one leaving for example about 5 to 10 μm of the vibrating plate 6 of the upper layer.

Figure 57:
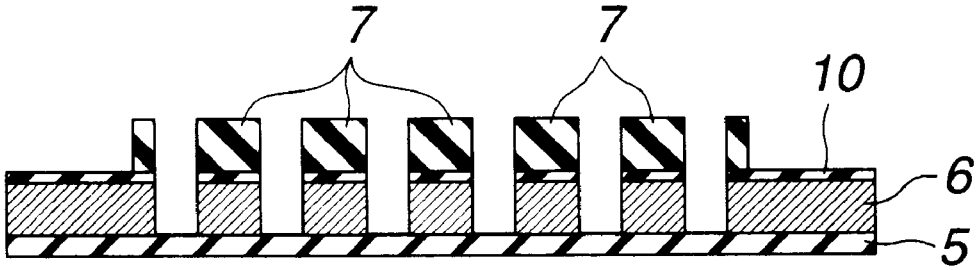
FIG. 57 shows a method of production of a print head to which the present invention is applied and is a sectional view of a state where the thickness of the vibrating plate is defined by etching.

Next, as shown in FIG. 57, the piezoelectric elements 7 bonded to the vibrating plates 5 and 6 are dipped in a solution which dissolves or etches only the vibrating plate 6 of the upper layer but does not dissolve or etch the vibrating plate 5 of the lower layer or the piezoelectric elements 7. This being done, the piezoelectric elements 7 are used as a mask and the portions of the vibrating plate 6 remaining at the cut portions are removed down to the vibrating plate 5 of the lower layer serving as the etching stop layer. As a result, the portions of the vibrating plate 6 of the upper layer remaining in the cut portions are removed, and the vibrating plate 5 of the lower layer is exposed at the bottom surface.

Here, where a material mainly composed of copper is used as the vibrating plate 6 of the upper layer and a material mainly composed of nickel or titanium is used as the vibrating plate 5 of the lower layer, the etching may be performed as shown in FIG. 57 by using as a mask the piezoelectric elements 7 remaining after the cutting by dipping in a 5 to 40 percent aqueous solution of ferric chloride for a few minutes or tens of seconds. By doing this, errors in the thickness of the vibrating plates due to the dicing can be eliminated and vibrating plates having a high precision of thickness can be obtained.

Figure 58:
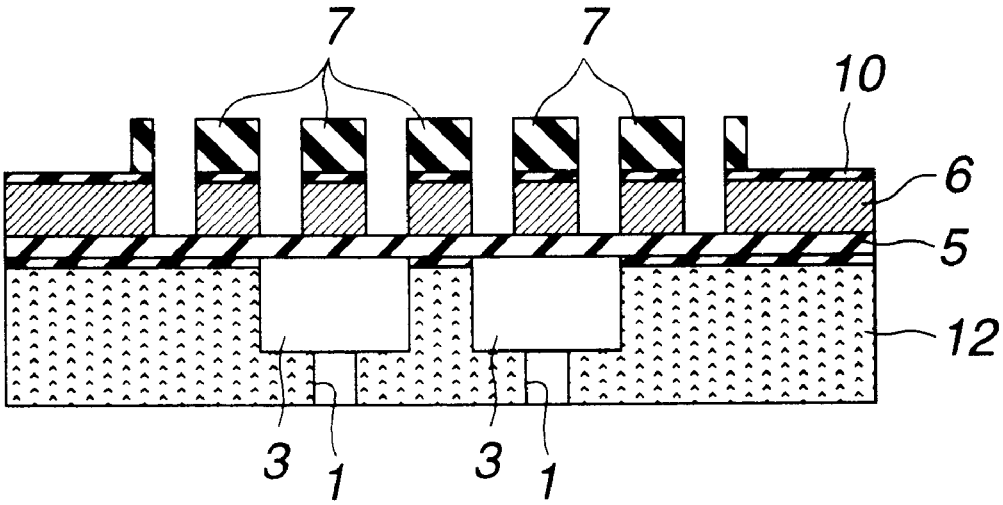
FIG. 58 shows a method of production of a print head to which the present invention is applied and is a sectional view of a state where the ink path-forming member is bonded.

Next, as shown in FIG. 58, the bonded assembly of the piezoelectric elements 7 and the vibrating plates 5 and 6 obtained in the previous step is bonded to an ink path-forming member 12, that is, the base on which the pressure chambers 3 and the ink feed paths are formed. At the bonding, the pressure chambers 3 are aligned at positions facing the piezoelectric elements 7. At this time, since the bonded assembly is provided with dummy piezoelectric elements 7 in addition to the regular piezoelectric elements 7, it is possible to make the pressure applied at the time of bonding equal. Accordingly, the reliability of the bonds is improved and the mechanical strength is raised.

Then, further, an orifice plate (not shown) having discharge nozzles 1 provided corresponding to the pressure chambers 3 and to be communicated with the pressure chambers 3 is attached to a position so that the discharge nozzles 1 are aligned with the pressure chambers 3. By this, a print head shown in FIG. 47 and FIG. 48 is completed.

In a print head produced after going through such a process, the same effects are obtained as with the print head of Embodiment 1. Here, those effects will be omitted and description made only of the effects peculiar to this print head so as to avoid an overlapped description.

Namely, in this print head, the plurality of divided piezoelectric elements 7, that is, the regular piezoelectric elements 7 contributing to the imparting of pressure to the pressure chambers 3 and the dummy piezoelectric elements 7 not contributing to the imparting of pressure to the pressure chambers 3, are arranged with periodicity with respect to the direction of arrangement of the pressure chambers 3, so the imparting of pressure can be facilitated in the tight affixment step with the ink path-forming member 12 shown in FIG. 58.

Further, since the plurality of divided piezoelectric elements 7, that is, the regular piezoelectric elements 7 contributing to the imparting of pressure to the pressure chambers 3 and the dummy piezoelectric elements 7 not contributing to the imparting of pressure to the pressure chambers 3, are arranged with periodicity with respect to the direction of arrangement of the pressure chambers 3, in the cutting step of the piezoelectric elements 7, a cutting tool having a narrow width with little cutting resistance can be used and the cutting conditions become stable. More specifically, where the nozzle pitch of the discharge nozzles 1 is about 0.6 mm and the width of the regular piezoelectric elements 7 is about 0.2 mm, it is sufficient if a cutting tool having a width of about 0.1 mm is used. Contrary to this, where the regular piezoelectric elements 7 and the dummy piezoelectric elements 7 are not arranged with periodicity with respect to the direction of arrangement of the pressure chambers 3, it is necessary to use a cutting tool of about 0.4 mm, therefore the volume of the portion to be removed by cutting becomes large, and the cutting becomes troublesome.

The above description is for the method of production of the print head shown in FIG. 47 and FIG. 48, Other than this, as the adhesive for bonding the vibrating plate 6 and the piezoelectric element layer 7, as indicated in Embodiment 1, a liquid metal adhesive can be used. As the bonding method of the vibrating plate 6 and the piezoelectric element layer at this time, a method shown in Embodiment 1 can be used too, therefore the explanation will be omitted.

In the print head produced in this way, not only can the same effect as that by the print head produced by the previous method be obtained, but also the effect of the case of using the liquid metal adhesive 13 can be obtained similar to Embodiment 1.

Embodiment 5

Figure 59:
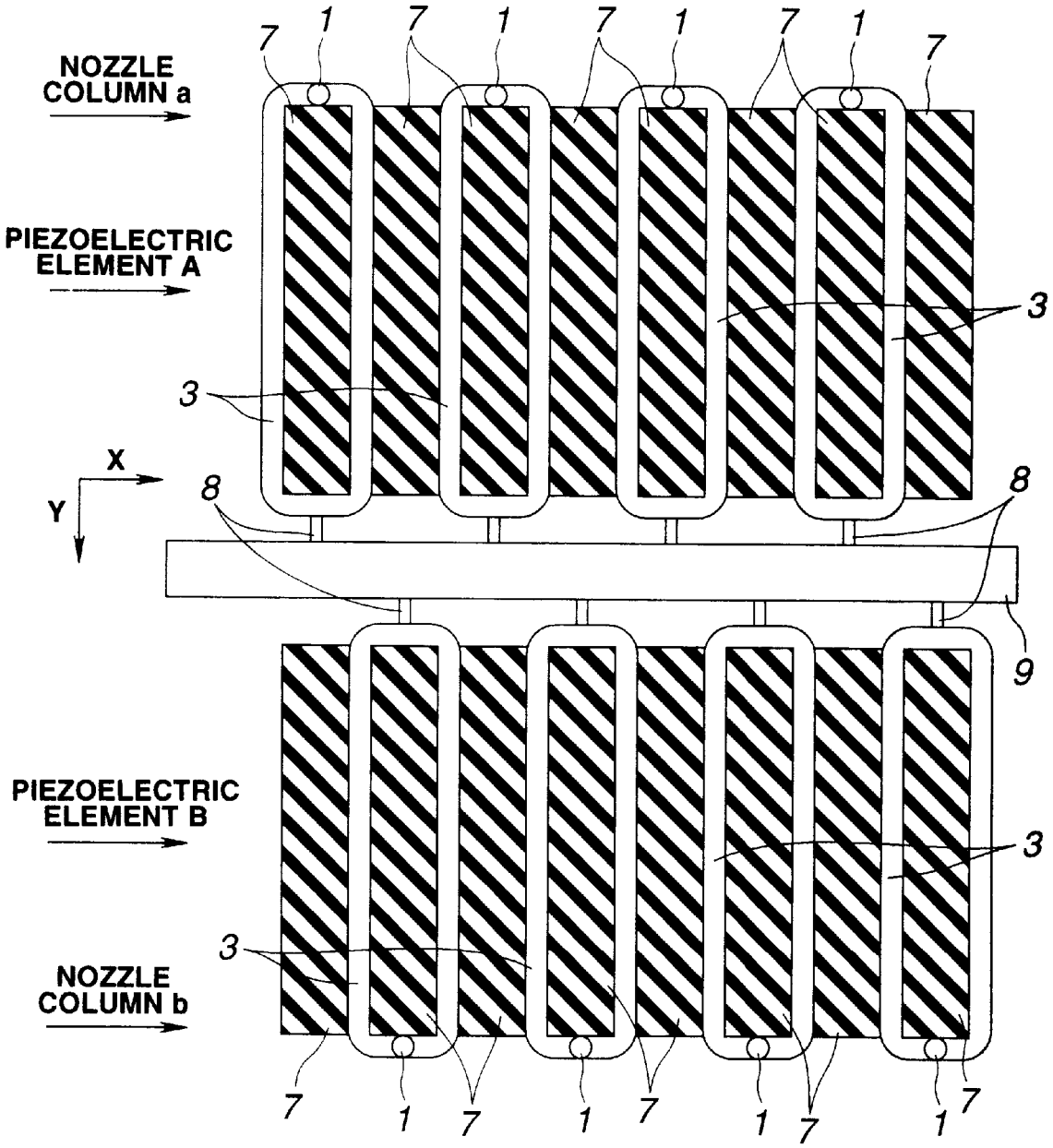
FIG. 59 is a plan view of another example of a print head to which the present invention is applied.

In the print head in this example, as shown in FIG. 59, the regular piezoelectric elements 7 and the dummy piezoelectric elements 7 are cyclically arranged not only in the column direction X of the pressure chamber 3, but also in a direction Y orthogonal to this.

This print head has the same configuration as that of the print head shown in FIG. 47 and FIG. 48. Only the arrangement of the piezoelectric elements 7 differs. Accordingly, here, the same reference numerals are given to the same members as those of the print head of Embodiment 4, and different reference numerals are given to the different members. Explanations of the same portions will be omitted. Further, the ink discharging operation in the print head and the method of production of the present embodiment are the same as those of the print head of Embodiment 4, therefore the explanations thereof will be omitted.

This print head is given a structure wherein, as shown in FIG. 59, the ink introducing portion 9 provided at the center is used as a trunk, a plurality of pressure chambers 3 connected to the ink feed paths 8 provided vertically branched from this ink introducing portion 9 are provided, and the regular piezoelectric elements 7 provided facing these pressure chambers 3 and the dummy piezoelectric elements 7 not facing the pressure chambers 3 are cyclically arranged.

Namely, in FIG. 59, the regular piezoelectric elements 7 (indicated by hatching in the same figure) and the dummy piezoelectric elements 7 arranged at an upper position with the ink introducing portion 9 as the boundary are alternately arranged at predetermined intervals in the order, from the left, of the regular piezoelectric element 7, the dummy piezoelectric element 7, the regular piezoelectric element 7 and the dummy piezoelectric element 7. On the other hand, the regular piezoelectric elements 7 and the dummy piezoelectric elements 7 arranged at a lower position with the ink introducing portion 9 as the boundary are alternately arranged at predetermined intervals in the order, from the left, of the dummy piezoelectric element 7, the regular piezoelectric element 7, and the regular piezoelectric element 7. When viewing this from the whole, they are arranged in a so-called zigzag pattern in which a regular piezoelectric element 7 arranged at the lower position is located between regular piezoelectric elements 7 arranged at the upper positions.

When conversely viewing this, the regular piezoelectric elements 7 in a nozzle column b to be arranged at the lower position are arranged on an extended line in the longitudinal direction of the dummy piezoelectric elements 7 in a nozzle column a to be arranged at the upper position with the ink introducing portion 9 as the boundary.

By such an arrangement, in the step of dividing the piezoelectric elements of the nozzle column a, it becomes possible to simultaneously perform the division of the piezoelectric elements of the nozzle column b. Further, since the discharge nozzles 1 of the nozzle columns a and b are alternately arranged, the density of the discharge nozzles 1 is improved.

Figure 60:
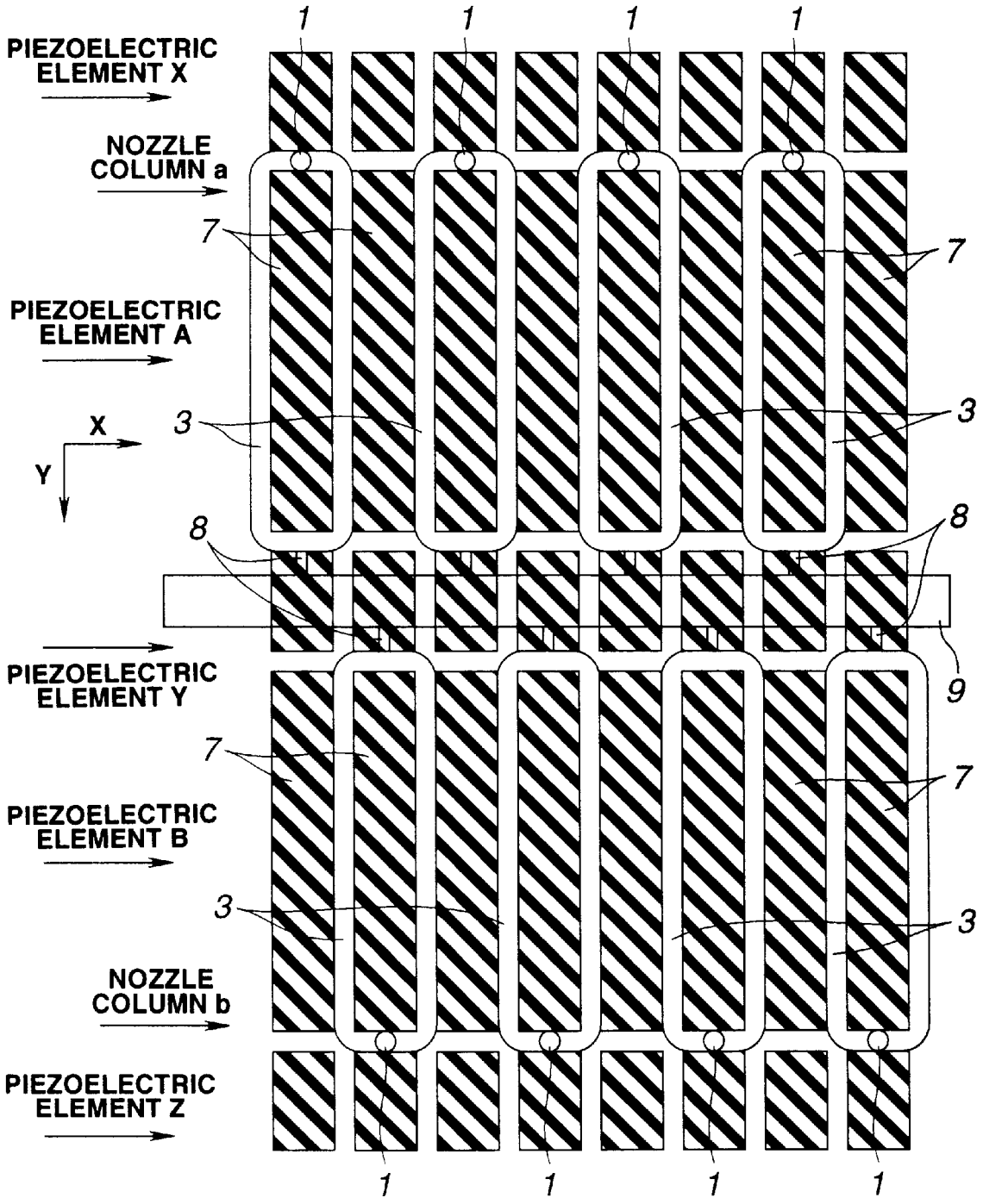
FIG. 60 is a plan view of still another example of a print head to which the present invention is applied.

Note that, as shown in FIG. 60, there is no problem even if the piezoelectric element columns X, Y, and Z not contributing to the rise of pressure exist in addition to the piezoelectric element columns A and B contributing to the rise of the pressure of the nozzle columns a and b.

Figure 61:
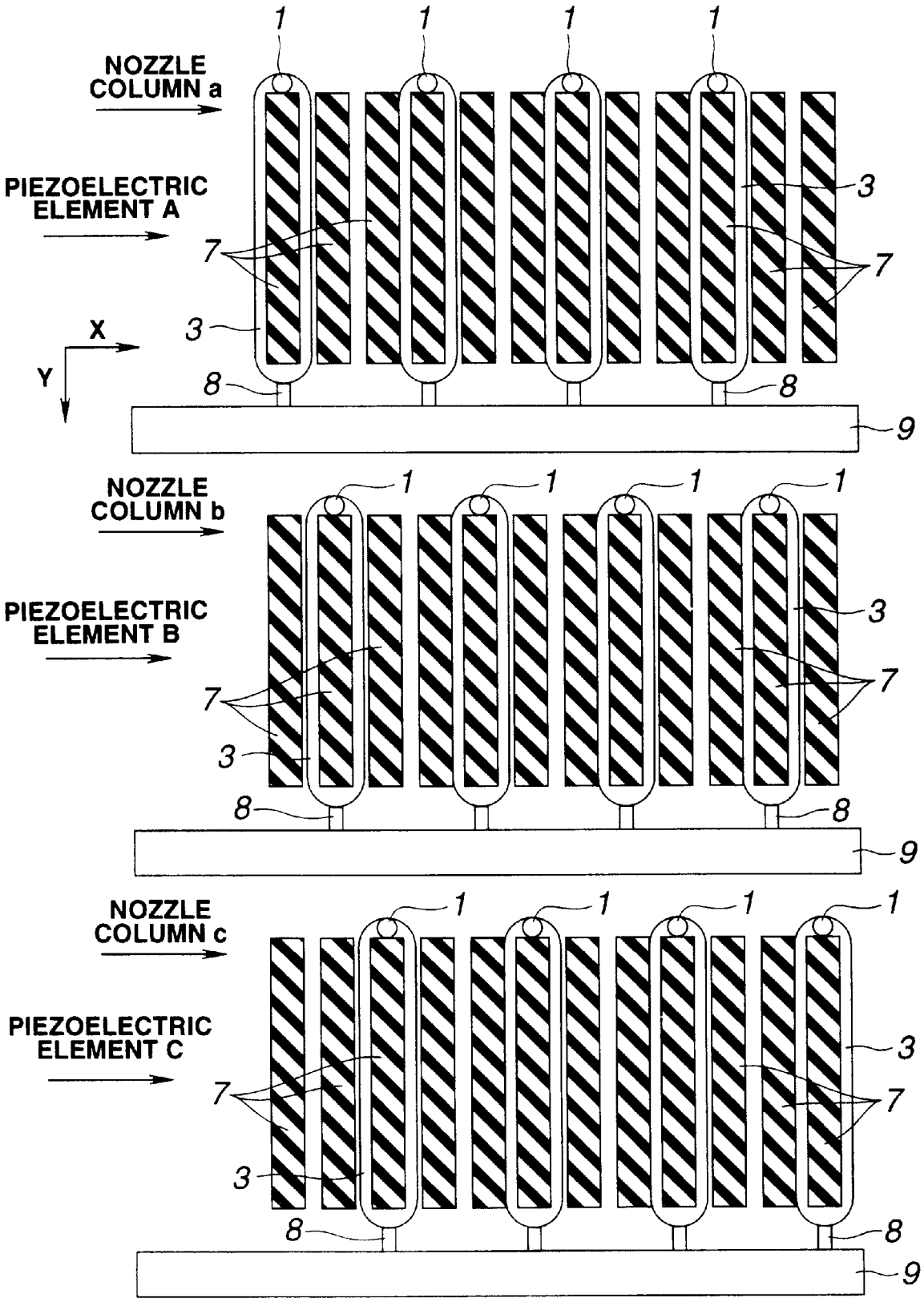
FIG. 61 is a plan view of still another example of a print head to which the present invention is applied.

Other than this, a pattern as shown in FIG. 61 can be considered for the arrangement of the regular piezoelectric elements 7 and the dummy piezoelectric elements 7, for example. Here, three nozzle groups, each consisting of the regular piezoelectric elements 7 provided facing the pressure chambers 3 connected to the ink feed paths 8 provided respectively branched from the ink introducing portion 9 and the dummy piezoelectric elements 7 not facing the pressure chambers 3, are arranged in the vertical direction. The regular piezoelectric elements 7 and dummy piezoelectric elements 7 of these three nozzle groups are cyclically arranged with respect to the column direction X of the pressure chambers 3 and the direction Y orthogonal to this.

Specifically, the regular piezoelectric elements 7 and the dummy piezoelectric elements 7 of the nozzle group located at the upper part of FIG. 61 are arranged with the regular piezoelectric elements 7 arranged at intervals of two dummy piezoelectric elements 7 at predetermined intervals, i.e., from the left, the regular piezoelectric element 7, the dummy piezoelectric element 7, the dummy piezoelectric element 7, the regular piezoelectric element 7, the dummy piezoelectric element 7, the dummy piezoelectric element 7, and the regular piezoelectric element 7 are arranged in order.

On the other hand, the regular piezoelectric elements 7 and the dummy piezoelectric elements 7 of the nozzle group located in the middle part are arranged so that the regular piezoelectric elements 7 are arranged at intervals of two dummy piezoelectric elements 7 at predetermined intervals as well, i.e., from the left, the dummy piezoelectric element 7, the regular piezoelectric element 7, the dummy piezoelectric element 7, the dummy piezoelectric element 7, and the regular piezoelectric element 7 are arranged in order.

The regular piezoelectric elements 7 and the dummy piezoelectric elements 7 of the nozzle group located in the lower part are arranged so that the regular piezoelectric elements 7 are arranged at intervals of two dummy piezoelectric elements 7 at predetermined intervals as well, i.e., from the left, the dummy piezoelectric element 7, the dummy piezoelectric element 7, the regular piezoelectric element 7, the dummy piezoelectric element 7, the dummy piezoelectric element 7, and the regular piezoelectric element 7 are arranged in order.

Viewing this as the whole, they are arranged in a so-called zigzag pattern in which the regular piezoelectric elements 7 to be respectively provided in the middle part and the lower part are alternately arranged between two regular piezoelectric elements 7 arranged in the upper part.

Conversely viewing this, the regular piezoelectric elements 7 in a nozzle column c to be arranged in the lower part are arranged on an extended line in the longitudinal direction of the dummy piezoelectric elements 7 in the nozzle columns a and b of the upper part and the middle part and, at the same time, the regular piezoelectric elements 7 in the nozzle column c to be arranged in the middle part are arranged on the extended line in the longitudinal direction of the dummy piezoelectric elements 7 in the nozzle columns a and c of the upper part and the lower part.

By such an arrangement, in the step of dividing the piezoelectric elements of the nozzle column a, it becomes possible to simultaneously perform the division of the piezoelectric elements of the nozzle column b and the nozzle column c. Further, since the discharge nozzles 1 of the nozzle columns a, b, and c are alternately arranged, the density of the discharge nozzles 1 is improved.

Figure 62:
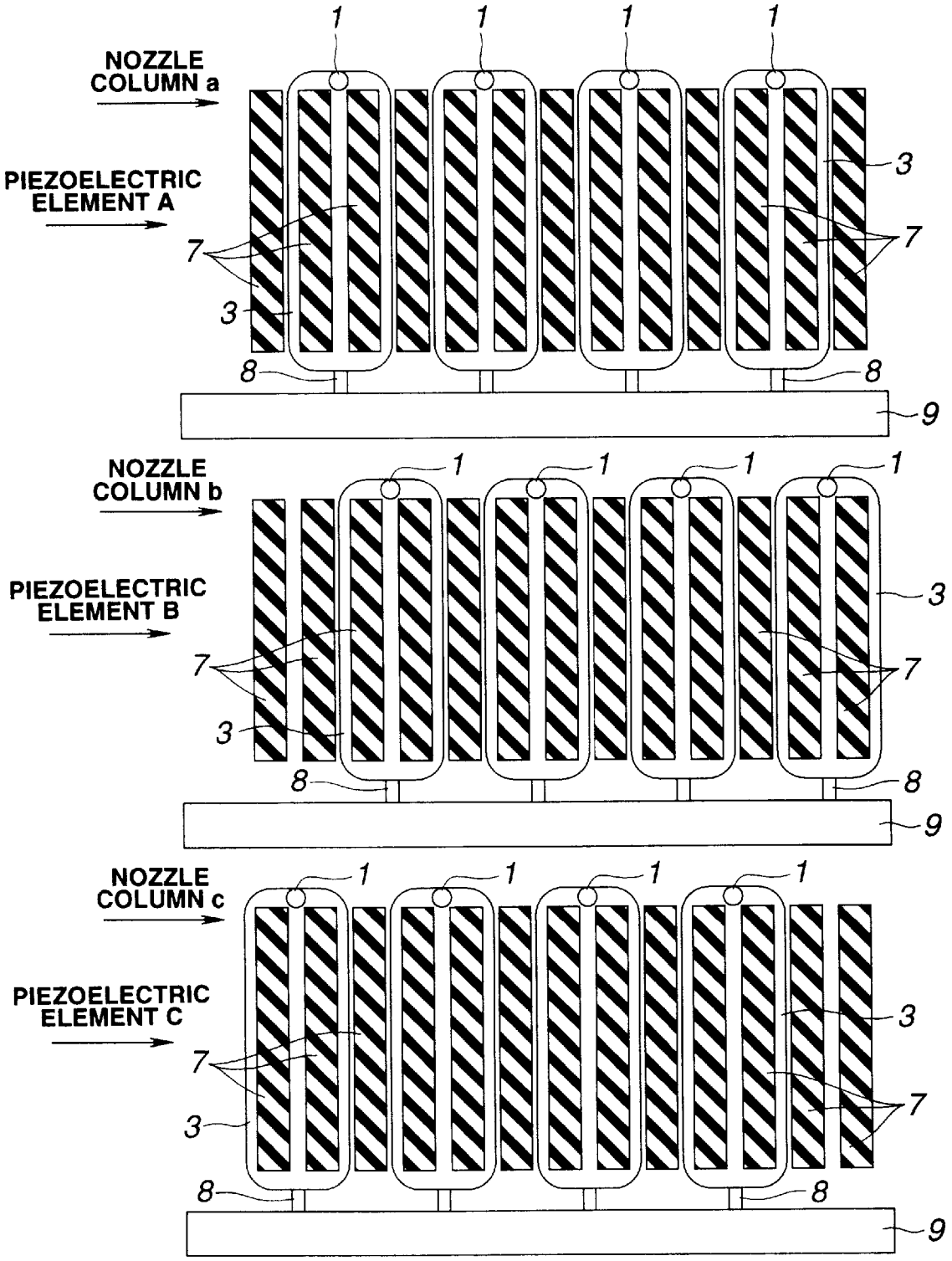
FIG. 62 is a plan view of a further example of a print head to which the present invention is applied.

Further, in addition, as shown in FIG. 62, it is also possible to constitute the discharge nozzles 1 of the respective nozzle groups in a zigzag manner and, at the same time, arrange two regular piezoelectric elements 7 for one pressure chamber 3. Note that, in the above embodiment, the number of the nozzle columns was set to three, but a further enhancement of the density of the discharge nozzles 1 can be similarly achieved even if the number of the nozzle columns is set to be four.

Embodiment 6

Figure 63:
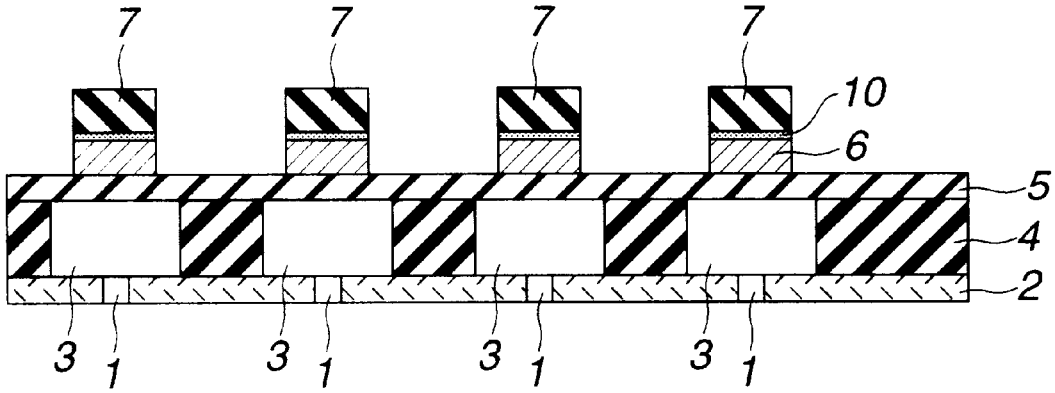
FIG. 63 is a lateral sectional view of a print head to which the present invention is applied.
Figure 64:
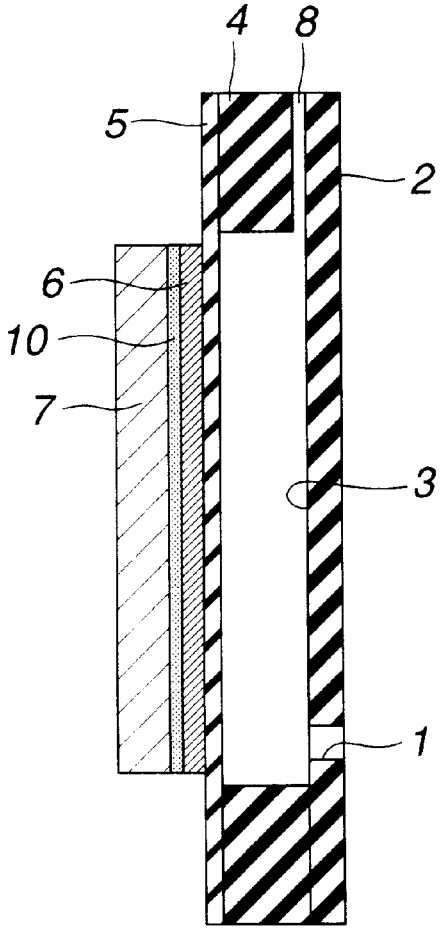
FIG. 64 is a vertical sectional view of a print head to which the present invention is applied.

This print head comprises, as shown in FIG. 63 and FIG. 64, an orifice plate 2 having a plurality of discharge nozzles 1, a base 4 having a plurality of pressure chambers 3 communicated with these discharge nozzles 1 and arranged corresponding to the discharge nozzles 1, vibrating plates 5 and 6 attached to this base 4, and a plurality of piezoelectric elements 7 arranged on these vibrating plates 5 and 6.

Figure 65:
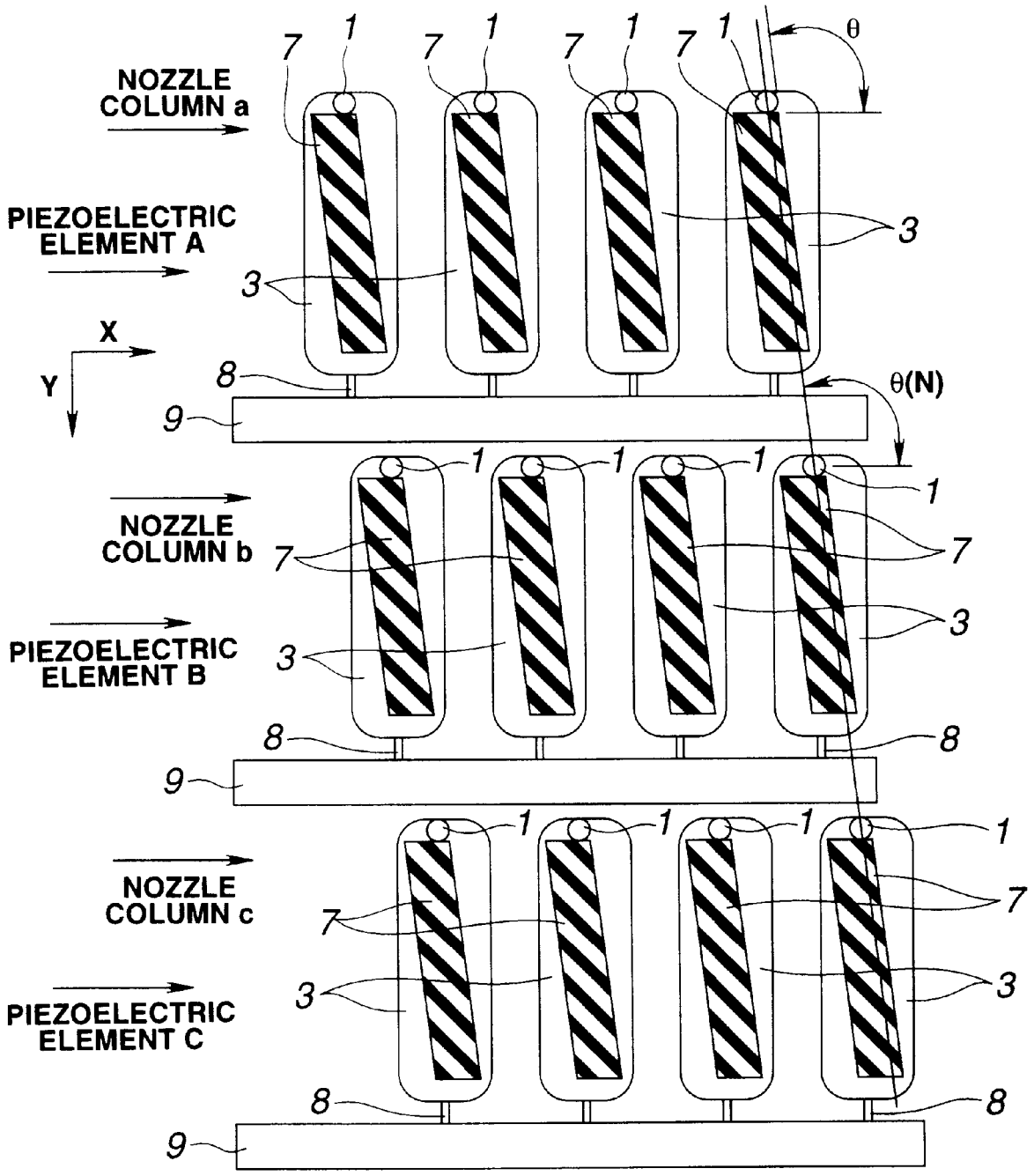
FIG. 65 is a plan view of a print head to which the present invention is applied.

As shown in FIG. 63, the orifice plate 2 is formed as a substrate having a plurality of discharge nozzles 1 for discharging the ink, that is, the discharge medium, and is attached to the surface of the base 4 opposite to the surface on which the vibrating plate 5 is provided. The discharge nozzles 1 provided on this orifice plate 2 are provided so as to face the respective pressure chambers 3 formed on the base 4 and, at the same time, are communicated with the respective pressure chambers 3. The shape of the outlets of the discharge nozzles 1 may be either a round shape or square shape since the ink is designed to try to become spherical due to its surface tension. In this example, as shown in FIG. 65, the shape of the outlets of the discharge nozzles 1 is made circular.

As shown in FIG. 63 and FIG. 64, flow paths for guiding the ink to the discharge nozzles 1 are formed in the base 4. Each of the flow paths comprises a pressure chamber 3 which exhibits a parallelogram shape and serves as an ink accommodating portion at a position facing the piezoelectric element 7 and an ink feed path 8 communicating with this pressure chamber 3 as shown in FIG. 65. The ink is introduced into the pressure chamber 3 from the ink tank after passing through the ink feed path 8.

The vibrating plates 5 and 6 form a two-layer structure of two superimposed vibrating plates as shown in FIG. 63 and FIG. 64. One vibrating plate 5 is provided on the surface of the base 4 opposite to the surface at which the orifice plate 2 is provided so as to cover all of the pressure chambers 3 provided in the base 4. The other vibrating plate 6 is given substantially the same width as that of the piezoelectric elements 7 by partial removal using the piezoelectric elements 7 as a mask as indicated in the method of production mentioned later.

The piezoelectric element 7 is made of a monomorphic element obtained by forming electrodes on upper and lower surfaces of a sintered ceramic and serves to change the pressure in the pressure chamber 3 by deformation by application of voltage so as to discharge the ink, that is, the discharge medium, from the discharge nozzle 1. This piezoelectric element 7 is formed as a parallelogram having a vertical angle θ of 90.5 degrees or more and is bonded to the vibrating plate 6 via an adhesive layer 10 as shown in FIG. 65.

In the print head constituted by such a structure, as shown in FIG. 65, three nozzle groups, each including a plurality of piezoelectric elements 7 provided facing the pressure chambers 3 connected to the ink feed paths 8 provided respectively branched from the ink introducing portion 9, are arranged in the vertical direction. The piezoelectric elements 7 of these three nozzle groups are cyclically arranged in the column direction X of the pressure chambers 3 and the direction Y orthogonal to this. Here, discharge nozzles 1 to be respectively provided in the middle part and the lower part are alternately arranged between the two discharge nozzles 1 arranged in the upper part. The piezoelectric elements 7 arranged in the upper part, the piezoelectric elements 7 arranged in the middle part, and the piezoelectric elements 7 arranged in the lower part are arranged on the same line.

Figure 66A:
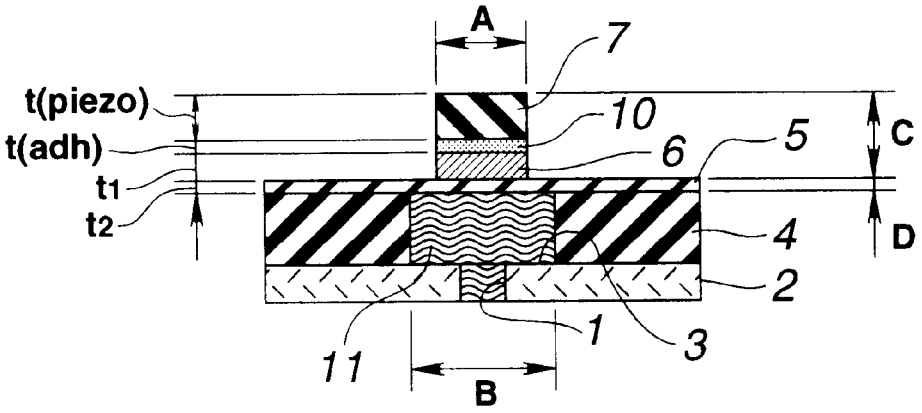
FIG. 66A and FIG. 66B are sectional views of the ink discharge standby state of a print head to which the present invention is applied.
Figure 66B:
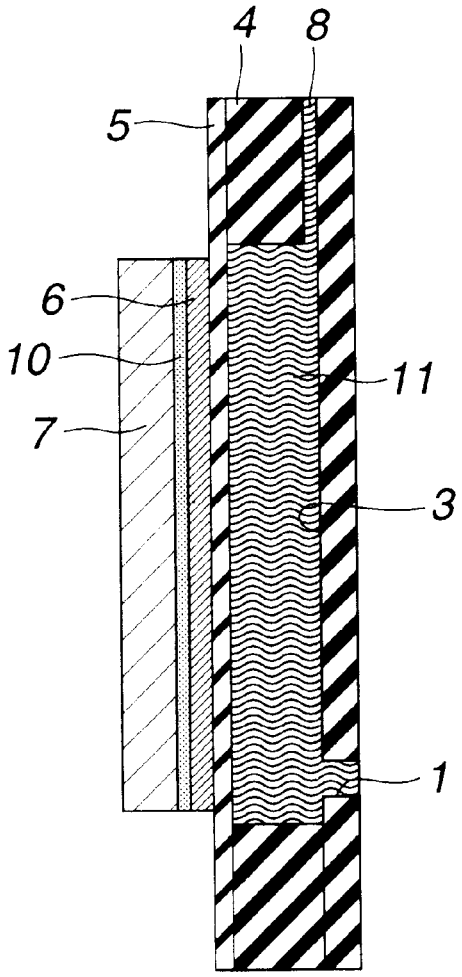
Figure 67A:
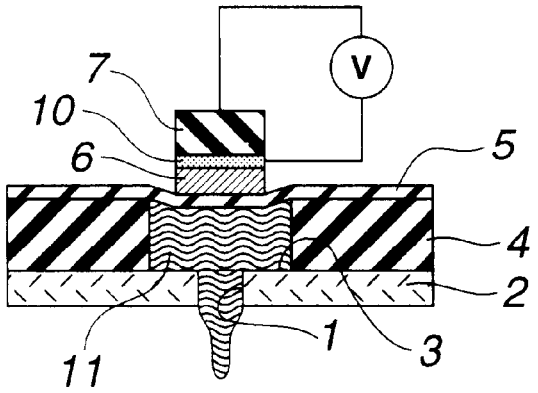
FIG. 67A and FIG. 67B are sectional views of the ink discharging state of a print head to which the present invention is applied.
Figure 67B:
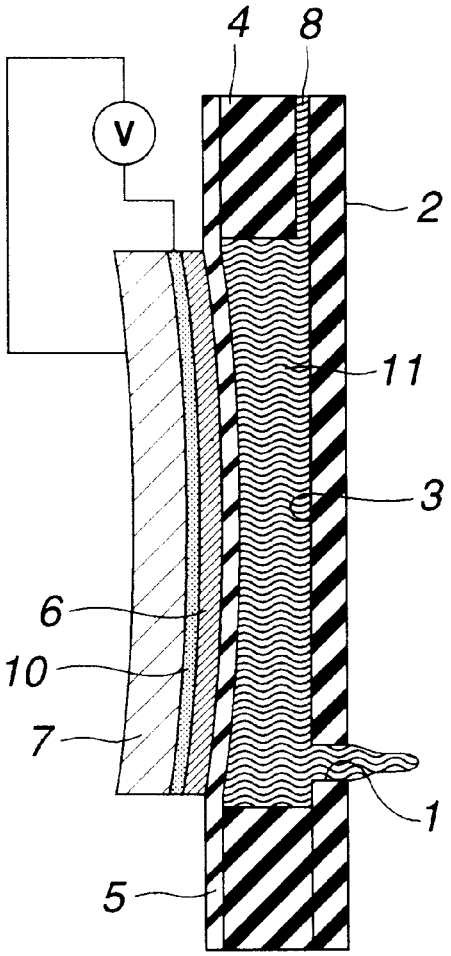

The discharging operation of the ink in the print head constituted in this way is as follows. When a voltage is given to a piezoelectric element 7 from the initial state shown in FIGS. 66A and 66B, as shown in FIGS. 67A and 67B, the bimorphic effect of the piezoelectric element 7 and the superposed vibrating plates 5 and 6 causes these piezoelectric element 7 and vibrating plates 5 and 6 to bend. For this reason, pressure is given to the pressure chamber 3 corresponding to the piezoelectric element 7 so as to discharge the ink 11 filled in the pressure chamber 3 from the discharge nozzle 1.

In this print head, the bimorphic effect is generated by the two superposed layers of plates 5 and 6 and the piezoelectric element 7. The only load for obtaining a displacement necessary for raising the pressure in the pressure chamber 3 is the vibrating plate 5 of the lowermost layer provided covering the pressure chamber 3. When illustrating this, as shown in FIG. 66A, the portion indicated by C in the figure mainly generates a displacement force, and the portion indicated by D in the same figure acts as the load.

The print head constituted as described above is produced according to the following process.

Figure 68:
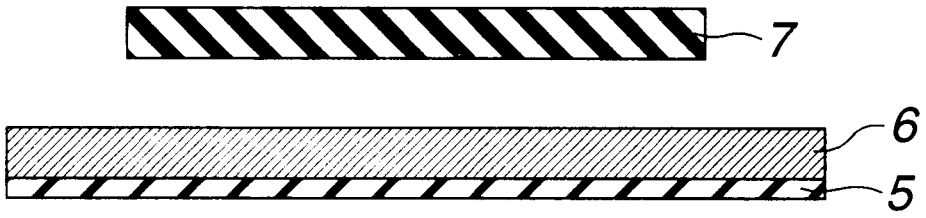
FIG. 68 shows a method of production of a print head to which the present invention is applied and is a sectional view of the state before the piezoelectric element layer is bonded to the vibrating plates.

First, as shown in FIG. 68, vibrating plates 5 and 6 for forming the two-layer structure and the piezoelectric element layer 7 are prepared. The materials for the vibrating plates 5 and 6 for forming the two layers are selected so that the vibrating plate 5 of the lower layer will not etched by the solution for dissolving the vibrating plate 6 of the upper layer. Further, the material of the vibrating plate 5 of the lower layer is selected to be free of almost all pits. Further, both of the vibrating plates 5 and 6 of the upper layer and the lower layer are desirably electrically conductive.

More specifically, the vibrating plate 6 of the upper layer may be made of a metal foil having a thickness of 20 μm or more mainly composed of copper, while the vibrating plate 5 of the lower layer may have a thickness of 15 μm or less and be made of mainly composed of nickel or titanium. Further, as to the method of superposing these vibrating plates 5 and 6, it is sufficient so far as they are tightly bonded. There exist a method of forming the vibrating plate 5 of the lower layer on the vibrating plate 6 of the upper layer by plating or a method of forming the vibrating plate 6 of the upper layer on the vibrating plate 5 of the lower layer by plating and further a method of bonding the vibrating plate 6 of the upper layer and the vibrating plate 5 of the lower layer, more specifically, a method of bonding them by adding a weight in a vacuum atmosphere etc.

On the other hand, the piezoelectric element layer 7 is comprised of a sintered ceramic having electrodes on its upper and lower surfaces. FIG. 68 shows this while omitting the electrodes. The thickness of this piezoelectric element layer 7 is desirably 200 μm or less. Note that, in this example, an explanation is made of a single piezoelectric element layer 7, but there is no problem even if it is a superposed assembly of piezoelectric element layers.

Further, the material of the vibrating plate 5 of the lower layer is desirably formed by rolling since there is a smaller possibility of existence of pits formed in a later stage in a material formed by press rolling than a material formed by the plating. Further, more desirably all materials constituting the vibrating plates 5 and 6 are formed by rolled foil.

Figure 69:
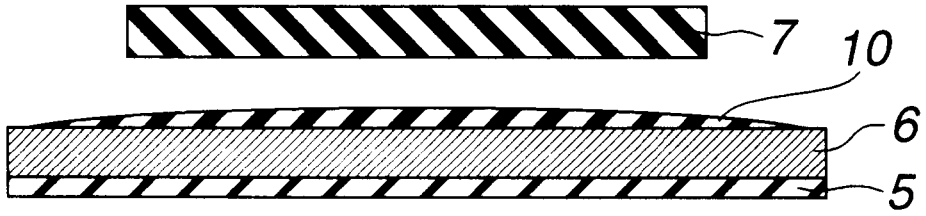
FIG. 69 shows a method of production of a print head to which the present invention is applied and is a sectional view of a state where the adhesive is coated on the vibrating plates.

Next, as shown in FIG. 69, an adhesive 10 is coated on the vibrating plate 6 of the upper layer among the laminated vibrating plates 5 and 6. Alternatively, it is also possible to coat the adhesive 10 on the surface of the piezoelectric element layer 7 and further both sides of the piezoelectric element layer 7 and the vibrating plate 6. It is sufficient so far as the adhesive 10 has a strength that is durable so that the vibrating plates 5 and 6 will not be peeled off in the later cutting process of the piezoelectric element layer 7. Further, this adhesive 10 desirably has electrical conductivity. More concretely, it may be a material obtained by mixing electrically conductive particles such as a metal in a epoxy adhesive.

Figure 70:
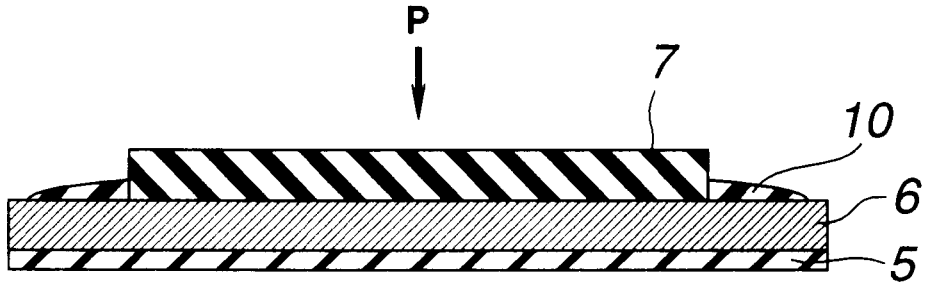
FIG. 70 shows a method of production of a print head to which the present invention is applied and is a sectional view of a state where the piezoelectric element layer is bonded to the vibrating plates.

Subsequently, as shown in FIG. 70, a pressure P is added from the piezoelectric element layer 7 side and to perform pressing so that the vibrating plates 5 and 6 and the piezoelectric element layer 7 can be bonded more strongly and the bonding can be carried out while reducing the thickness of the adhesive 11. Note that, while pressing was performed in this example, pressing need not be performed where a method is used with which the thickness of the adhesive 10 is stabilized and further the piezoelectric element layer 7 and the vibrating plates 5 and 6 are tightly affixed.

Further, here, it is also possible if an underlying layer is further provided on the vibrating plate 6 of the upper layer so as to stabilize the coating of the adhesive 10. For example, it is effective to provide a layer of silicon oxide of several tens of nm so as to reduce the bubbles which may be contained in the adhesive at the time of the coating.

Figure 71:
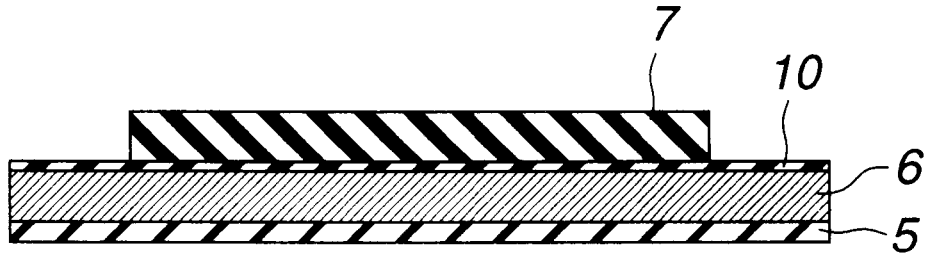
FIG. 71 shows a method of production of a print head to which the present invention is applied and is a sectional view of a state where the adhesive is thermally cured.

Next, as shown in FIG. 71, when an epoxy is used as the adhesive 10, thermal curing of the adhesive is carried out.

Figure 72:
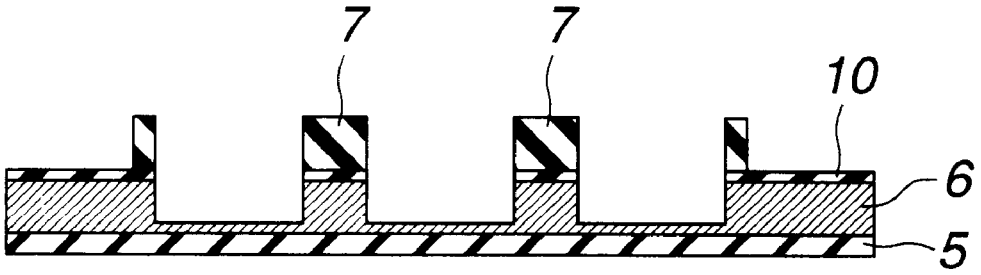
FIG. 72 shows a method of production of a print head to which the present invention is applied and is a sectional view of a state where the piezoelectric element layer is diced.

Subsequently, as shown in FIG. 72, the piezoelectric element layer 7 affixed on the vibrating plates 5 and 6 is cut by dicing by a rotating blade. Here, the cutting is carried out at a pitch such that the size of the resultant piezoelectric elements 7 becomes a size corresponding to the size of the pressure chambers communicating with the discharge nozzles. Further, at the cutting of the piezoelectric elements 7, a parallelogram having a vertical angle of 90.5 degrees or more is obtained. Note that, in the cutting step of the piezoelectric elements 7, the cutting means can be a grindstone containing diamond particles in place of diamond.

When performing the cutting, the piezoelectric element layer 7 is completely cut and the bottom of the cutting tool is prevented from reaching the vibrating plate 5 of the lower layer which served as the etching stop layer. That is, the cutting is stopped just before the vibrating plate 5 of the lower layer. The position just before the vibrating plate 5 of the lower layer means one leaving for example about 5 to 10 $\mu$m of the vibrating plate 6 of the upper layer.

Figure 73:
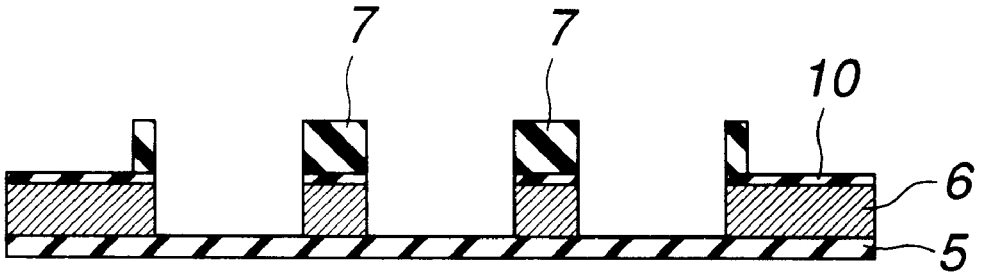
FIG. 73 shows a method of production of a print head to which the present invention is applied and is a sectional view of a state where the thickness of the vibrating plate is defined by etching.

Next, as shown in FIG. 73, the piezoelectric elements 7 bonded to the vibrating plates 5 and 6 are dipped in a solution which dissolves or etches only the vibrating plate 6 of the upper layer but does not dissolve or etch the vibrating plate 5 of the lower layer or the piezoelectric elements 7. This being done, the piezoelectric elements 7 are used as a mask and the portions of the vibrating plate 6 remaining at the cut portions are removed down to the vibrating plate 5 of the lower layer serving as the etching stop layer. As a result, the portions of the vibrating plate 6 of the upper layer remaining in the cut portions are removed, and the vibrating plate 5 of the lower layer is exposed at the bottom surface.

Here, where a material mainly composed of copper is used as the vibrating plate 6 of the upper layer and a material mainly composed of nickel or titanium is used as the vibrating plate 5 of the lower layer, the etching may be performed as shown in FIG. 73 by using as a mask the piezoelectric elements 7 remaining after the cutting by dipping in a 5 to 40 percent aqueous solution of ferric chloride for a few minutes or tens of seconds. By doing this, errors in the thickness of the vibrating plates due to the dicing can be eliminated and vibrating plates having a high precision of thickness can be obtained.

Figure 74:
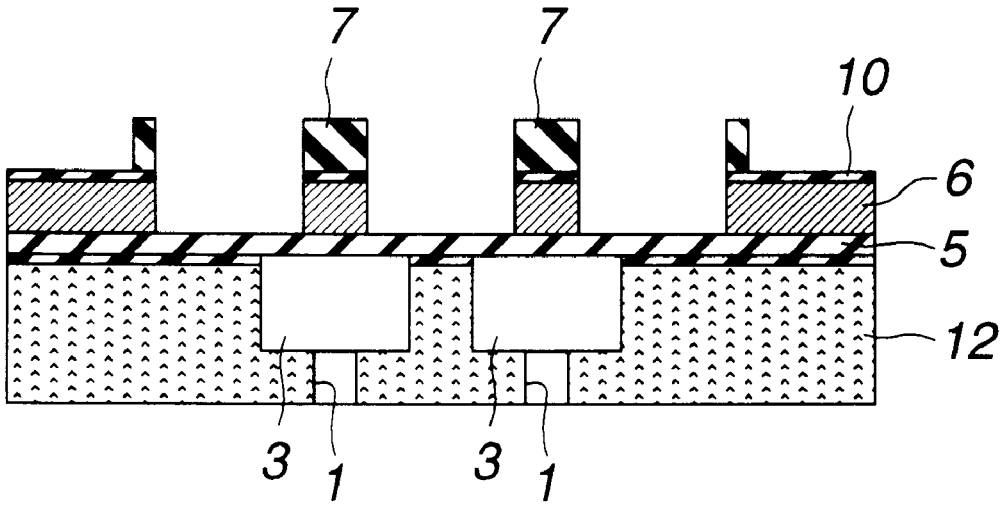
FIG. 74 shows a method of production of a print head to which the present invention is applied and is a sectional view of a state where the ink path-forming member is bonded.

Next, as shown in FIG. 74, the bonded assembly of the piezoelectric elements 7 and the vibrating plates 5 and 6 obtained in the previous step is bonded to an ink path-forming member 12, that is, the base on which the pressure chambers 3 and the ink feed paths are formed. At the bonding, the pressure chambers 3 are aligned at positions facing the piezoelectric elements 7.

Then, further, an orifice plate (not shown) having discharge nozzles 1 provided corresponding to the pressure chambers 3 and to be communicated with the pressure chambers 3 is attached to a position so that the discharge nozzles 1 are aligned with the pressure chambers 3. By this, a print head shown in FIG. 63 and FIG. 64 is completed.

In a print head produced after going through such a process, the same effects are obtained as with the print head of Embodiment 1. Here, those effects will be omitted and description made only of the effects peculiar to this print head so as to avoid an overlapped description.

Namely, in this print head, as shown in FIG. 65, by forming the piezoelectric element 7 as the parallelogram having a vertical angle $\theta$ of 90.5 degrees or more, the arrangement angle $\theta(N)$ in the vertical direction of a plurality of nozzle columns a, b, and c can be made equal, and as a result, the nozzle pitch can be made further finer.

More specifically, where the plurality of divided piezoelectric elements 7 are formed as parallelograms having a vertical angle $\theta$ of 90.5 degrees, and the length of the piezoelectric elements 7 in the longitudinal direction is set to about 10 mm, it becomes possible to shift the nozzle columns a, b, and c in the lateral direction by about 80 $\mu$m.

The above description was for the method of production of the print head shown in FIG. 63 and FIG. 65. Other than this, as the adhesive for bonding the vibrating plate 6 and the piezoelectric element layer 7, as in the previously shown embodiments, a liquid metal adhesive can be used. As the bonding method of the vibrating plate 6 and the piezoelectric element layer at this time, the method of the previously shown embodiments can be used too, therefore the explanation will be omitted.

In the print head produced in this way, not only can the same effect as that by the print head produced by the previous method be obtained, but also the effect of the case of using the liquid metal adhesive 13 can be obtained similar to that mentioned before.

Figure 75:
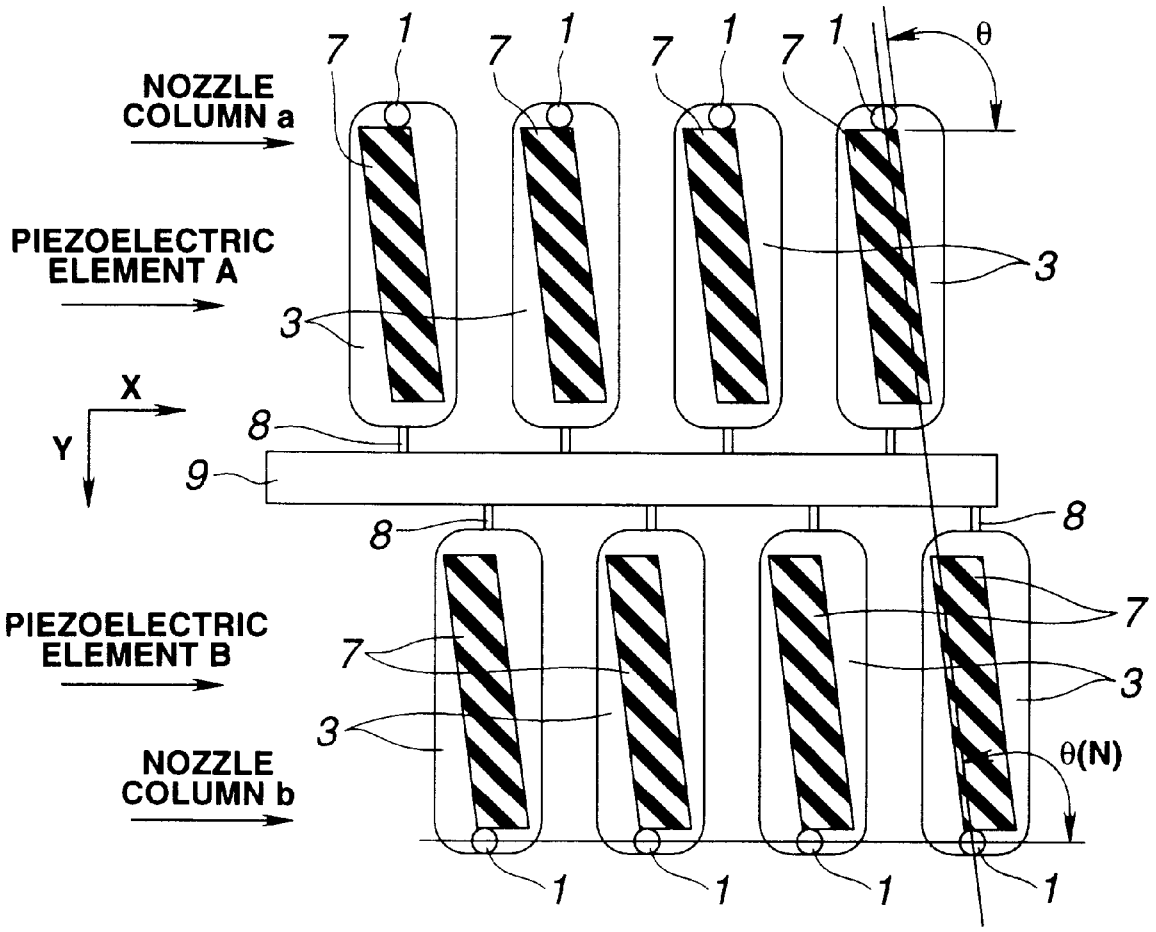
FIG. 75 is a plan view of another example of a print head to which the present invention is applied.

Note that, in the print head of this example, as shown in FIG. 65, the vertical angle $\theta$ of the parallelogram of the piezoelectric element 7 was set to an angle equal to the arrangement angle $\theta(N)$ of the plurality of nozzle columns a, b, and c, but if the piezoelectric elements 7 are arranged at the corresponding pressure chambers 3, as shown in FIG. 75, it is not always necessary to bring the vertical angle $\theta$ of the parallelogram of the piezoelectric elements 7 and the arrangement angle $\theta(N)$ of the plurality of nozzle columns a, b, and c into coincidence with each other.

Embodiment 7

Figure 76:
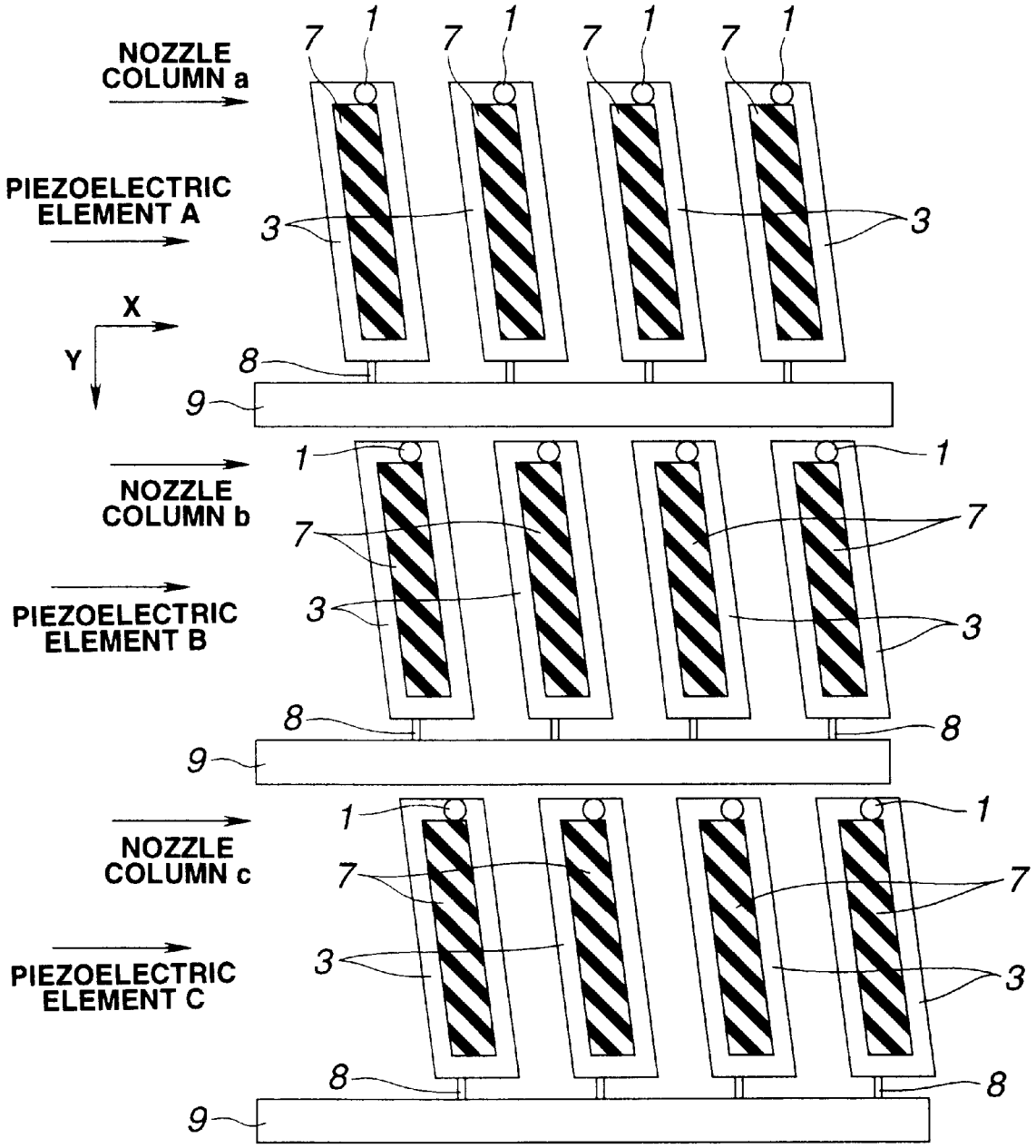
FIG. 76 is a plan view of still another example of a print head to which the present invention is applied.

In the print head in this example, as shown in FIG. 76, the shape of the pressure chambers 3 is made a parallelogram corresponding to the shape of the piezoelectric elements 7. The rest of the configuration is the same as that of the print head shown in previous FIG. 63 and FIG. 64. Accordingly, here, the same reference numerals are given to the same members as those of the print head of the previous embodiment and explanations of those portions will be omitted. Further, also the ink discharging operation in the print head and the method of production of this embodiment are the same as those of the previous print head, therefore the explanations thereof will be omitted.

In a print head having such a structure, a similar effect to that of the print head of Embodiment 6 is obtained and there is the following advantage: Namely, where a voltage is given to a piezoelectric element 7 and the vibrating plates 5 and 6 are deformed, the width of the vibrating plate 5 serving as the load becomes uniform over the entire surface of the pressure chamber 3, and the load of the vibrating plate 5 can be reduced in comparison with the shape shown in FIG. 3.

Embodiment 8

Figure 77:
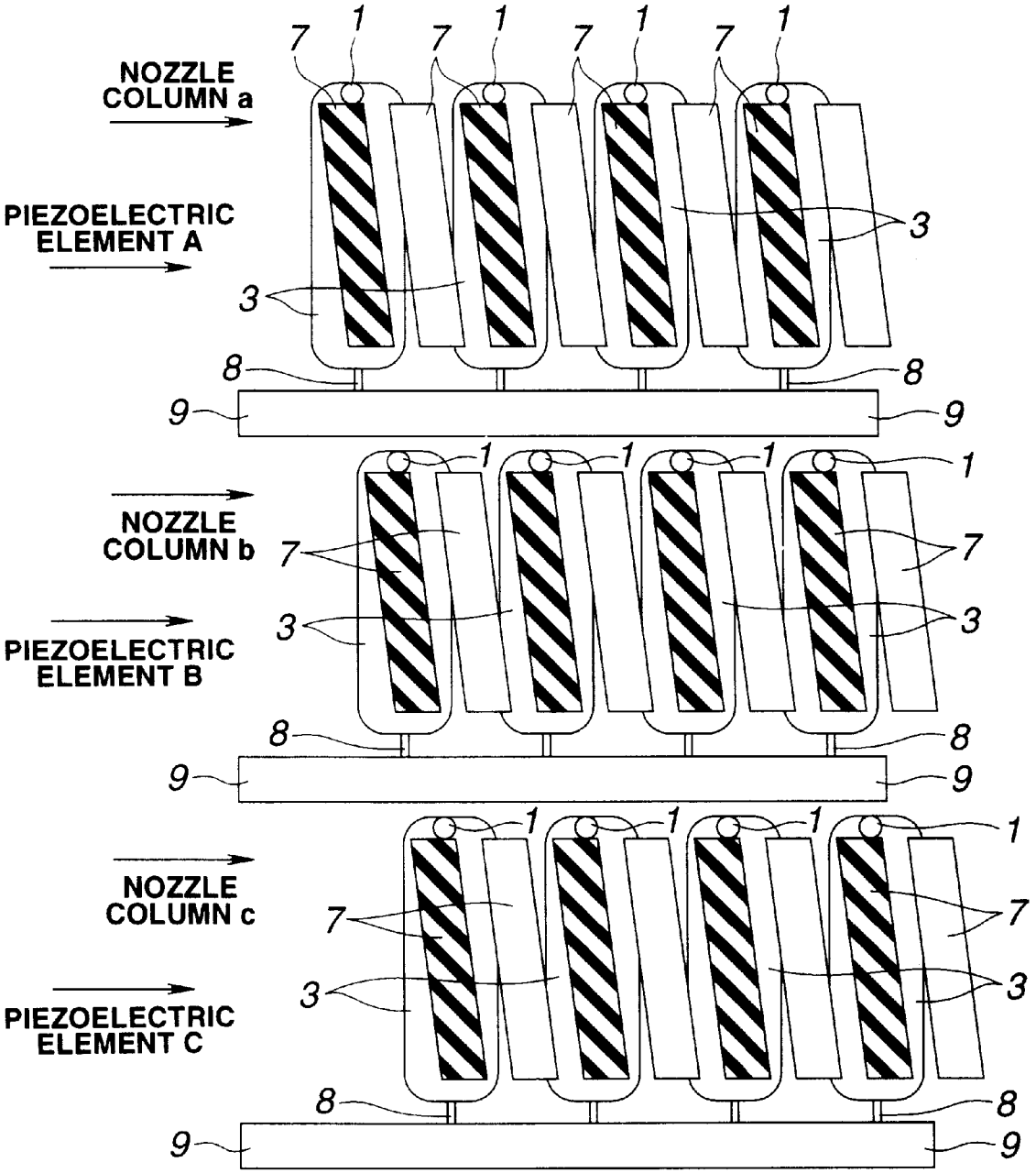
FIG. 77 is a plan view of still another example of a print head to which the present invention is applied.
Figure 78:
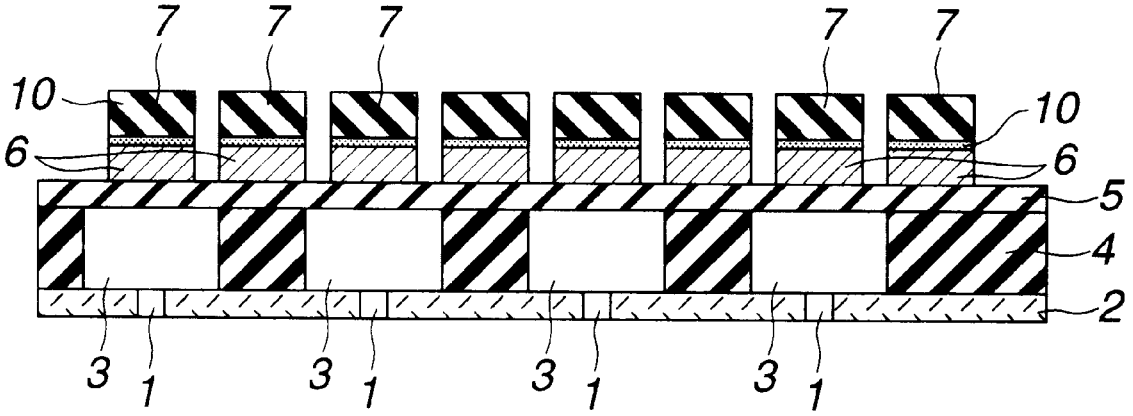
FIG. 78 is a lateral sectional view of still another example of a print head to which the present invention is applied.

The print head in this embodiment as shown in FIG. 77 and FIG. 78 has the same configuration as that of the previously explained print head shown in FIG. 65 except piezoelectric elements 7 not contributing to the imparting of pressure of the pressure chamber 3 (hereinafter, this will be referred to as the dummy piezoelectric element 7) are provided between the piezoelectric elements 7 contributing to the imparting of the pressure indicated by hatching in the figure (hereinafter, this will be referred to as the regular piezoelectric elements 7) provided corresponding to the pressure chambers 3 arranged in the nozzle columns a, b, and c.

Accordingly, here, the same reference numerals are given to the same members as those of the print head of the previous embodiment, and the explanations of those portions will be omitted. Further, also the ink discharging operation in the print head of this embodiment and the method of production are the same as those of the print head of Embodiment 6, therefore the explanation thereof will be omitted.

In a print head given such a configuration, a similar effect to that by the print head of Embodiment 6 is obtained. In addition, there is the following advantage. The dummy piezoelectric elements 7 are formed as parallelograms having a vertical angle θ of 90.5 degrees or more similar to the regular piezoelectric elements 7, but are different from the regular piezoelectric elements 7 in that they do not contribute to the imparting of the pressure of the pressure chamber 3. The dummy piezoelectric elements 7 do not act as regular piezoelectric elements, but instead make the pressure when bonded to the orifice plate 2 uniform and play the role of enhancing the bonding reliability and the mechanical strength.

Further, the regular piezoelectric elements 7 and the dummy piezoelectric elements 7 are arranged with periodicity with respect to the direction of arrangement of the pressure chambers 3, whereby in the cutting step of the piezoelectric element 7, a cutting tool having a narrow width with a little cutting resistance can be used and the cutting conditions can be made stable. More specifically, where the nozzle pitch is set to about 0.6 mm and the width of the regular piezoelectric elements 7 is set to about 0.2 mm, it is sufficient if a cutting tool having a width of about 0.1 mm is used so as to alternately arrange the regular piezoelectric elements 7 and the dummy piezoelectric elements 7. Contrary to this, where the regular piezoelectric elements 7 and the dummy piezoelectric elements 7 are not arranged with periodicity with respect to the direction of arrangement of the pressure chambers 3, it is necessary to use a cutting tool of about 0.4 mm, therefore the volume of the portion to be removed by cutting becomes large, and the cutting processing becomes troublesome.

Figure 79:
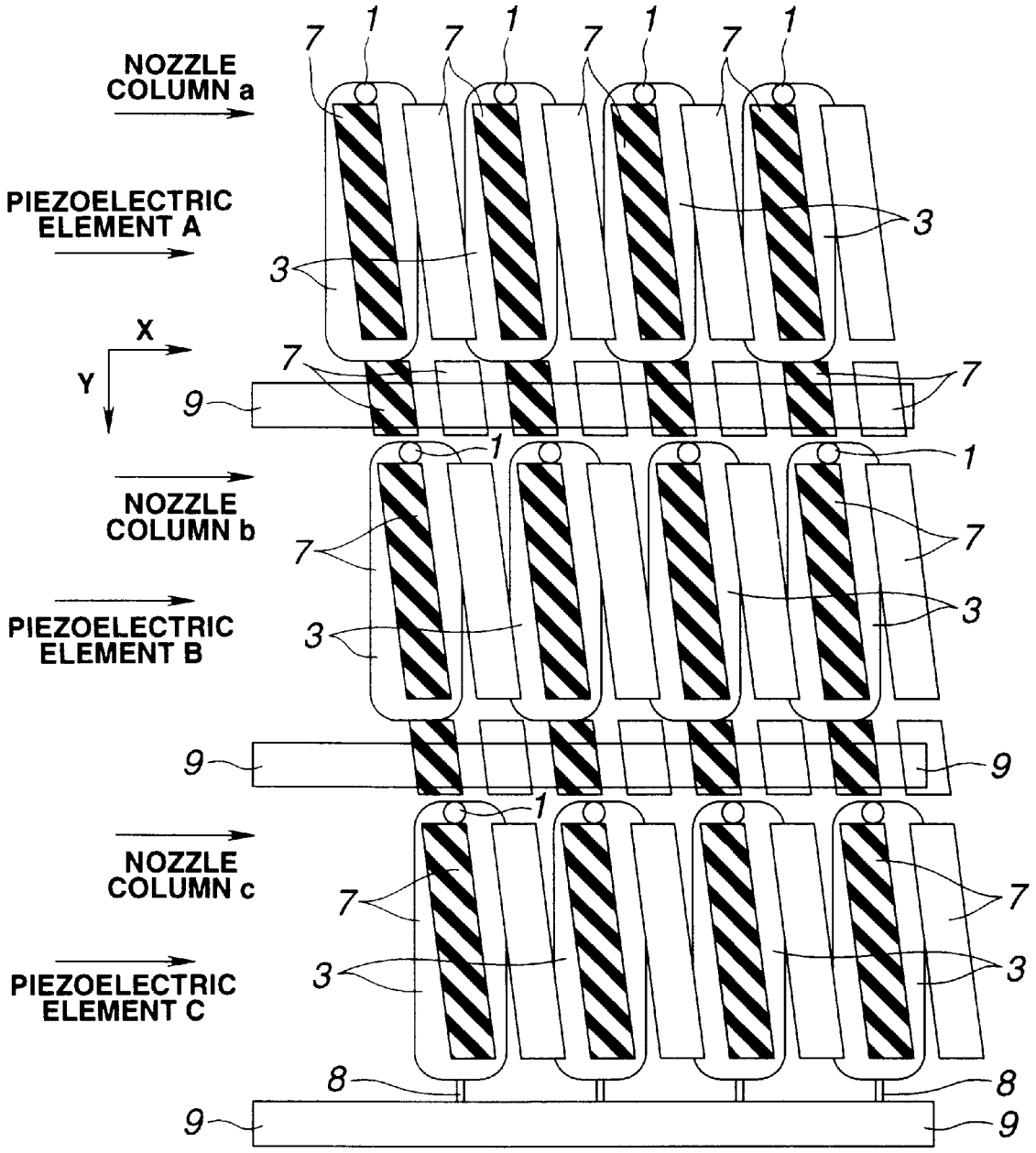
FIG. 79 is a plan view of a further example of a print head to which the present invention is applied.

Note that, as shown in FIG. 79, there is no problem even if the dummy piezoelectric elements 7 not contributing to the rise of the pressure exist between the piezoelectric element column A of the upper part and the piezoelectric element column B of the middle part and between the piezoelectric element column B of the middle part and the piezoelectric element column C of the lower part.

Embodiment 9

Figure 80:
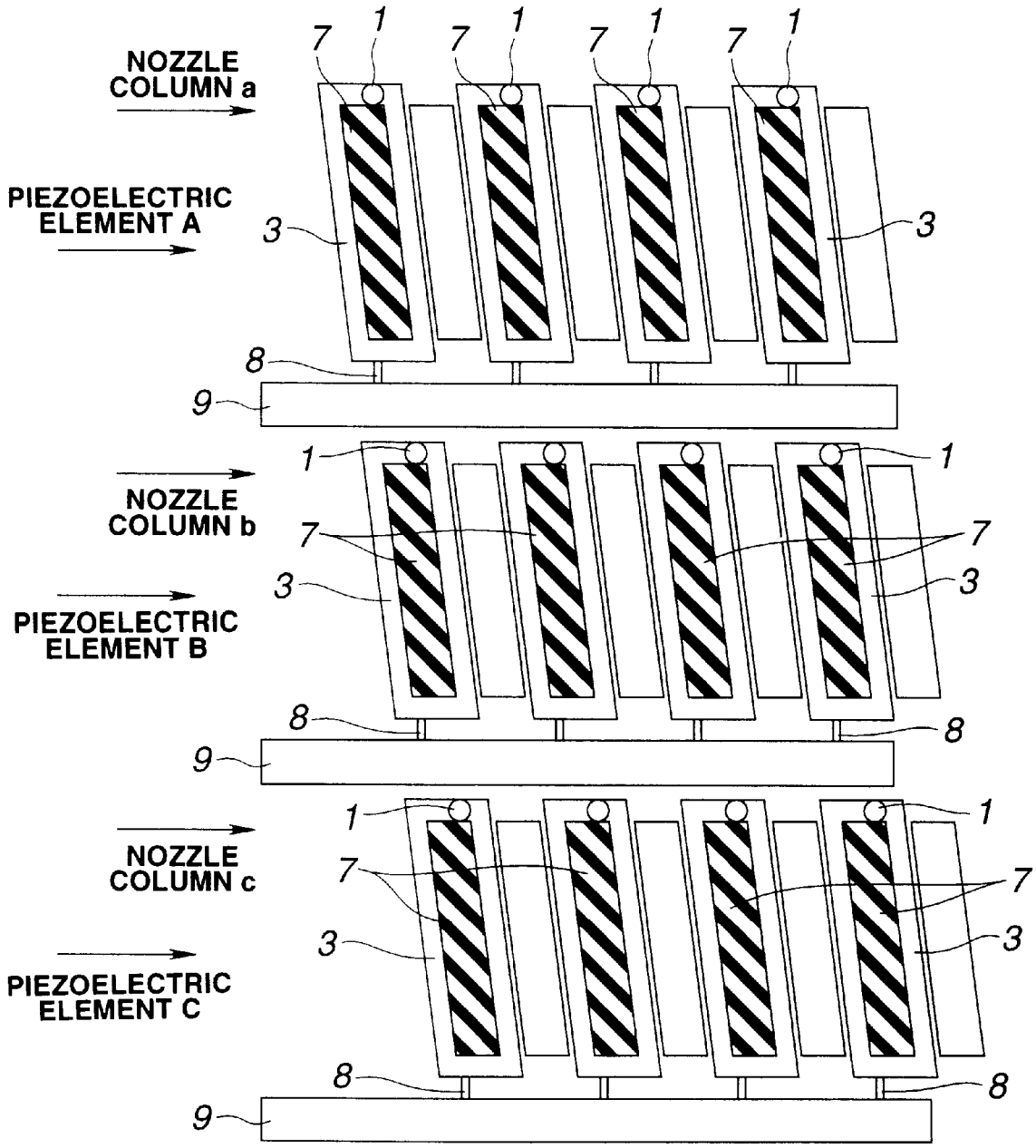
FIG. 80 is a plan view of still another example of a print head to which the present invention is applied.

The print head in this example has the same configuration as that of the previously explained print head shown in FIG. 76 except the dummy piezoelectric elements 7 are provided between the regular piezoelectric elements 7 provided corresponding to the pressure chambers 3 arranged in the nozzle columns a, b, and c as shown in FIG. 80.

Accordingly, here, the same reference numerals are given to the same members as those of the print head of Embodiment 6, and explanations of those portions will be omitted. Further, also the ink discharging operation and the method of production in the print head of this embodiment are the same as those of the print head of Embodiment 6, therefore the explanations thereof will be omitted In the print head given such a configuration, a similar effect to that by the print head of Embodiment 8 is obtained, and the production process becomes further easier. In addition, an improvement of the bonding reliability and the mechanical strength is realized.

Embodiment 10

Here, an explanation will be made of the printer apparatus on which the above print head is actually mounted.

Figure 81:
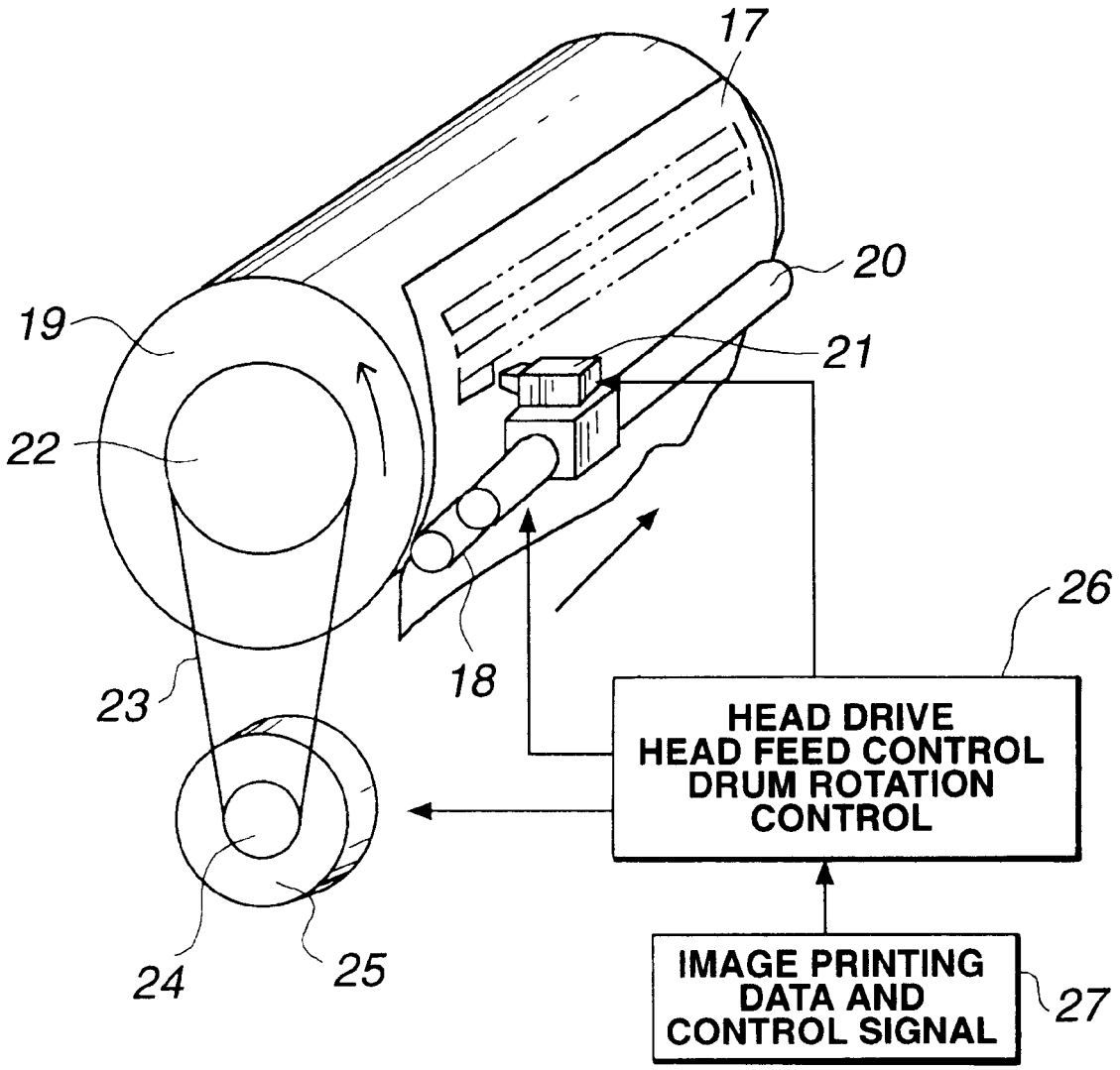
FIG. 81 is a schematic structural view of a serial type printer apparatus.

The print head is mounted on a serial type printer apparatus as shown in for example FIG. 81. A print sheet 17 serving as the printed object is brought into press-contact with a drum 19 and held by a sheet press-fixing roller 18 provided in parallel to the drum axis direction. In the vicinity of the outer periphery of that drum 19, a feed screw 20 is provided in parallel to the drum axis direction. The print head 21 is held at this feed screw 20. Such a print head 21 is moved in the axial direction of the drum 19 by the rotation of the feed screw 20.

On the other hand, the drum 19 is driven to rotate by a motor 25 via a pulley 22, a belt 23, and a pulley 24. Further, the rotation of the feed screw 20 and the motor 25 and the driving of the print head 21 are controlled by a driving control unit 26 based on the image printing data and a control signal 27.

In the above configuration, when the print head 21 moves and performs one row's worth of printing, the drum 19 is made to rotate exactly by the amount of one row and the next printing is carried out. The case where the print head 19 moves and performs the image printing includes a case of one direction and a case of a reciprocal direction.

Figure 82:
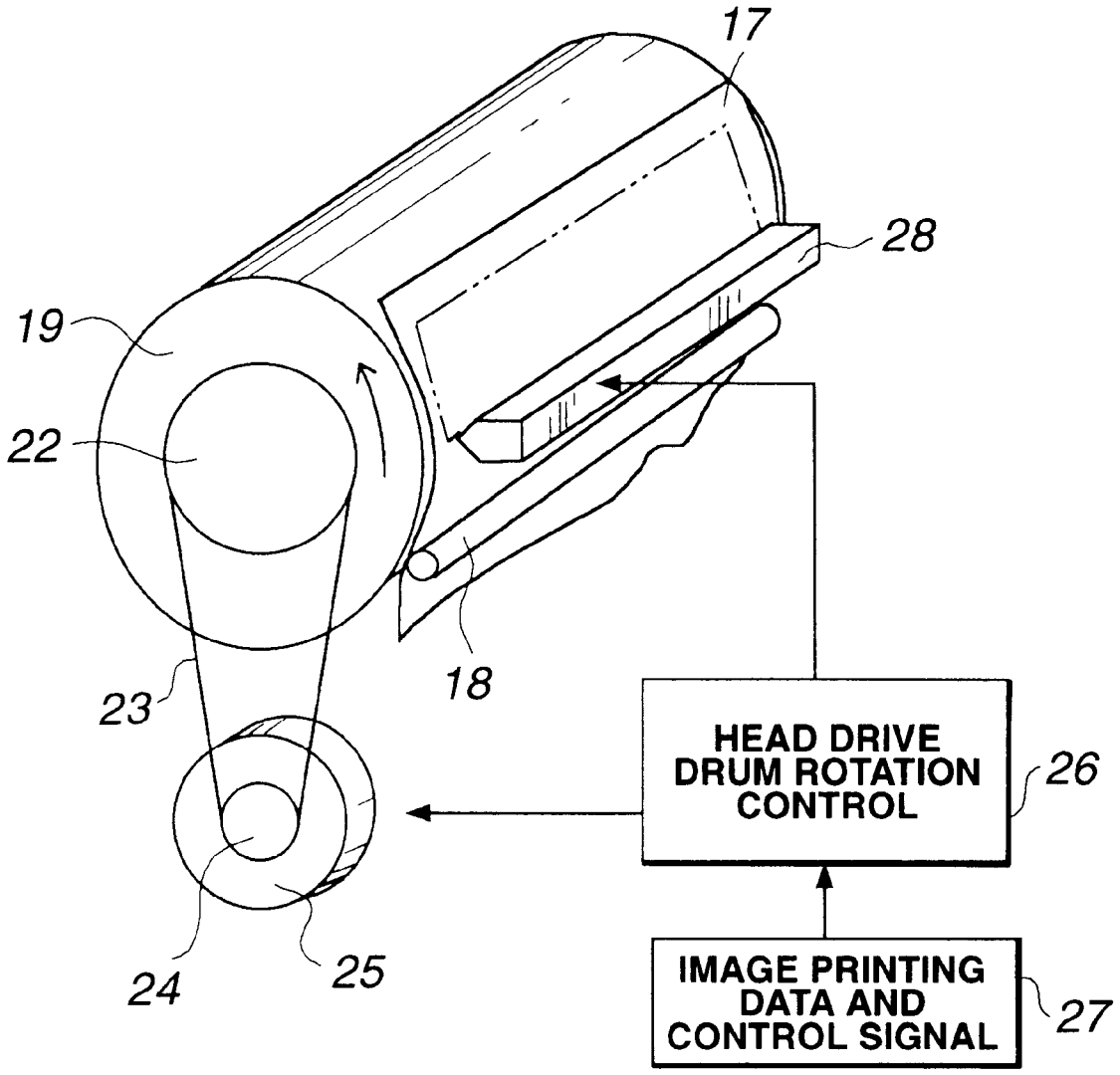
FIG. 82 is a schematic structural view of a line type printer apparatus.

FIG. 82 shows an example of the configuration of the line type. In this case, in place of the serial type print head 21 and feed screw 20 shown in FIG. 81, a line head 28 by arranging a large number of heads in the form of a line is provided affixed in the axial direction. In this configuration, one row's worth of printing is simultaneously carried out by the line head 28 and, when the printing is completed, the drum 19 is made to rotate exactly by the amount of one row and the printing of the next row is carried out. In this case, consideration may also be given to a method in which the printing is carried out for all lines together, the printing is divided into a plurality of blocks, or the printing is alternately carried out for every other row.

Figure 83:
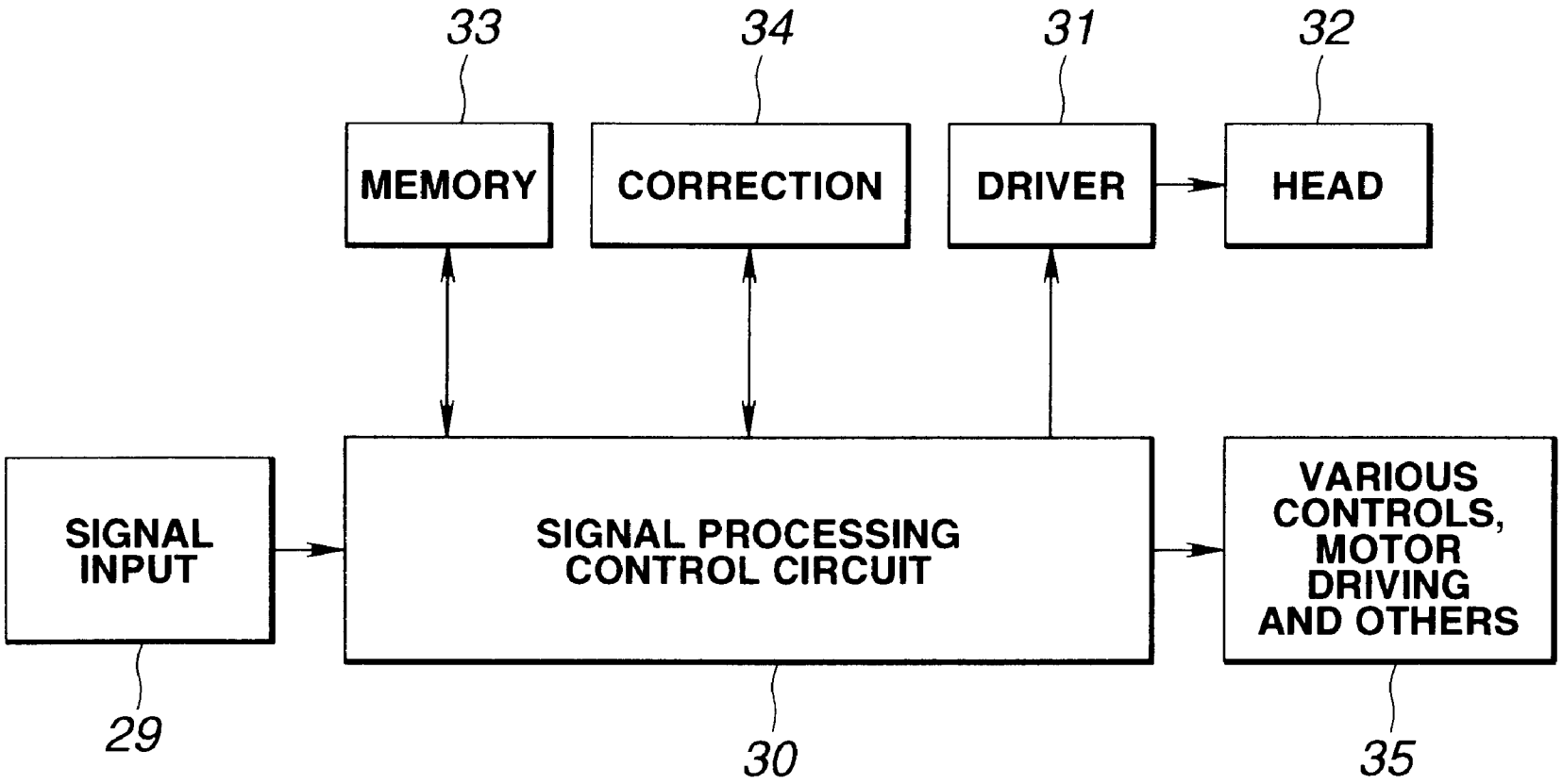
FIG. 83 is a block diagram of a control system.

FIG. 83 is a block diagram of the printing and control system. A signal 29 such as printing data is input to a signal processing control circuit 30, arranged in order of printing in this signal processing control circuit 30, and sent to a head 32 via a driver 31. The printing order is different according to the configuration of the head 32 and the printing portion and is related to the order of input of the printing data too. The data is once recorded in a memory 33 such as a line buffer memory or single screen memory or the like and then taken out according to need. A tone signal and discharge signal are input to the head 32.

Note that, where the head is a multi-head and the number of the nozzles is very large, an IC is mounted on the head 32 to reduce the number of wirings to be connected to the head 32. Further, a correcting circuit 34 is connected to the signal processing control circuit 30 and performs a ν-correction, color correction in the case of color, a correction of variation among different heads, etc.

In general, predetermined correction data is stored in the correcting circuit 34 in the form of a ROM map and taken out in accordance with the external conditions, for example, the number of nozzles, temperature, input signal, etc. In general, the signal processing control circuit 30 is constituted by a CPU or DSP and the data is processed by software. The processed signal is sent to various control units 35.

In the respective control units 35, the control of the driving of the motor rotating the drum 19 and the feed screw 20, the synchronization, the cleaning of the heads 21 and 28, the feed of the print sheet 17, the discharge, etc. is carried out. Further, needless to say the signal includes the operating unit signals and external control signals other than the printing data.

While the invention has been described by reference to specific embodiments chosen for purposes of illustration, it should be apparent that numerous modifications could be made thereto by those skilled in the art without departing from the basic concept and scope of the invention.

What is claimed is:

1. A printer apparatus comprising:

a discharge nozzle;

a pressure chamber in fluid communication with said discharge nozzle;

a plurality of layers of vibrating plates adjacent said pressure chamber, the plurality of layers of vibrating plates having at least one vibrating plate which forms a complete side wall of the pressure chamber;

a piezoelectric element formed on a top one of said vibrating plates; and an electrically conductive adhesive formed directly at a boundary between said vibrating plates and the piezoelectric element, wherein the piezoelectric element is a mask and a vibrating plate adjacent the at least one vibrating plate is comprised of a material different than a material of the at least one vibrating plate forming the complete side wall and wherein the at least one vibrating plate forming the complete side wall acts as an etching stopper for an etchant of the adjacent vibrating plate.

2. A printer apparatus according to claim 1, wherein at least one layer of said plurality of layers of vibrating plates is comprised of a metal material.

3. A printer apparatus according to claim 1, wherein the vibrating plates other than the vibrating plate forming the side wall are comprised primarily of copper.

4. A printer apparatus according to claim 1, wherein the vibrating plate forming the side wall is comprised primarily of nickel.

5. A printer apparatus according to claim 1, wherein the vibrating plate forming the side wall is comprised primarily of titanium.

6. A printer apparatus according to claim 1, wherein said plurality of layers of vibrating plates are formed by bonding individually rolled starting materials in vacuum.

7. A printer apparatus according to claim 1, further comprising an alloy of metal composed of gallium, indium, and tin and a material constituting the vibrating plates is arranged at the boundary between said vibrating plates and the piezoelectric element.

8. A printer apparatus according to claim 1, further comprising an alloy of metal composed of gallium, indium, and zinc and a material constituting the vibrating plates is formed at the boundary between said vibrating plates and the piezoelectric element.

9. A printer apparatus according to claim 1, wherein said plurality of layers of vibrating plates are comprised of three or more layers and the pressure chamber is formed adjacent a lowermost layer of the vibrating plates.

10. A printer apparatus according to claim 9, wherein a nozzle is further formed in said lowermost layer of the vibrating plates.

11. A printer apparatus according to claim 1, wherein each of the vibrating plates adjacent the vibrating plate forming the complete side wall do not extend the complete length of the side wall.

12. A printer apparatus according to claim 1, wherein at least one of the vibrating plates adjacent the vibrating plate forming the complete side wall does not extend the complete length of the side wall.

13. A printer apparatus according to claim 1, wherein the vibrating plates adjacent the vibrating plate forming the complete side wall do not extend the complete length of the side wall.

14. A printer apparatus comprising:

a plurality of discharge nozzles, a plurality of pressure chambers in fluid communication with respective ones of said plurality of discharge nozzles;

a plurality of layers of vibrating plates adjacent said plurality of pressure chambers;

a plurality of piezoelectric elements arranged on top of said plurality of layers of vibrating plates; and an electrically conductive adhesive formed directly at a boundary between said vibrating plates and said piezoelectric elements, the plurality of layers of vibrating plates having at least one layer forming a side wall for all of said plurality of pressure chambers, the remaining plurality of layers of vibrating plates including at least one layer which is partially removed using the plurality of piezoelectric elements as a mask and wherein the at least one layer forming the complete side wall is an etching stopper.

15. A printer apparatus according to claim 14, wherein said plurality of piezoelectric elements include piezoelectric elements contributing to an imparting of pressure to the pressure chambers and piezoelectric elements not contributing to the imparting of pressure to the pressure chambers and wherein these two types of piezoelectric elements are cyclically arranged with respect to plurality of pressure chambers.

16. A printer apparatus according to claim 15, wherein the piezoelectric elements contributing to an imparting of pressure to the pressure chambers and the piezoelectric elements not contributing to the imparting of pressure to the pressure chambers are alternately arranged on the vibrating plates.

17. A printer apparatus according to claim 15, wherein the piezoelectric elements contributing to an imparting of pressure to the pressure chambers and the piezoelectric elements not contributing to an imparting of pressure to the pressure chambers are cyclically arranged in a column direction of the pressure chambers and a direction orthogonal thereto.

18. A printer apparatus according to claim 14, wherein a shape of said plurality of piezoelectric elements is substantially a parallelogram.

19. A printer apparatus according to claim 14, wherein said piezoelectric elements have a vertical angle of at least 90.5 degrees with respect to a plane of the vibrating plates.

20. A printer apparatus according to claim 14, wherein the pressure chambers are shaped as parallelograms having a vertical angle of at least 90.5 degrees with respect to a plane of the vibrating plates.

21. A printer apparatus according to claim 15, wherein the piezoelectric elements contributing to an imparting of pressure to the pressure chambers and the piezoelectric elements not contributing to the imparting of pressure to the pressure chambers are cyclically arranged with respect to the pressure chambers and a shape of the piezoelectric elements is substantially a parallelogram.

22. A printer apparatus according to claim 14, wherein at least one of the vibrating plates adjacent the vibrating plate forming the complete side wall does not extend the complete length of the side wall.

* * * * *